United States Patent [19]

Gross et al.

[11] 4,187,548

[45] Feb. 5, 1980

[54] SIMULATION OF CATALYTIC CRACKING PROCESS

[75] Inventors: Benjamin Gross; Solomon M. Jacob, both of Cherry Hill; Donald M. Nace, Woodbury, all of N.J.; Sterling E. Voltz, Media, Pa.

[73] Assignee: Mobil Oil Corporation, New York, N.Y.

[21] Appl. No.: 472,525

[22] Filed: May 23, 1974

Related U.S. Application Data

[63] Continuation of Ser. No. 148,051, May 28, 1971, abandoned.

[51] Int. Cl.² ..... G06F 15/32

[52] U.S. Cl. ..... 364/578; 364/121

[58] Field of Search ..... 235/151.12, 151.35, 235/150; 444/1; 208/113; 364/121, 200, 900, 578, 500–501

[56] References Cited

U.S. PATENT DOCUMENTS

| | | | |
|---|---|---|---|
| 3,591,783 | 7/1971 | Zumwalt | 235/151.12 |
| 3,702,003 | 10/1972 | Ramirez, Jr. et al. | 235/151.12 X |
| 3,725,653 | 4/1973 | Carr et al. | 235/151.12 |

*Primary Examiner*—Edward J. Wise

*Attorney, Agent, or Firm*—Charles A. Huggett; Michael G. Gilman

[57] ABSTRACT

The specific disclosure is directed to a catalytic cracking model wherein the reactant and product species are lumped according to molecular type and boiling range. The specific invariant lumping scheme includes paraffins, naphthenes, aromatic rings, and aromatic substituent groups.

5 Claims, 33 Drawing Figures

LUMPED KINETIC SCHEME

FIG. 3

MATRIX OF RATE CONSTANTS $\underset{\approx}{K}$ $$
\begin{array}{c}
 \\ P_h \\ N_h \\ A_h \\ C_{Ah} \\ P_\ell \\ N_\ell \\ A_\ell \\ C_{A\ell} \\ G \\ C
\end{array}
\begin{array}{c}
\begin{array}{ccccccccccc}
P_h & N_h & A_h & C_{Ah} & P_\ell & N_\ell & A_\ell & C_{A\ell} & G & C
\end{array} \\
\begin{pmatrix}
-(K_{php\ell}+K_{phg}+K_{phc}) & & & & & & & & & \\
 & -(K_{nhn\ell}+K_{nhg}+K_{nhc}) & & & & & & & & \\
 & & -(K_{ah\ell}+K_{ahg}+K_{ahc}+K_{ahca\ell}) & & & & & & & \\
 & & & -(K_{cahca\ell}+K_{cahc}) & & & & & & \\
\nu_{h\ell}\ K_{php\ell} & & & & -(K_{p\ell g}+K_{p\ell c}) & & & & & \\
 & \nu_{h\ell}\ K_{nhn\ell} & & & & -(K_{n\ell g}+K_{n\ell c}) & & & & \\
 & & \nu_{h\ell}\ K_{ah\ell} & & & & -(K_{a\ell g}+K_{a\ell c}) & & & \\
 & & \nu_{h\ell}\ K_{ahca\ell} & \nu_{h\ell}\ K_{cahca\ell} & & & & -K_{ca\ell c} & & \\
\nu_{hg}\ K_{phg} & \nu_{hg}\ K_{nhg} & \nu_{hg}\ K_{ahg} & 0 & \nu_{\ell g}\ K_{p\ell g} & \nu_{\ell g}\ K_{n\ell g} & \nu_{\ell g}\ K_{a\ell g} & 0 & -K_{gc} & \\
\nu_{hc}\ K_{phc} & \nu_{hc}\ K_{nhc} & \nu_{hc}\ K_{ahc} & \nu_{hc}\ K_{cahc} & \nu_{\ell c}\ K_{p\ell c} & \nu_{\ell c}\ K_{n\ell c} & \nu_{\ell c}\ K_{a\ell c} & \nu_{\ell c}\ K_{ca\ell c} & \nu_{gc}\ K_{gc} & 0
\end{pmatrix}
\end{array}
$$

where, $\nu_{h\ell}$ = Stoichiometric coefficient (Mol. Wt. of heavy fuel oil/Mol. Wt. of light fuel oil)
$\nu_{hg}$ = " " (Mol. Wt. of heavy fuel oil/Mol. Wt. of gasoline)
$\nu_{hc}$ = " " (Mol. Wt. of heavy fuel oil/Mol. Wt. of C lump)
$\nu_{\ell g}$ = " " (Mol. Wt. of light fuel oil/Mol. Wt. of gasoline)
$\nu_{\ell c}$ = " " (Mol. Wt. of light fuel oil/Mol. Wt. of C lump)
$\nu_{gc}$ = " " (Mol. Wt. of gasoline/Mol. Wt. of C lump)

Computed Vs. Observed Time-Averaged Gasoline Yields

Computed Vs. Observed Time-Averaged C Lump Yields

Computed Vs. Observed Time-Averaged LFO Yields

Observed Vs. Computed Time-Averaged Gasoline Yields ($t_c$ = 5.0 Minutes)
As a Function of Charge Stock Observed Vs. Computed Time-Averaged Gasoline Yields ($t_c$ = 1.25 Minutes)
As a Function of Charge Stock Model Selectivity Plot for a Naphthenic Charge Stock (N3)
$t_c$ = 5.0 Minutes, Temp = 900°F Model Selectivity Plots for a Paraffinic Charge Stock (P3)
$t_c$ = 5.0 Minutes, Temp = 900°F Predicted Vs. Experimenal Cracking Yields at a Catalyst Residence Time of 10 Minutes Experimental Cracking Yields Vs. Computed Yields for WCMCGO with 0.1 Wt. % Addition Basic N as Quinoline Experimental Cracking Yields Vs. Computed Yields for WCMCGO with 0.2 Wt. % Addition Basic N as Quinoline Predicted Vs. Observed Ethylene Yields in Catalytic Cracking Predicted Vs. Observed Normal Butane Yields in Catalytic Cracking

SIMULATION OF CATALYTIC CRACKING PROCESS

This application is a continuation of application Ser. No. 148,051, filed May 28, 1971, now abandoned.

BACKGROUND OF THE INVENTION

1. Field of the Invention

The present invention is directed to a method and a system for simulating a catalytic cracking process. More particularly, the present invention is directed to a kinetic computer model for a catalytic cracking process.

2. Description of the Prior Art

In a refinery operation such as a fluid catalytic cracking system, the number of different molecules involved runs into the thousands. Consequently, it is impossible, or at least greatly impractical, to investigate each of the thousands of molecules to determine the kinetics of a system or to characterize feed stocks or products. However, it is known to partition molecules into a number of classes and then to consider each class as an independent entity. For example, it is possible to consider all oxygen molecules as "oxygen", even though the kinetic energies of the individual oxygen molecules are different. Such grouping or lumping is used in a standard petroleum processing analysis known as PONA, in which all species are divided into 4 classes: paraffins, olefins, naphthenes and aromatics.

SUMMARY OF THE INVENTION

In accordance with the present invention, there is provided a method for simulation of a catalytic cracking process for the conversion of the hydrocarbon feed stream wherein the stream is contacted with an active catalyst in a reactor maintained under catalytic conversion conditions to provide reaction products which are removed from the reactor. The catalyst in the reactor becomes contaminated by the deposition of coke thereon. The simulation method comprises programming an automatic processing system to (a) generate rates of change of hydrocarbon reactants in the reactor in accordance with:

$$\underset{\sim}{da}/dt = Q\underset{\approx}{K}\,\underset{\sim}{a}$$

where da/dt = rates of reaction,

Q = catalyst properties and process variables, $\underset{\approx}{K}$ = matrix of reaction rate constants lumped kinetically and according to boiling range, and $\underset{\sim}{a}$ = composition vector of reactants and product species lumped according to molecular type and boiling range, and, (b) generate the composition vector $\underset{\sim}{a}$ as a function of reaction time.

In accordance with another aspect of the present invention, there is provided a system for simulating a catalytic cracking process for the conversion of a hydrocarbon feed stream wherein the stream is contacted with an active catalyst in a reactor maintained under catalytic conversion conditions to provide reaction products which are removed from the reactor. The catalyst in the reactor becomes contaminated by the deposition of coke thereon. The system comprises processing means programmed to generate rates of change of hydrocarbon reactants in the reactor in accordance with:

$$\underset{\sim}{da}/dt = Q\underset{\approx}{K}\,\underset{\sim}{a}$$

where da/dt = rates of reaction,

Q = catalyst properties and process variables, $\underset{\approx}{K}$ = matrix of reaction rate constants lumped kinetically and according to boiling range, and $\underset{\sim}{a}$ = composition vector of reactants and product species lumped according to molecular type and boiling range.

The processing means is further programmed to generate the composition vector $\underset{\sim}{a}$ as a function of reaction time.

BRIEF DESCRIPTION OF THE DRAWINGS

FIG. 3 is a matrix of rate constants for a specific embodiment of the present invention.

DESCRIPTION OF SPECIFIC EMBODIMENTS

Figure 1:
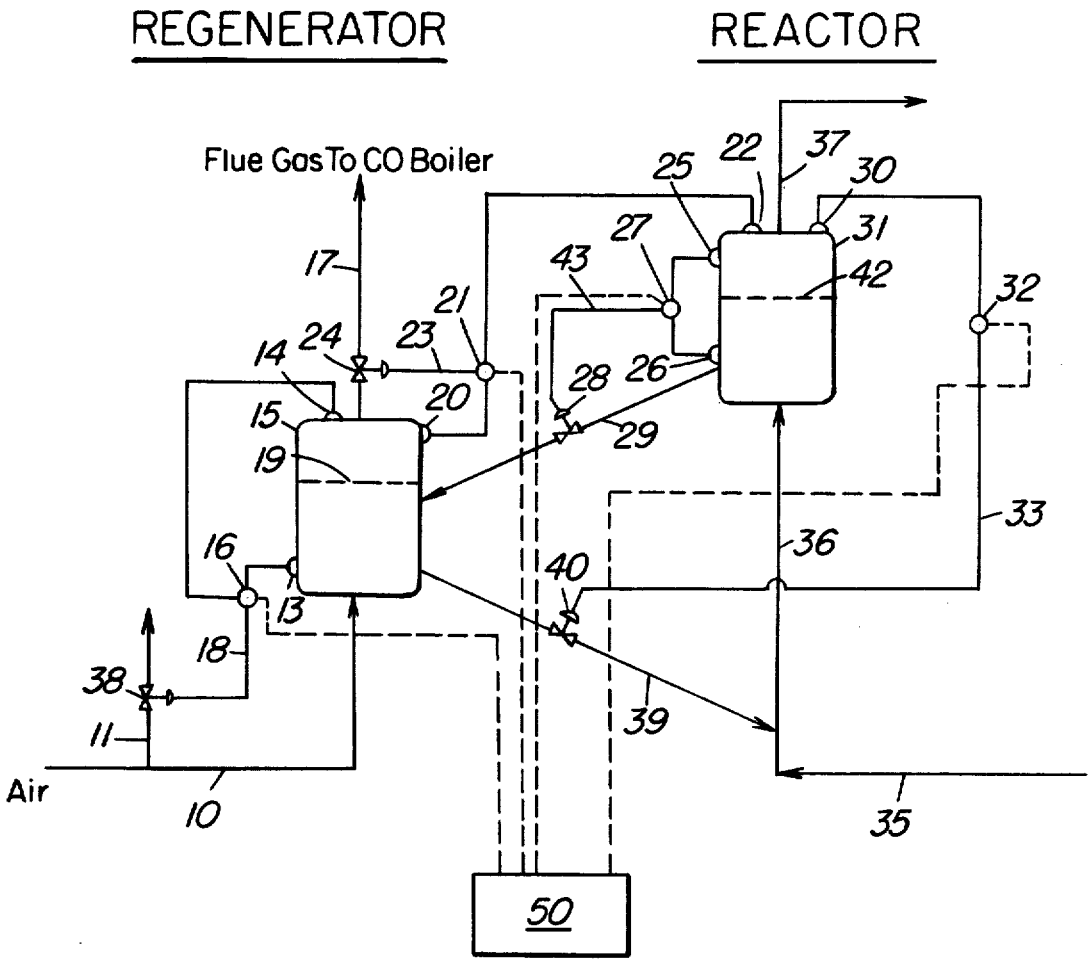
FIG. 1 is a block diagram of a catalyst section of a fluid catalytic cracking process.

FIG. 1 shows the essentials of a typical catalyst section control system wherein fresh hydrocarbon feed which can include recycle oil from a fractionator (not shown) is applied by a line 35 to the lower end of a riser line 36. Heated regenerated catayst from a standpipe 39 having a control 40 is combined with the oil in the riser line 36 such that an oil-catalyst mixture rises in an ascending dispersed stream to the lower end of a reactor 31. In the reactor 31, there may be further fluidized contacting between the oil and the catalyst particles within a relatively dense fluidized bed diagrammatically represented below the dashed line 42. Generally, a major portion of the necessary cracking and contact of the oil with the catalyst takes place in the riser 36.

At the upper end of the reactor, the catalyst particles are separated from the vaporous cracked reaction products by cyclone separating means (not shown). The reaction products are transferred overhead by a line 37 to a products recovery section which includes at least one fractionator (not shown). A stream of spent or coked catalyst is continuously passed from the reactor 31 to a regenerator 15 by a spent catalyst transfer line 29 having a control valve 28 such that the catalyst is transferred to the regenerator 15 at a controlled rate.

In the regenerator 15, the carbonized or coked catalyst particles are subjected to oxidation and carbon removal in the presence of air being introduced to the regenerator by a line 10. A bypass line 11 having a control valve 38 is connected to the line 10 to vent a portion of the air being introduced into the regenerator 15 and thus regulate the flow rate of air.

In the lower portion of the regenerator 15, a fluidized dense phase bed diagrammatically represented as below the dashed line 19 provides for contact between the coked catalyst particles and the oxidizing air stream. In the upper portion of the regenerator 15, a light phase zone permits the separation of catalyst particles by suitable centrifugal separating means (not shown) from a flue gas stream being discharged from the regenerator 15 by a line 17 having a control valve 24 therein. The line 17 vents the regenerator flue gas or feeds the flue gas to a carbon monoxide boiler (not shown) where the carbon monoxide is converted to carbon dioxide.

A level controller 27 is connected by level indicating taps 25, 26 to the side wall of the reactor 31. A control line 43 from the level controller 27 is connected to the valve 28 in the transfer line 29 to control the flow rate of catalyst through the transfer line 29. Thus, the dense phase bed 42 level and quantity of catalyst in the lower portion of the reactor 31 are maintained at desired values. A temperature controller 32 is connected to a temperature indicating means 30 at the upper portion of the reactor 31, and generates a control signal on a line 33 to control the setting of the valve 40. Thus, a variable quantity of hot regenerated catalyst may be withdrawn from the standpipe 39 to the riser line 36 to maintain a predetermined reactor temperature as defined by the set point of the temperature controller 32.

A pressure sensitive means 22 is positioned in the upper part of the reactor 31, and another pressure sensitive means 20 is positioned in the upper portion of the regenerator 15. The pressure sensitive means 20, 22 are connected to a differential pressure regulator 21 having an adjustable set point to maintain a desired differential pressure between the reactor 31 and the regenerator 15. The differential pressure regulator 21 is connected by a line 23 to the control valve 24 in the line 17 to regulate the flue gas flow through the line 17 and in turn vary the internal pressure within the upper portion of the regenerator 15 to thereby maintain the desired pressure difference between the reactor 31 and the regenerator 15. Generally, the pressure differential between the reactor 31 and the regenerator 15 is relatively low, for example, in the order of about 6 psi, and is necessary to permit the maintenance of suitable pressure differentials across the slide valves 28, 40 in the spent catalyst transfer line 29 and in the standpipe 39 to thus provide for a continuous circulation of catalyst particles between the reactor 31 and the regenerator 15.

Temperature indicating means 13, 14 within the lower and upper portions of the regenerator 15 are connected to a differential temperature controller 16, which in turn is connected by a line 18 to the valve 38 in the air vent line 11. Thus, when the temperature differential between the lower and the upper portions of the regenerator 15 varies from a predetermined differential as defined by the set point of the differential pressure controller 16, the valve 38 in the vent line 11 is adjusted to control the amount of air flowing in the line 10 to the lower portion of the regenerator 15.

In accordance with an aspect of the present invention, there is provided a lumped invariant kinetic model for catalytic cracking processes. The model contains an invariant kinetic scheme of simultaneous and consecutive reactions to predict the product yields produced in the reactor such as that shown in FIG. 1. The yields predicted in this specific embodiment are gasoline, light fuel oil, and light ends+coke (C lump). Correlation methods based on certain kinetic principles are used to break the C lump into individual light ends and coke.

The lumping scheme groups kinetically similar molecules or components according to boiling range of the molecules or components. The lumping scheme according to a specific embodiment is based on the concentrations of paraffins, naphthenes, aromatic rings, and aromatic substituent groups (paraffinic and naphthenic groups attached to aromatic rings) in the charge stock in line 35 and appears adequate to predict the major product yields in the cracking of widely different charge stocks under a broad range of process conditions. Gas oils of wide boiling range have thousands of compounds of different molecular structures and molecular weights. However, the kinetic behavior of so many different molecules can be reasonably accounted for by such a relatively simple lumping scheme in accordance with this specific embodiment. The product yields of virgin gas oils can be adequately predicted by the simple lumping scheme of paraffins, naphthenes, and aromatics; however, it is necessary to split the aromatics into aromatic rings and aromatic substituent groups to include recycle feedstocks in the model. This is not unexpected, since the molecular compositions of recycle feeds are significantly different from those of virgin gas oils. Recycle feedstocks are generally recycled from the fractionator (not shown) downstream on line 37, and are combined with the fresh charge stock in the line 35.

In addition to the lumping scheme, other factors have been incorporated into the model of the present embodiment to account for process variables and other related phenomena. A catalyst decay term is provided to account for the rapid deactivation of the catalyst which occurs during the catalytic cracking of gas oils in the line 36 and the reactor 31. Other features are an adsorption term for nitrogen poisoning, activation energies, molecular weight, residual carbon on regenerated catalyst in the line 39, and some catalyst effects.

Lumping and Reaction Scheme

Figure 2:
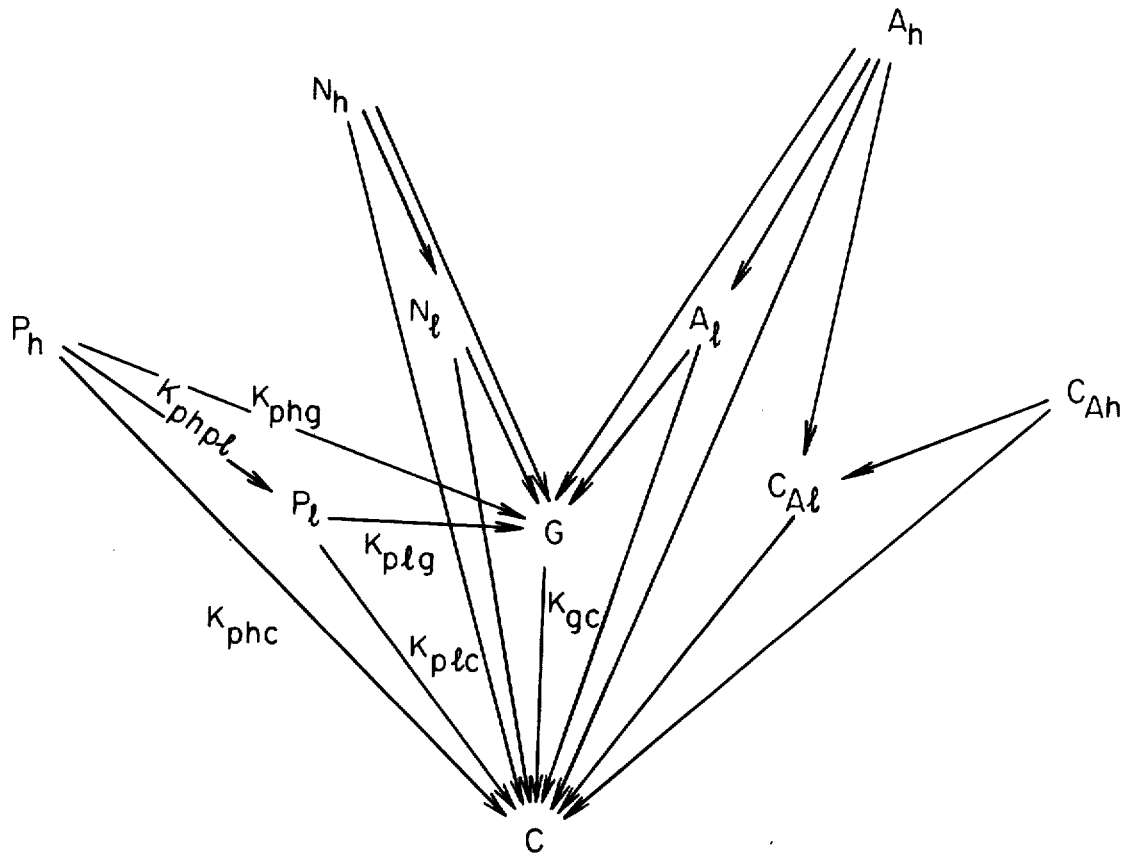
FIG. 2 shows a kinetic scheme for a specific embodiment of the present invention.

The lumped invariant kinetic model for fluid catalytic cracking such as shown in FIG. 1 consists of a kinetic scheme shown in FIG. 2. With reference to FIG. 2, ten lumps are provided to follow the cracking of virgin gas oils and recycle oil charge stocks. The lumps of FIG. 1 are:

$P_l$=Wt. % paraffinic molecules, (mass spec analysis), 430°-650° F.

$N_l$=Wt. % naphthenic molecules, (mass spec analysis), 430°-650° F.

$C_{Al}$=Wt. % carbon atoms among aromatic rings, (n-d-M method), 430°-650° F.

$A_l$=Wt. % aromatic substituent groups (430°-650° F.)

$P_h$=Wt. % paraffinic molecules, (mass spec analysis), 650° F.+

$N_h$=Wt. % naphthenic molecules, (mass spec analysis), 650° F.+

$C_{Ah}$=Wt. % carbon atoms among aromatic rings, n-d-M method, 650° F.+

$A_h$=Wt. % aromatic substituent groups (650° F.+)

G=G lump ($C_5$+ −430° F.)

C=C lump ($C_1-C_4$+coke)

$C_{Al}+P_l+N_l+A_l=LFO$ (430° F.-650° F.)

$C_{Ah}+P_h+N_h+A_h+HFO$ (650° F.+)

Adapted Nomenclature for rate constants is detailed in the FIG. 2 for paraffinic molecules. Similar rules apply for the other reaction steps.

This lumping scheme successfully treats gasoline (G lump, $C_5$+ −430° F.), C lump ($H_2$, $H_2S$, $C_1$-$C_4$,-+coke), light fuel oil, LFO, (430°-650° F.) yields resulting from gas oil cracking. It will be noted that the total wt.% conversion is just the sum of the G and C lumps. Detailed composition changes resulting in the light fuel oil, LFO, (430°-650° F.) and heavy fuel oil, HFO, (650° F.+) are obtained by following the concentrations of paraffinic, naphthenic, aromatic rings, and aromatic substituent groups as the gas oil proceeds to crack. The split of aromatics is necessary for the inclusion of recycle charge stocks in the model. This split permits closing of the recycle loop and iterating about a recycle composition until convergence is established.

The kinetic scheme of FIG. 2 shows that a paraffinic molecule in HFO will form paraffinic molecules in LFO ($P_h$–$P_l$) and molecules in G lump ($P_h \rightarrow G$) and C lump ($P_h \rightarrow C$). Paraffinic molecules in LFO can only crack to molecules in G lump ($P_l \rightarrow G$) and in C lump ($P_l \rightarrow C$).

Likewise a naphthenic molecule in HFO can form a naphthenic molecule in LFO and molecules in the G and C lumps. This is popularly designated as saying there is "no interaction" between the paraffinic, naphthenic, and aromatic groups.

The side chains and naphthenic rings attached to the aromatic rings react similarly, except for a single "interaction" step which allows $A_h \rightarrow C_{Al}$. This is the only "interaction" reaction step in the model, and is designated by the rate constant $K_{ahcal}$ in a matrix of rate constants shown in FIG. 3. The aromatic rings in the HFO ($C_{Ah}$) and LFO ($C_{Al}$) do not form gasoline, but result in the formation of the C lump and are primarily manifested as the coke contribution to the C lump. In the present model, no distinction is made between P, N, A molecules in the gasoline fraction; consequently, all the gasoline molecules are lumped together with a single cracking rate. The matrix of rate constants shown in FIG. 3 is lower triangular and is a consequence of the irreversible nature of the postulated cracking kinetic network. Irreversible reactions lend themselves to stepwise solution and considerable advantage is derived from this fact when determining the rate constants.

Nomenclature for terms used in the present application is listed in Appendix I which forms part of the present specification.

REACTOR MODEL FOR FLUIDIZED DENSE BED

The rate of reaction for a mixture of hydrocarbons is a function of catalyst properties and process variables, and of charge stock composition. In accordance with the present invention, the rate of reaction can be represented as the following equation.

$$\underset{\sim}{da}/dt = Q\underset{\approx}{K}\,\underset{\sim}{a}$$

where $\underset{\sim}{da}/dt$ = rates of reaction,

Q = catalyst properties and process variables, $\underset{\approx}{K}$ = matrix of reaction rate constants lumped kinetically and according to boiling range, and $\underset{\sim}{a}$ = composition vector of reactants and product species lumped according to molecular type and boiling range.

A specific fluid catalytic cracking reactor model in accordance with the present invention includes non-linear differential equations which describe the behavior of the feedstock composition vector in a plug flow vapor phase, fluid catalyst reactor with time-decaying non-diffusion limited fluid catalyst at atmospheric pressure. Plug flow vapor phase assumes that there is no change in composition across any cross-section of the reactor. In matrix notation these equations are $$\frac{d\underset{\sim}{a}}{dX} = \frac{1}{1 + K_{Ah}C_{Ah}} \frac{P\overline{MW}}{RT} \frac{\Phi(t_c)}{S_{WH}} \underset{\approx}{K}\,\underset{\sim}{a}$$

where $\underset{\sim}{a}$ = composition vector consisting of j lumped species ($a_j$ = moles j/g gas)

$$= \begin{pmatrix} P_h \\ N_h \\ A_h \\ C_{Ah} \\ P_l \\ N_l \\ A_l \\ C_{Al} \\ G \\ C \end{pmatrix}$$

X = dimensionless reactor length.

P = absolute pressure (atmospheres).

R = gas constant (82.05 atm. $cm^3$/g-mole °K.).

T = absolute temperature (°K.).

$\overline{MW}$ = mean molecular weight of the mixture =

$$\frac{1}{\sum_j a_j}$$

$S_{WH}$ = true weight hourly space velocity (g feed/g catalyst-hr).

$\underset{\approx}{K}$ = matrix of invariant rate constants (g catalyst/$cm^3$)$^{-1}$ (hr)$^{-1}$. a function of T, catalyst type, residual carbon on regenerated catalyst, Basic N poison, pressure, metals, etc. The effects of temperature; Basic N poisoning, catalyst type and residual carbon on regenerated catalyst on the $\underset{\approx}{K}$ matrix are detailed in their corresponding sections.

$t_c$ = time from start of run, hr.

$\Phi(t_c)$ = catalyst decay as a function of catalyst residence time, $$\frac{1}{1 + \beta t_c^{\gamma}}$$

where $\beta$ and $\gamma$ are constants.

$K_{Ah}$ = adsorption term associated with the concentration of aromatic rings in the 650° F.+ fraction, $(C_{Ah})^{-1}$ A detailed development of the reactor model is included in Appendix II, and a program listing is in Appendix III of the specification.

Determination of Rate Constants

A pattern search technique was used to determine the rate constants, K, from experimental data. The data supplied to the program consisted of 63 sets of isothermal cracking data at 900° F. in a fluidized dense bed. These were obtained on 15 charge stocks with widely different boiling ranges and compositions. The ranges of charge stock composition, process variables, and resulting yields are given in Table 1. It should be noted that all the experimental data presented are time-averaged data. Further, it should be understood that throughout this application "conversion" or "yields" imply "time-averaged conversion" and "time-averaged yields".

The function used to measure "goodness of fit" is $$f = \sqrt{\frac{\sigma_G^2 + \sigma_C^2 + 0.3\,\sigma_L^2}{N_D - N_P}}$$

where $\rho_G^2$, $\rho_C^2$, and $\rho_L^2$ are the sums of the squares of the deviations over all experimental points for G lump, C lump, and LFO, respectively.

$N_D$ is the number of data points.

$N_P$ is the number of parameters used in the estimation.

Table 1

Range of Charge Stock Composition, Process Variables, And Resulting Yields Used in Fitting the Model Parameters

| | Range |
|---|---|
| Conversion (G lump + C lump) Wt. % | 30.5-82.1 |
| G lump ($C_5^+$ - 430° F.) Wt. % | 20.0-59.4 |
| C lump ($H_2$, $H_2S$, $C_1$—$C_4$, + coke) Wt. % | 9.1-25.2 |
| LFO (430-650° F.) | 14.0-43.0 |
| Total Paraffins in Charge Stock (Wt. %) | 8.6-51.9 |
| Total Naphthenes in Charge Stock (Wt. %) | 4.2-68.8 |
| Total Aromatic Rings in Charge Stock (Wt. %) | 6.1-45.0 |
| Total Aromatic Substituent Groups | 5.6-23.5 |
| Molecular weight of charge stock | 206-402 |
| Boiling Range (°F.) | 430-1000 |
| Catalyst Residence Time (Min.) | 1.25, 5.0 |
| Catalyst/Oil Ratio (Wt.) | 1.25-6.0 |
| Temperature (°F.) | 900 |
| Nitrogen Dilution (Mole %) | 10 |
| Pressure (psig) | 0 |

Figure 4:
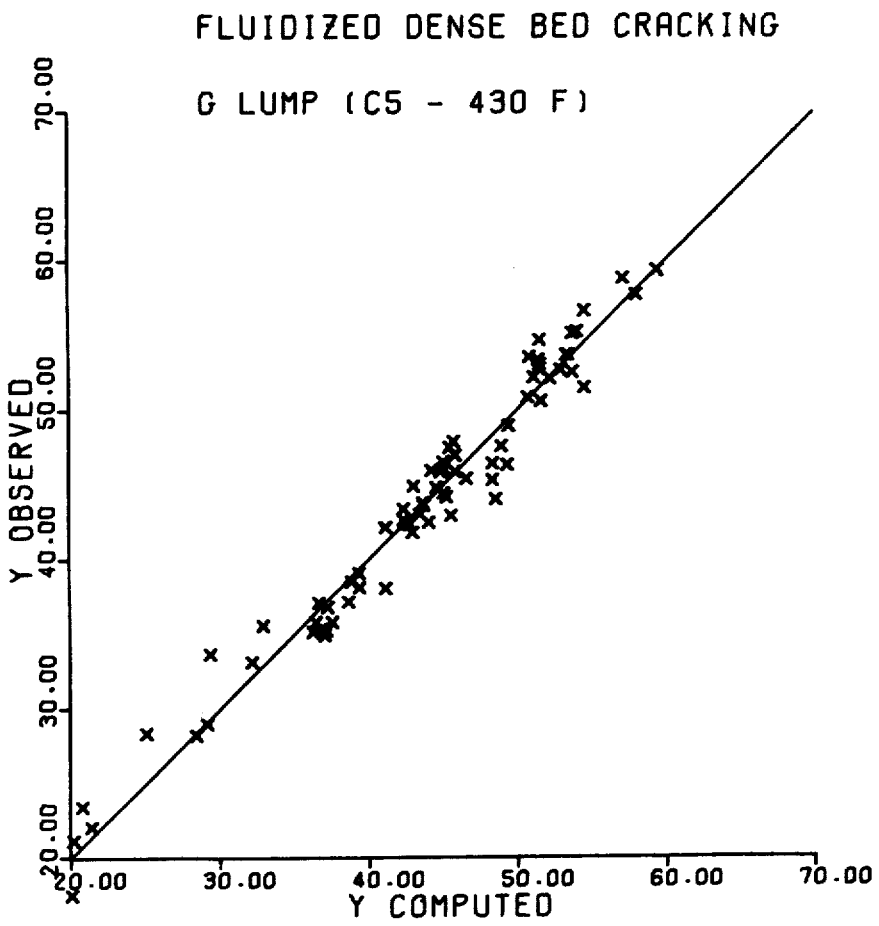
FIGS. 4 through 33 are graphs of computer generated data.
Figure 5:
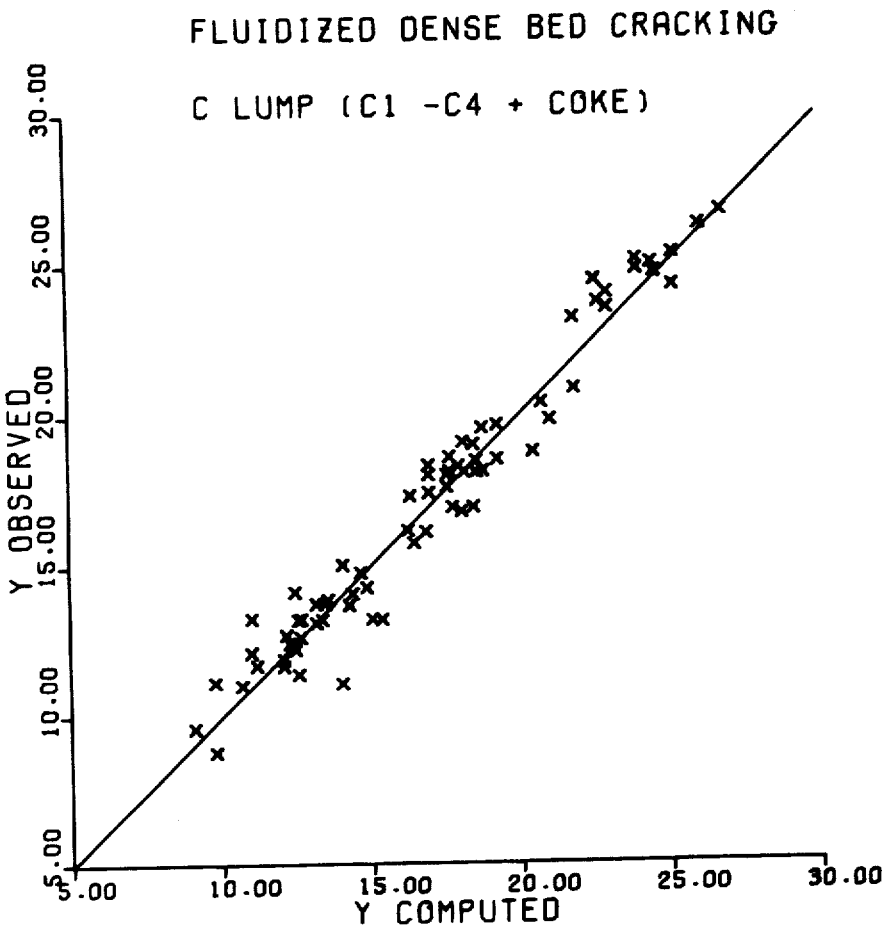
Figure 6:
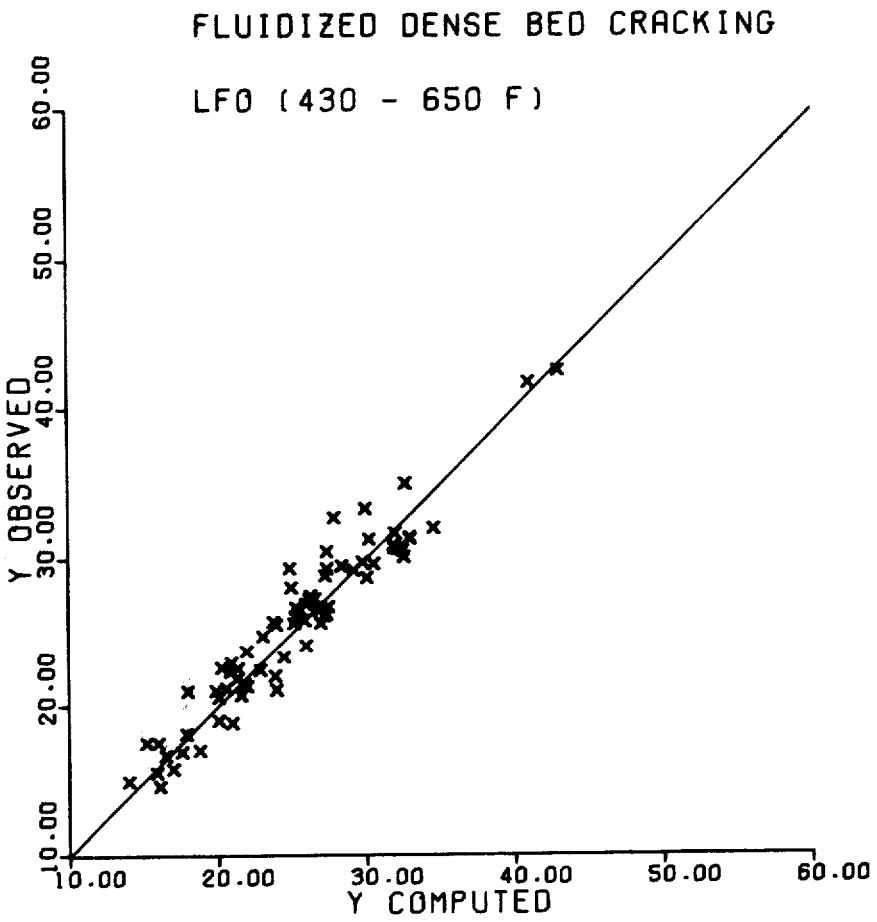

Plots of observed vs. computed yields of gasoline, C lump, and LFO are shown in FIGS. 4, 5 and 6. The best fit occurs where f is a minimum.

The economics of cracking suggest that more importance be attached to the G lump and C lump fit as compared to the fit on LFO. Hence less significance is attached to the sum of the squares of deviations for LFO. This allows the LFO, G lump, and C lump to be fitted simultaneously, yet the deviations on the LFO fit will not excessively sway the G lump and C lump fit. The best set of parameters is shown in Table 2. The reactions have been grouped into four types of reactions to facilitate further discussion. With a weighting of 30% applied to LFO deviations, it may be seen from Table 2 that the average and standard error for gasoline and LFO are comparable. Heavier weighting on LFO will result in a better fit on LFO at the expense of the fit on gasoline and C lump.

Table 2

Model Parameters

| G lump (Gasoline Formation Reactions | Best Parameters |
|---|---|
| $K_{alg}$ (g catalyst/cm$^3$)$^{-1}$ (hr)$^{-1}$ | $18.50 \times 10^3$ |
| $K_{ahg}$ | $63.00 \times 10^3$ |
| $K_{nlg}$ | $66.15 \times 10^3$ |
| $K_{nhg}$ | $84.70 \times 10^3$ |
| $K_{plg}$ | $23.85 \times 10^3$ |
| $K_{phg}$ | $55.00 \times 10^3$ |
| C Lump Formation Reactions | |
| $K_{alc}$ | $3.63 \times 10^3$ |
| $K_{ahc}$ | $34.20 \times 10^3$ |
| $K_{nlc}$ | $8.18 \times 10^3$ |
| $K_{nhc}$ | $14.87 \times 10^3$ |
| $K_{plc}$ | $9.44 \times 10^3$ |
| $K_{phc}$ | $7.85 \times 10^3$ |
| $K_{calc}$ | $1.00 \times 10^3$ |
| $K_{cahc}$ | $14.63 \times 10^3$ |
| Gasoline Crackling Reaction | |
| $K_{gc}$ | $4.4 \times 10^3$ |
| LFO Formation Reactions | |
| $K_{ahal}$ | $19.00 \times 10^3$ |
| $K_{nhnl}$ | $22.50 \times 10^3$ |
| $K_{phpl}$ | $20.70 \times 10^3$ |
| $K_{cahcal}$ | $5.86 \times 10^3$ |
| $K_{ahcal}$ | $50.00 \times 10^3$ |
| Heavy Aromatic Ring Adsorption Constant $K_{Ah}$, (Wt. % $C_{Ah}$)$^{-1}$ | 0.128 |
| Catalyst Deactivation, $\frac{1}{1+\beta t_c^{\gamma}}$, dimensionless | |
| $\beta$ ($t_c$ in hours) | 162.15 |
| $\gamma$ | 0.76 |
| Average Absolute Error (G lump), Wt. % | 1.26 |
| Average Absolute Error (C lump), Wt. % | 0.69 |
| Average Absolute Error (LFO), Wt. % | 1.41 |
| Standard Error (G lump), $\sqrt{\frac{\sigma_G^2}{N_D - N_G}}$, Wt. % | 1.78 |
| Standard Error (C lump), $\sqrt{\frac{\sigma_G^2}{N_D - N_C}}$, Wt. % | 0.95 |
| Standard Error (LFO), $\sqrt{\frac{\sigma_G^2}{N_D - N_L}}$, Wt. % | 1.90 |

$N_D$ = No. of data points
$N_G$ = No. of parameters associated with the G lump fit
$N_C$ = No. of parameters associated with the C lump fit
$N_L$ = No. of parameters associated with the LFO fit It is interesting to compare some of the rate constants listed in Table 2 with the known kinetics of the catalytic cracking of pure hydrocarbons and classes of hydrocarbons. The rate constants for the cracking of the heavy fuel oil fractions of the P, N, and A lumps to gasoline are greater than the respective ones for the light fuel oil fractions. This is quite reasonable as the cracking rates of most paraffins and naphthenes increase with increasing molecular weight.

The aromatic substituent groups in heavy fuel oil ($A_h$) have the highest rate constant ($K_{ahc}$) for C lump formation. This is consistent with the high cracking rate of side chain alkyl groups particularly $C_3$ and $C_4$ and the high coking tendency of 3 and 4 membered ring aromatic compounds. Consider the refractory aromatic rings in LFO ($C_{Al}$). This lump should exhibit smaller coke forming and cracking tendencies ($K_{calc}$) compared to the higher boiling aromatic fractions. The ratios of the respective rate constants for gasoline formation to the corresponding ones for C lump formation are an approximate measure of the selectivity of each lump for gasoline formation. The cracking of gasoline to C lump ($K_{gc}$) is considerably smaller than the rate constants for formation as would be expected.

Further, significance of these rate constants may be gleaned from the next section where predicted and experimental yields are discussed for paraffinic, naphthenic, aromatic, and recycle charge stocks.

Comparison of Predicted Product Yields with Experimental Results

Some comparisons of time-averaged predicted versus time-averaged observed product yields for the G lump, C lump, and light fuel oil are shown in FIGS. 4, 5, and 6, respectively. These data were used for the computation of the rate constants given in Table 2. The agreement is extremely good for all 15 widely different charge stocks used in the calculations of the rate constants. The results represent wide ranges of charge stock properties, reaction conditions, and conversion levels.

Figure 7:
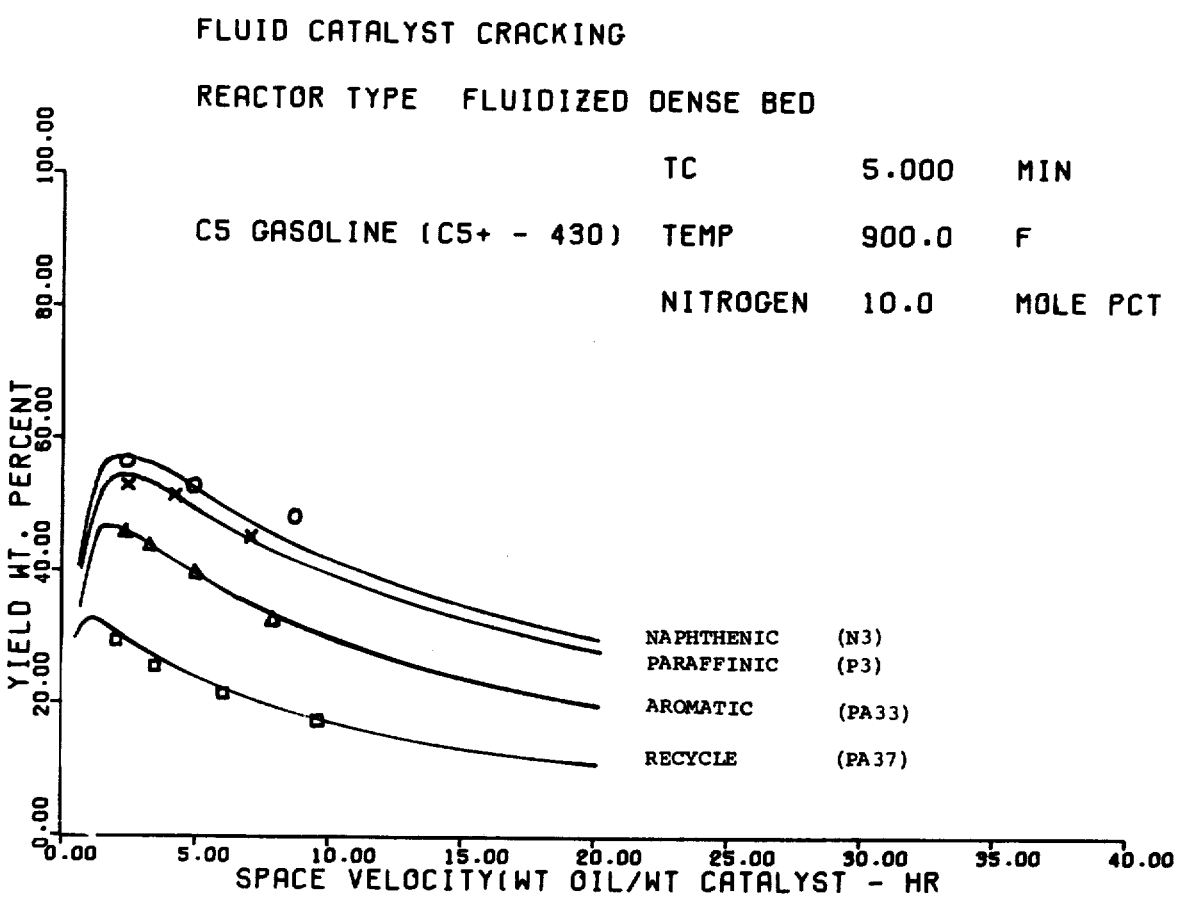
Figure 8:
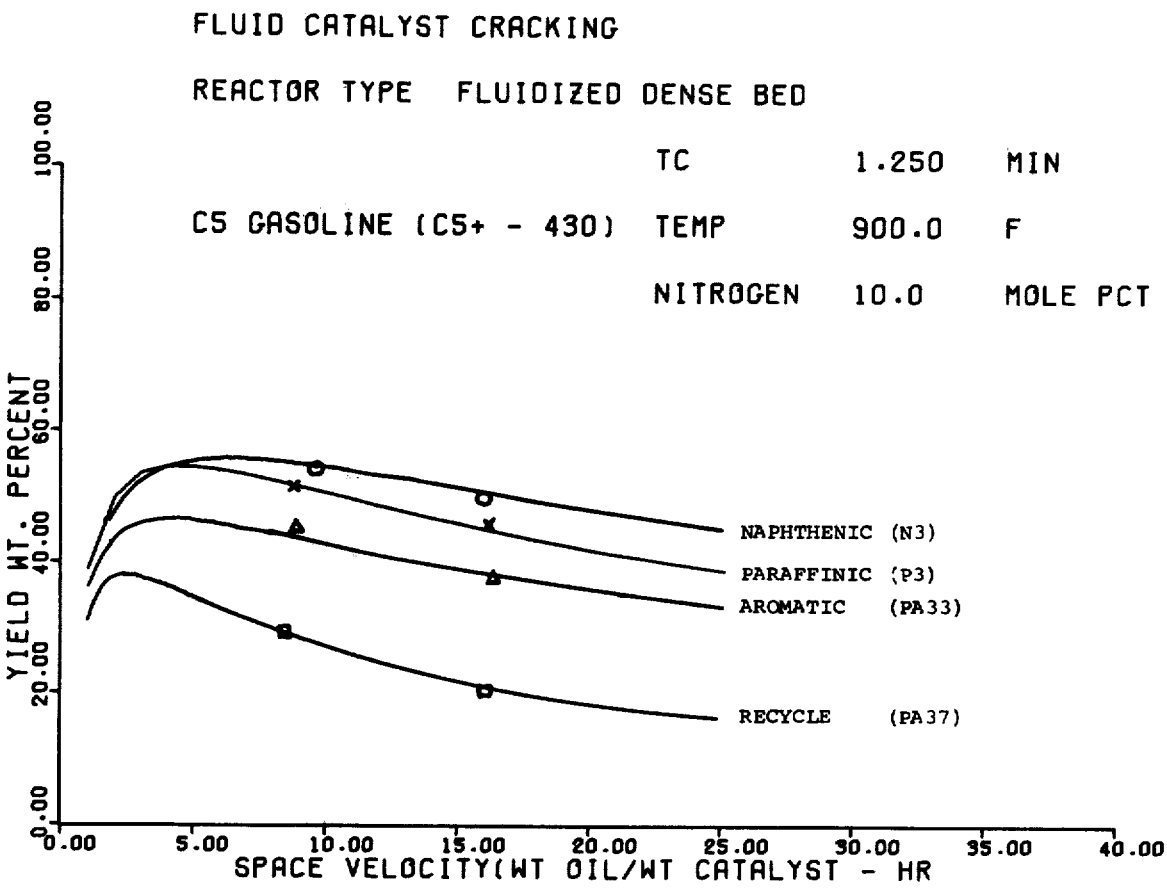

Plots of gasoline yields versus space velocity are given for four different charge stocks in FIGS. 7 and 8. The catalyst residence times are 5.0 to 1.25 minutes, respectively, in these plots. The points are the experimental data for each charge stock and the solid curves were calculated from the model. N3 is a highly naphthenic charge stock and gives the greatest yields of gasoline. The highly paraffinic charge stock, P3, gives gasoline yields only slightly lower than N3. Both the highly aromatic (PA 33) and recycle (PA 37) charge stocks give much lower gasoline yields. The side chains on aromatic rings crack quite readily, but aromatic rings are very stable and are extremely resistant to cracking reactions. Recycle charge stocks consist largely of refractory aromatic molecules and as expected give very low yields of cracked products.

Figure 9:
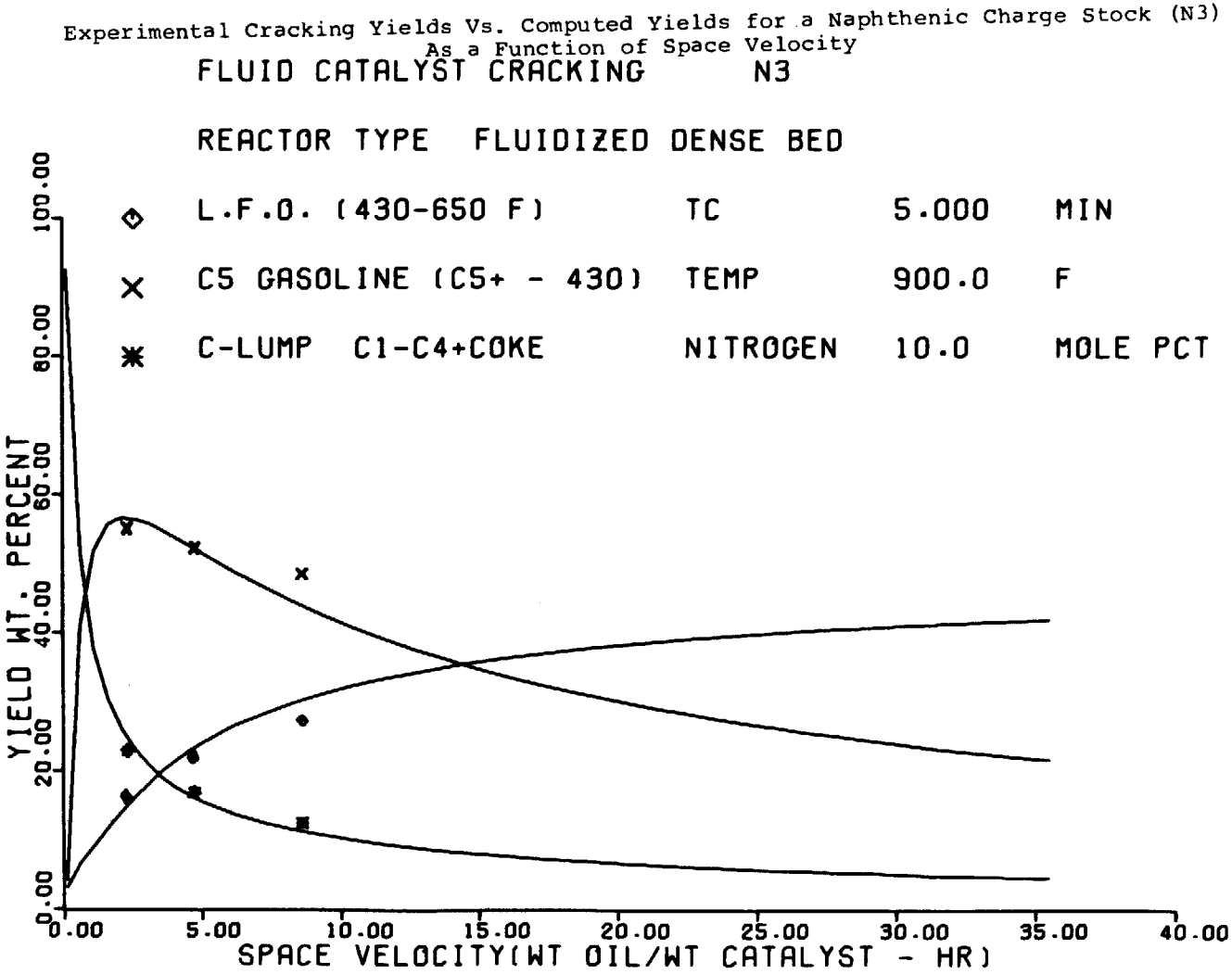

Some detailed yield data for N3 are given in FIG. 9 which contains plots of gasoline, C lump, and light fuel oil versus space velocity. The yield of gasoline goes through a maximum. The C lump increases with decreasing space velocity and the light fuel oil decreases. The agreements between the calculated and experimental results are very good.

Figure 10:
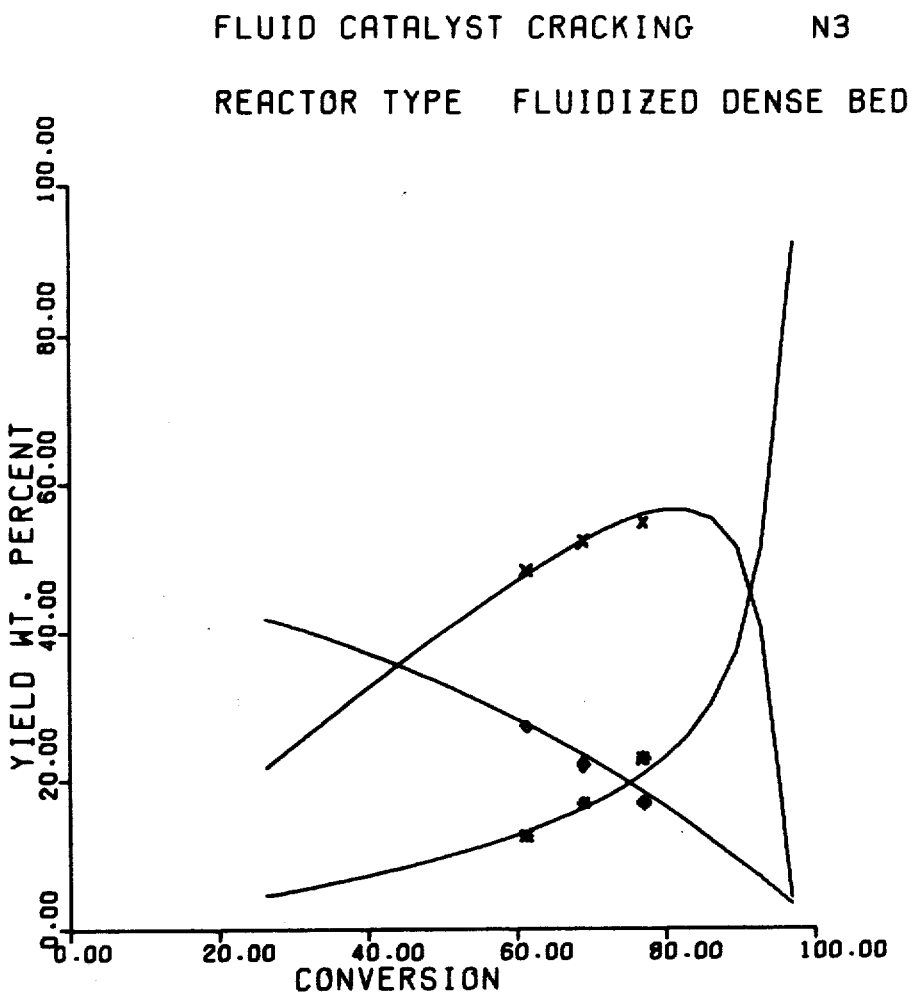
Figure 11:
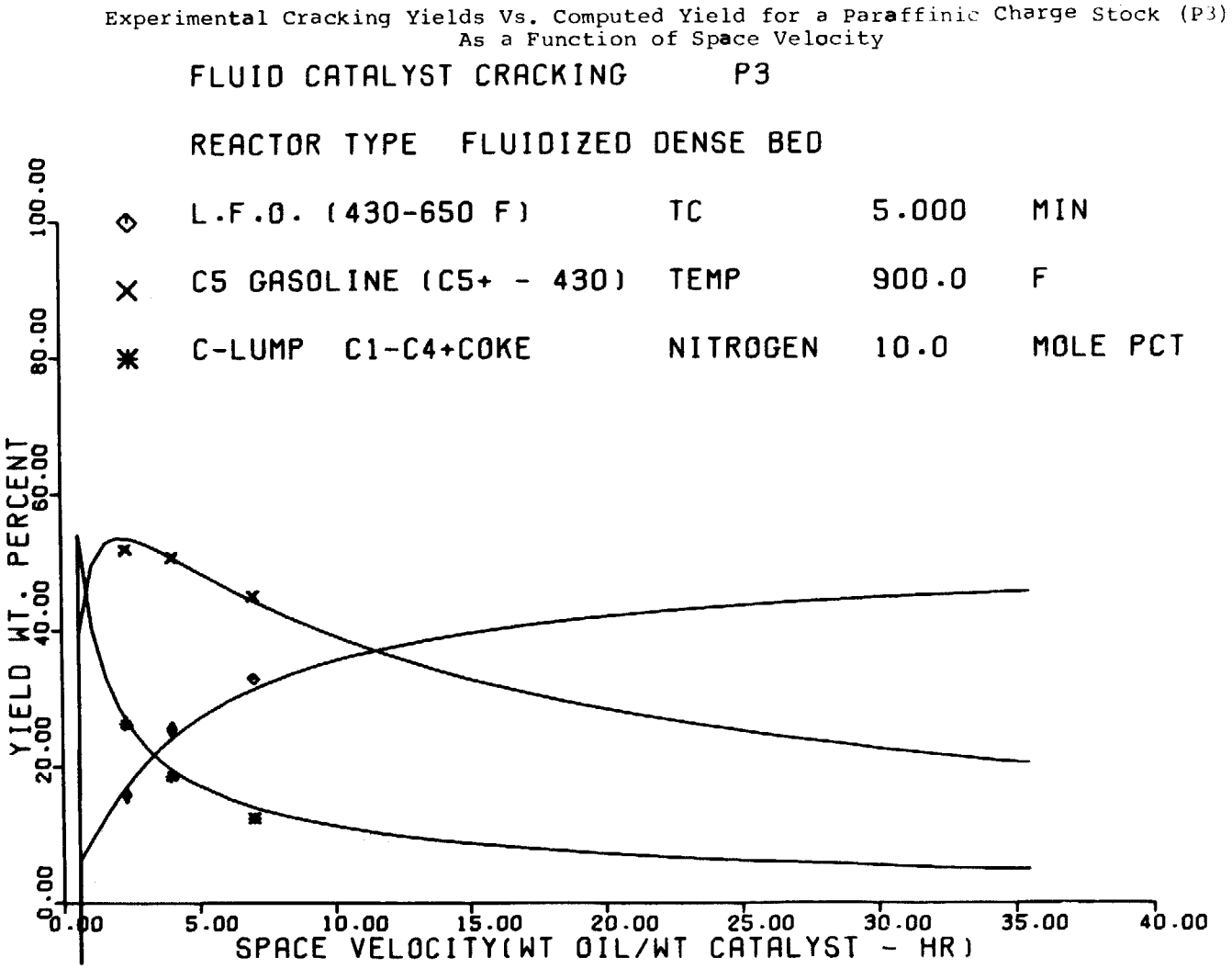
Figure 12:
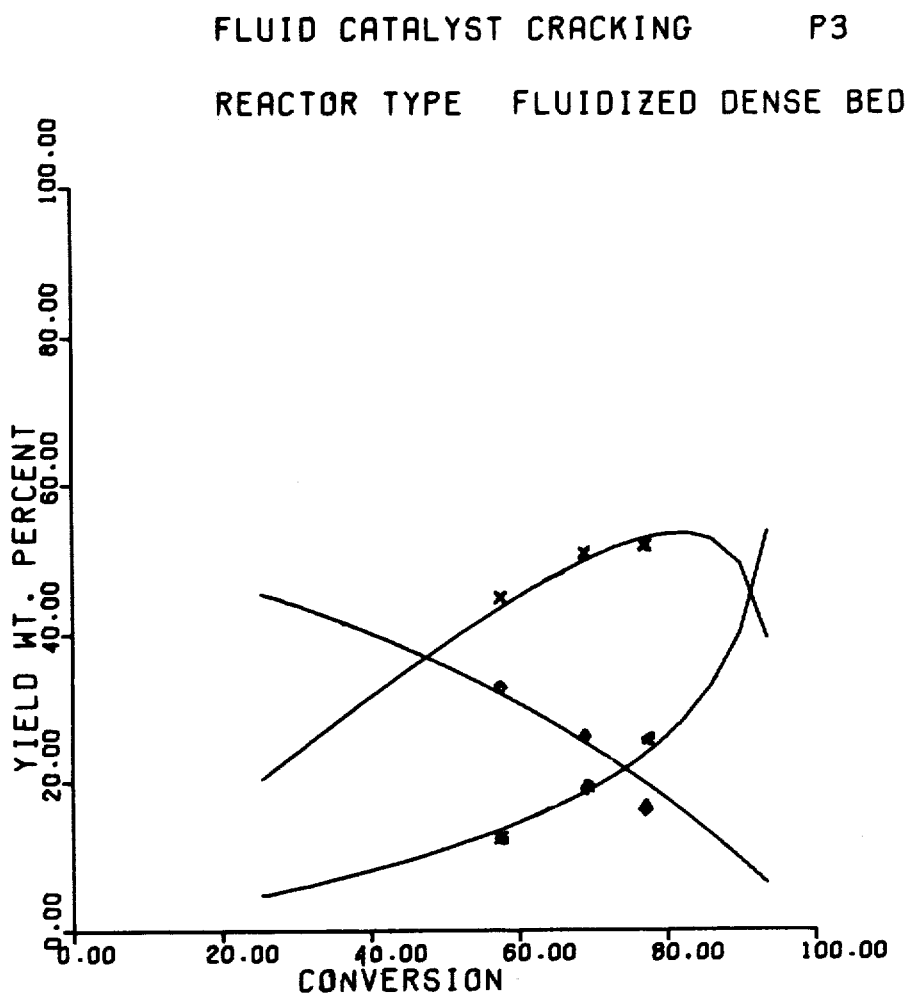
Figure 13:
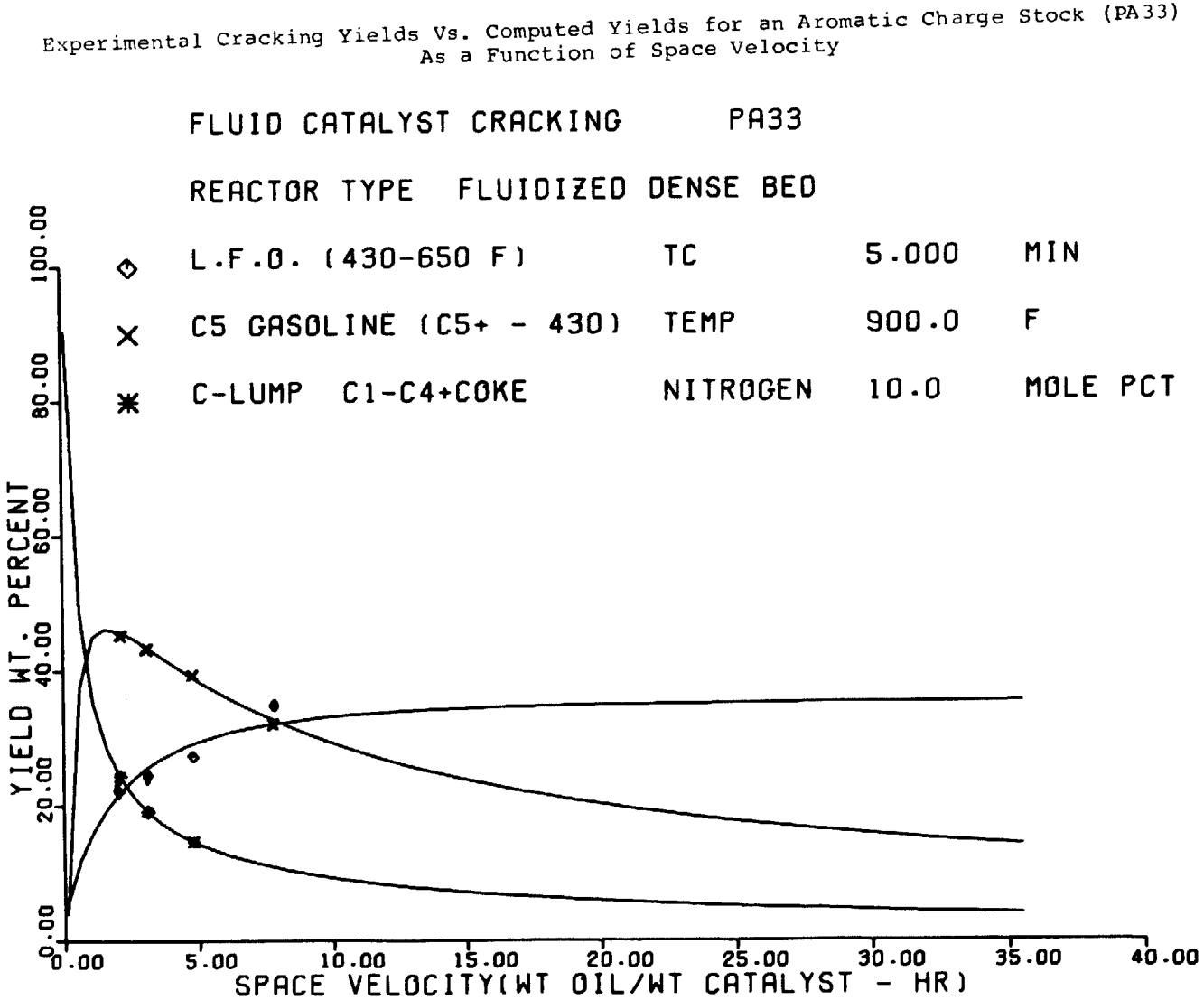
Figure 14:
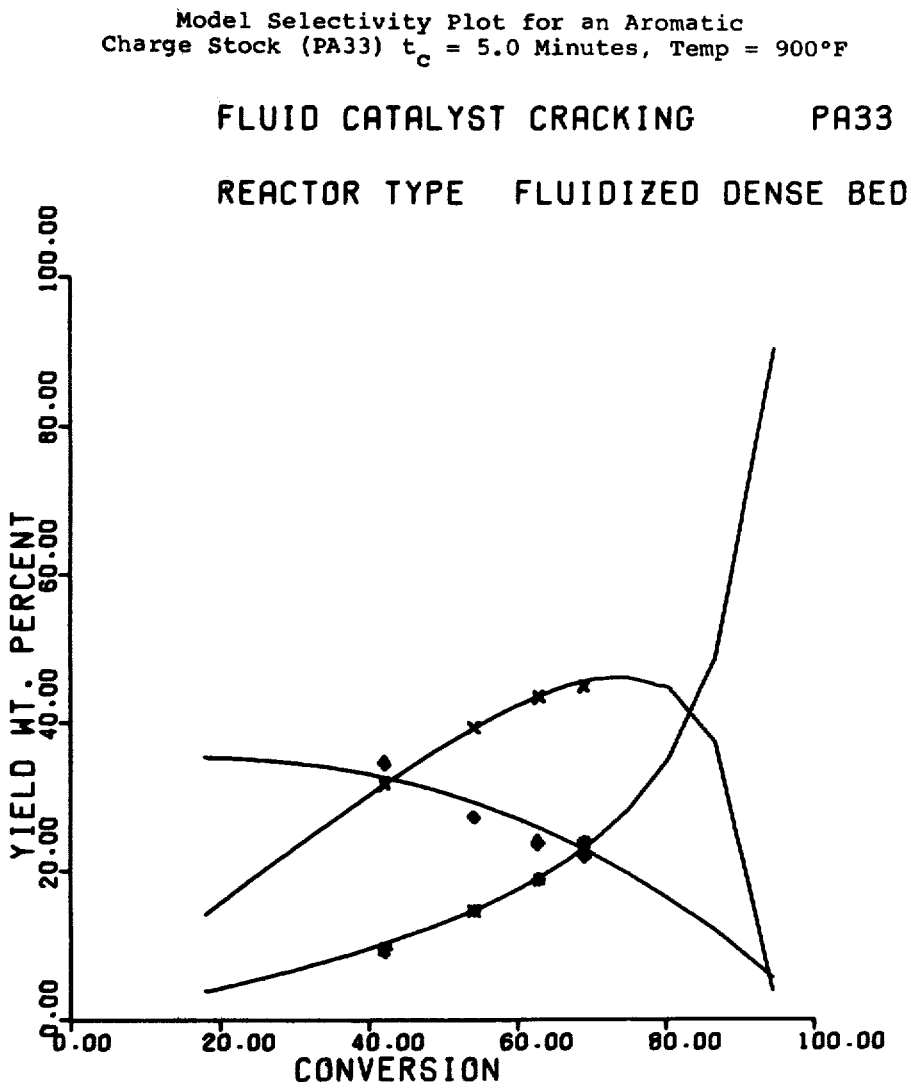
Figure 15:
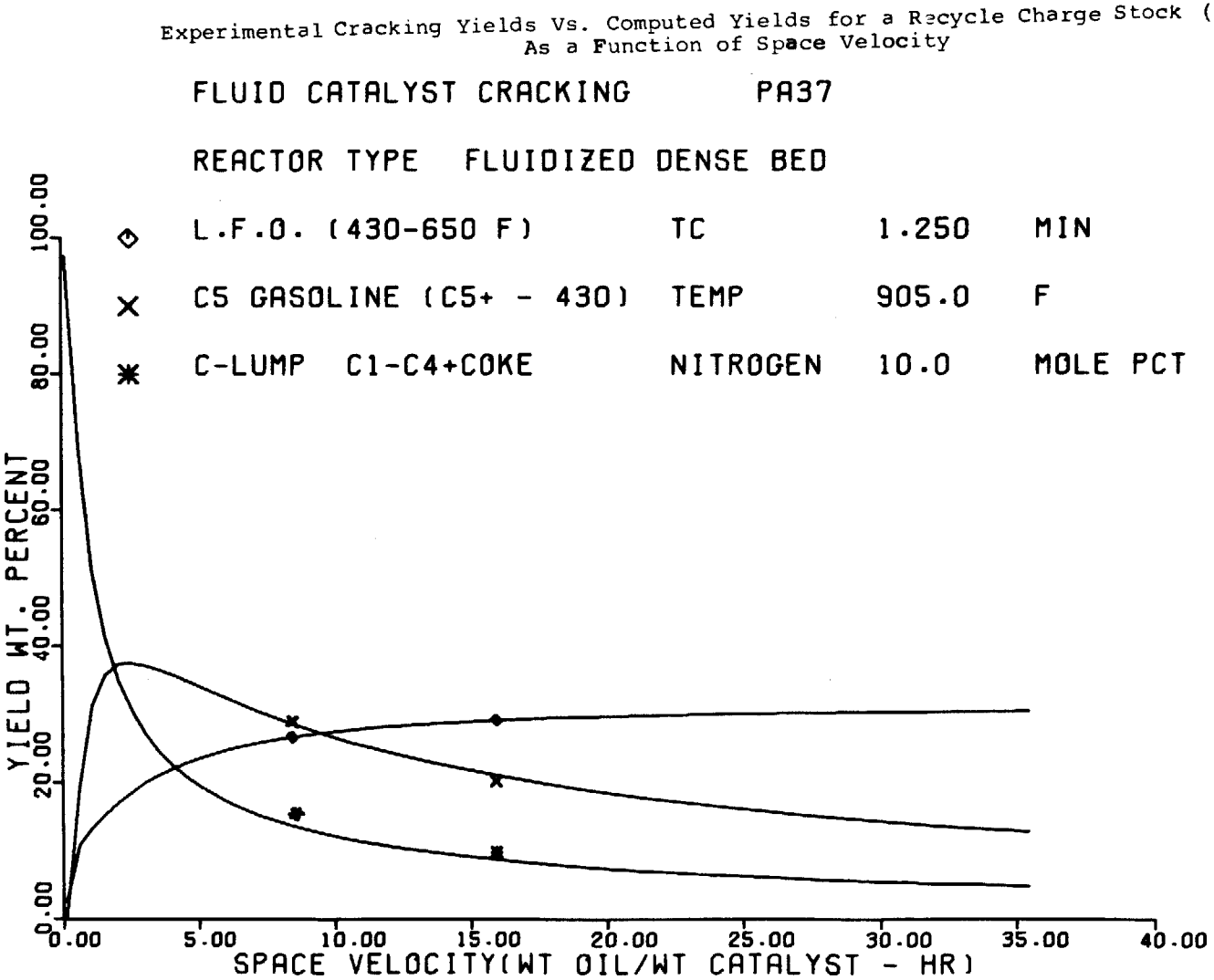
Figure 16:
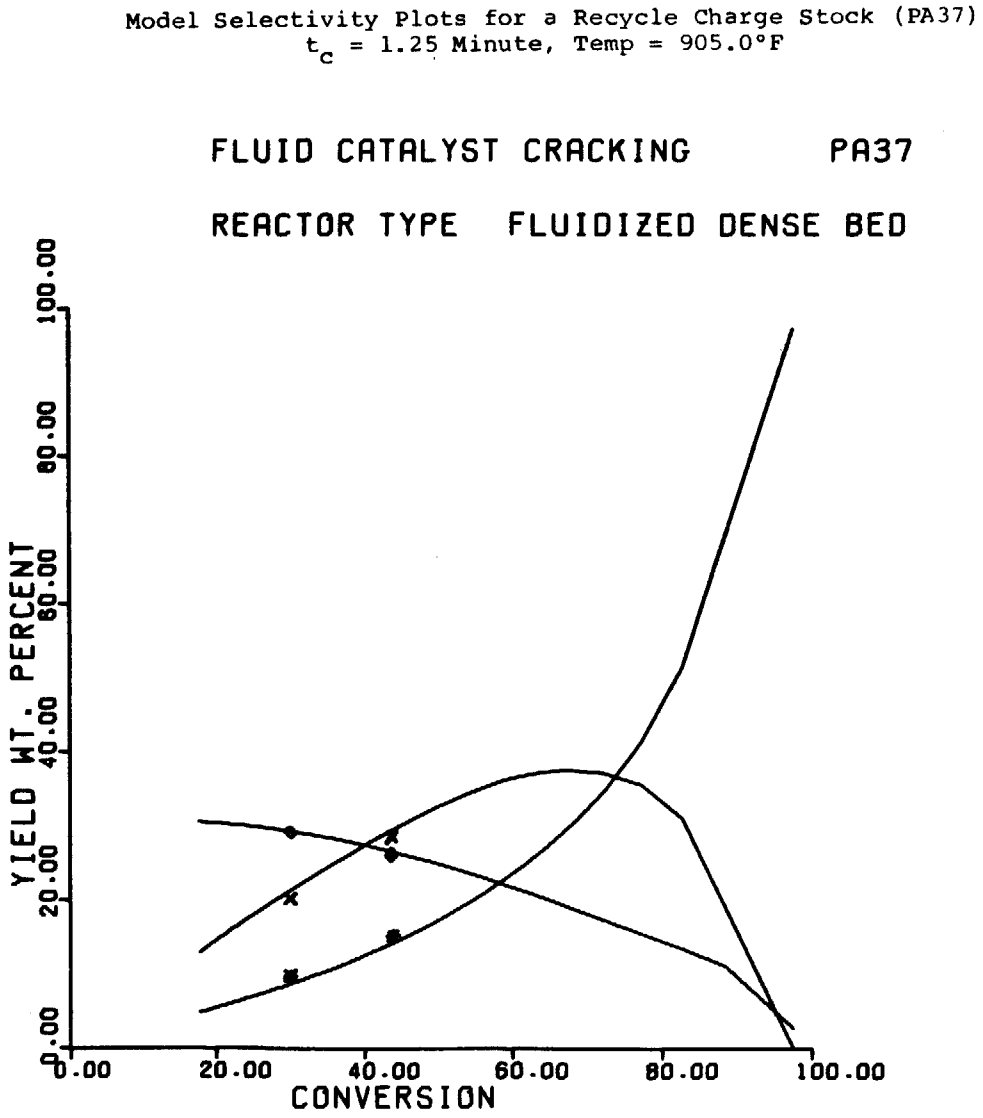

Selectivity curves for N3 are shown in FIG. 10. Yields of gasoline, C lump, and light fuel oil are plotted against total conversion. Gasoline yield goes through a maximum whereas the C lump increases and light fuel oil decreases with increasing conversion. It is particularly significant that the model not only fits the experimental data well, but predicts the proper trends over the entire range of conversion.

Similar data for charge stocks P3, PA33, and PA37 are given in FIGS. 11-16.

Compositional Changes During Reaction

Most importantly, it has been demonstrated that with the model parameters shown in Table 2 the HFO and LFO compositions are accurately traced as conversion proceeds. It must be remembered that these compositional changes were not used in determining the model parameters. Rather, the predictions of compositional change result as a pure prediction from fitting the model to the G lump, C lump, and LFO and as such provide considerable support for the validity of the kinetic scheme.

Figure 17:
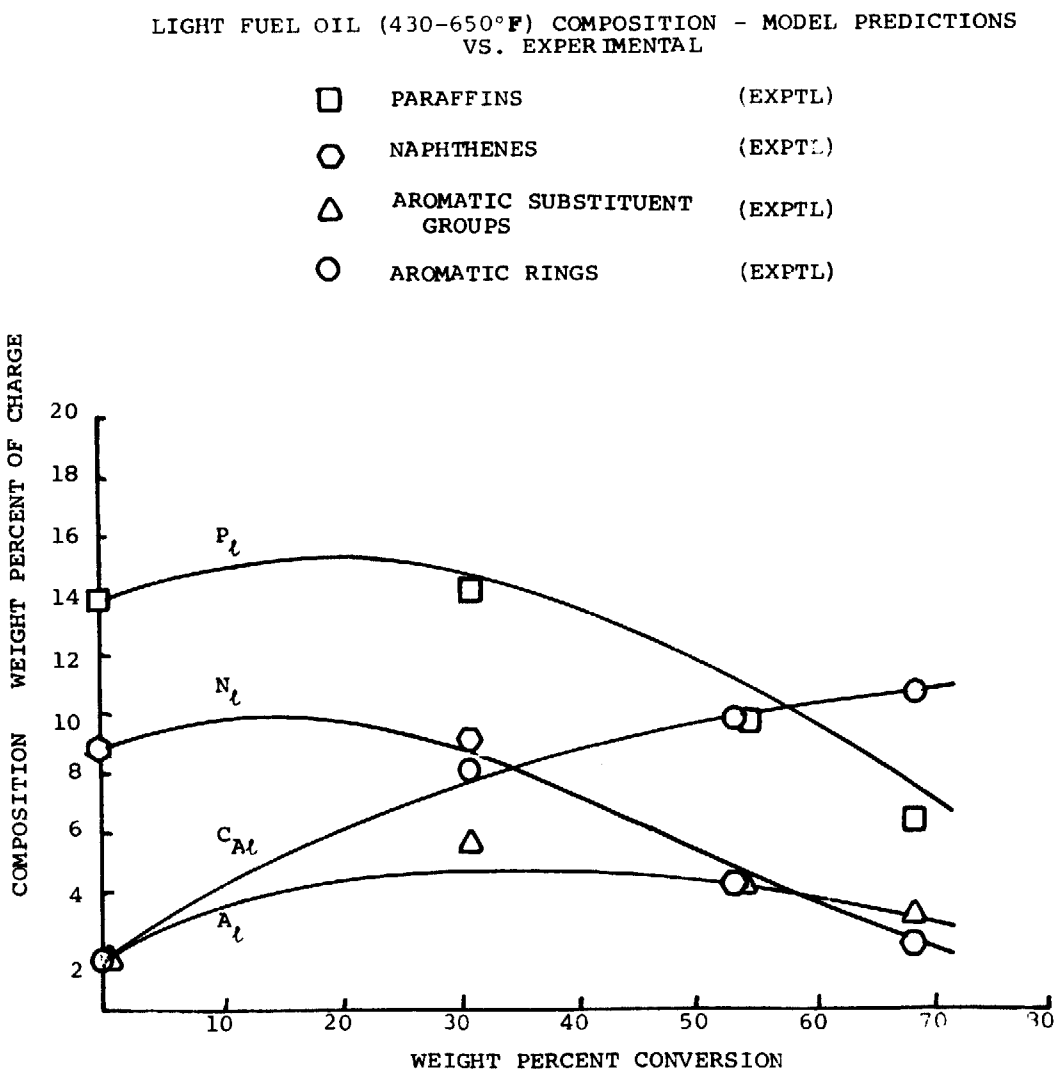
Figure 18:
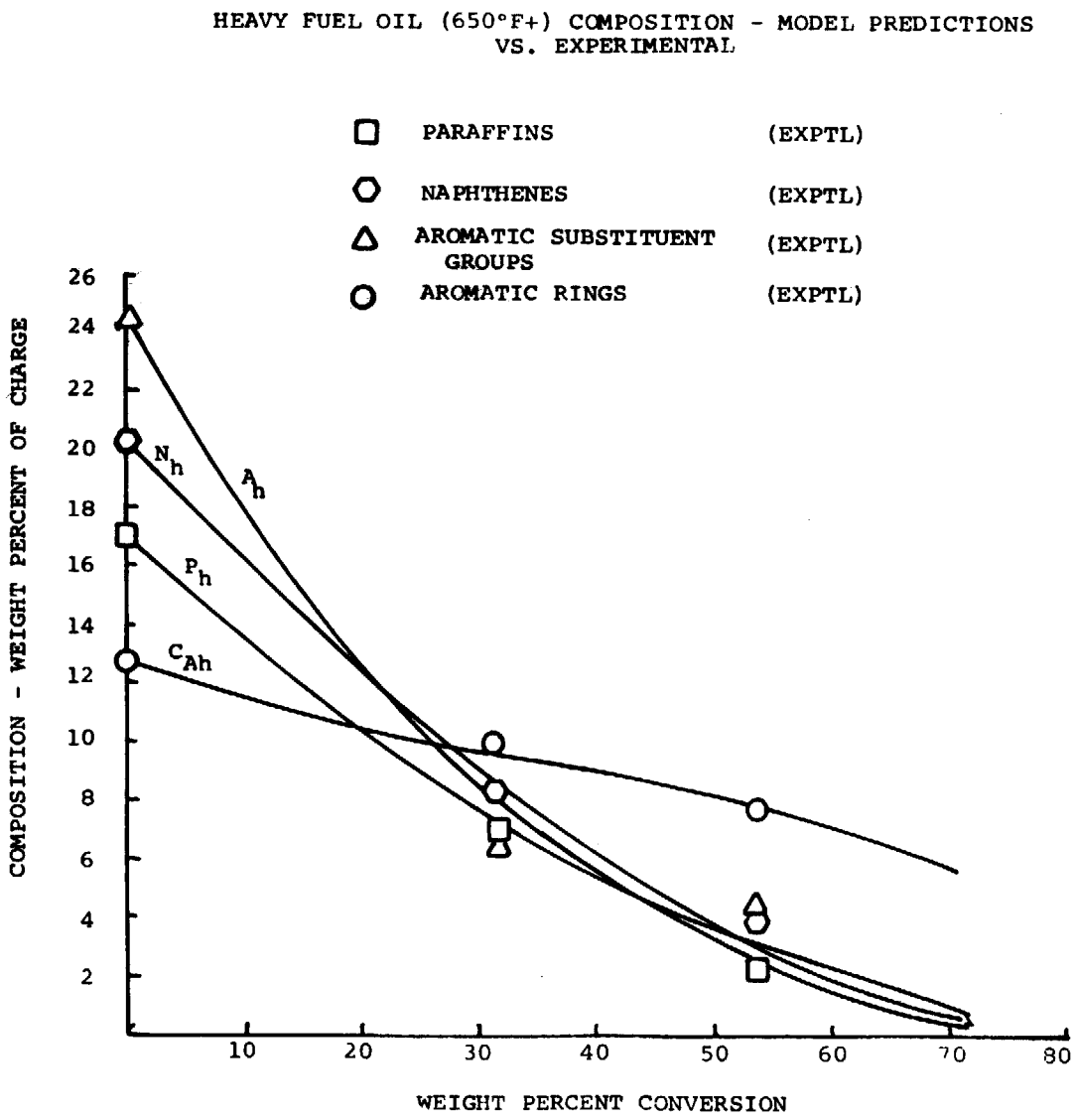

Detailed experimental analyses of the LFO and HFO are shown for the single highly aromatic charge stock PA33 in FIGS. 17 and 18 as a function of conversion. The solid lines represent the kinetic paths traced by the model for each of the compositional lumps. The model accurately follows the increase and subsequent decrease in the wt. % of the kinetic lumps in LFO, and follows the decrease in the wt. % of the kinetic lumps in HFO.

It is especially important, from the viewpoint of recycle, to be able to predict the polynuclear aromatic rings in the HFO % $C_{Ah}$ as this lump primarily determines the increased coke production from recycle charge stocks and also reflects its cracking characteristics. At high conversion (60-70 wt. %) the HFO is almost solely composed of polynuclear aromatic rings. Since the lumped composition of these fractions is accurately predicted, recycle situations (recycling HFO or LFO, or both) may now be treated with confidence.

Example of Predictive Capabilities of Model

The fluid catalytic cracking reactor model can be used to predict G lump ($C_5+-430°$ F. gasoline), C lump ($H_2$, $H_2S$, $C_1$-$C_4$, coke), and LFO (430°-650° F.) yields for charge stocks not used in determining the rate constants. Predictions are computed using the kinetic model based on kinetically invariant lumps of paraffins, naphthenes, aromatic rings, and aromatic substituent groups and the model parameters presented in Table 2. The average and standard errors of the predictions are similar to those obtained when the model was fitted to the original data. The model has good prediction capability as demonstrated by the following examples.

Figure 19:
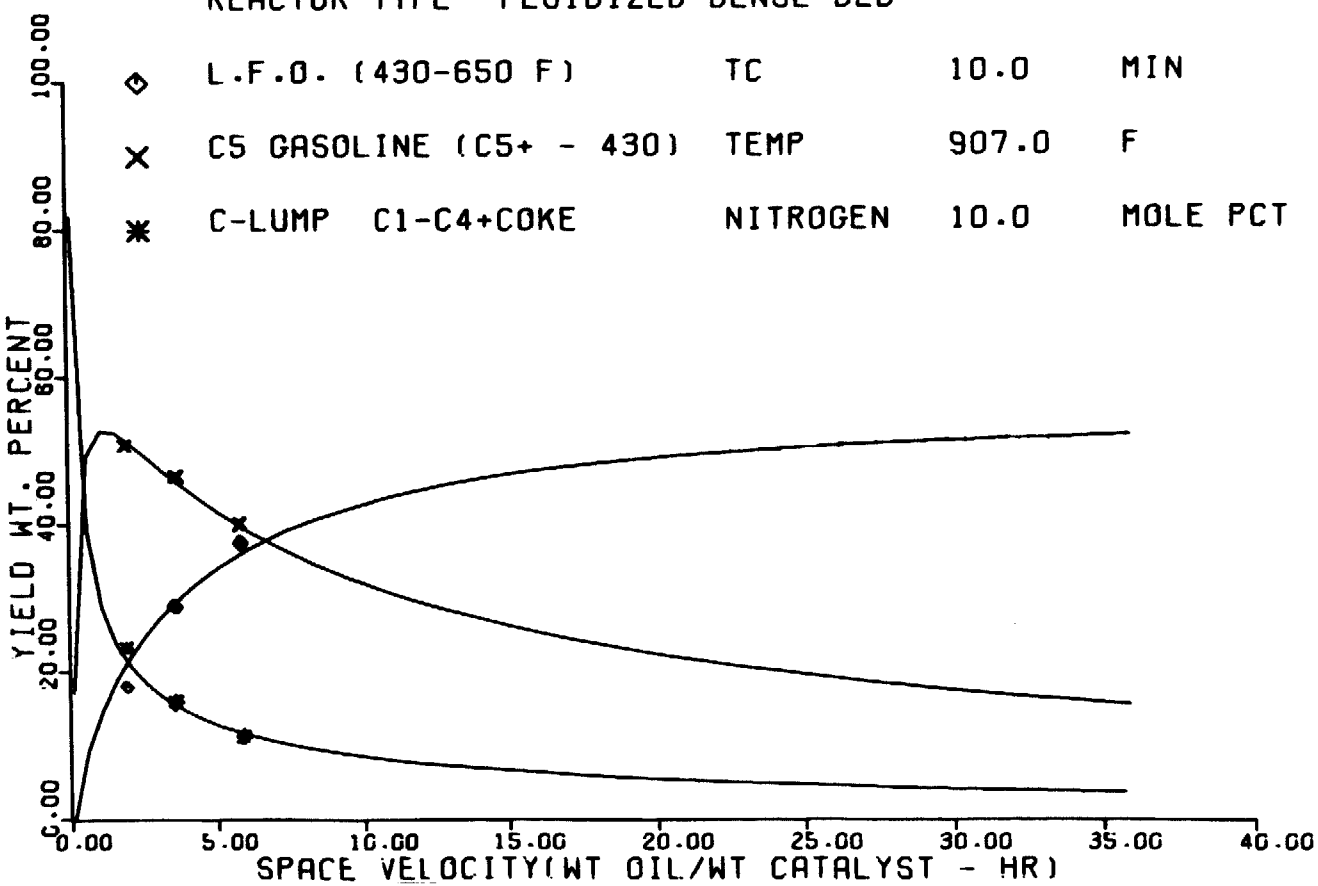

Amal gas oil (P3) was run at a catalyst residence time of 10 minutes to test the validity of extrapolating the catalyst deactivation function to longer catalyst residence times. The catalyst deactivation function was previously computed from the cracking results of 15 charge stocks at 1.25 and 5 minutes on-stream periods. FIG. 19 shows the deactivation function adequately predicts the cracking yields of gasoline, C lump, and LFO at longer catalyst residence times ($t_c = 10$ min.).

Figure 20:
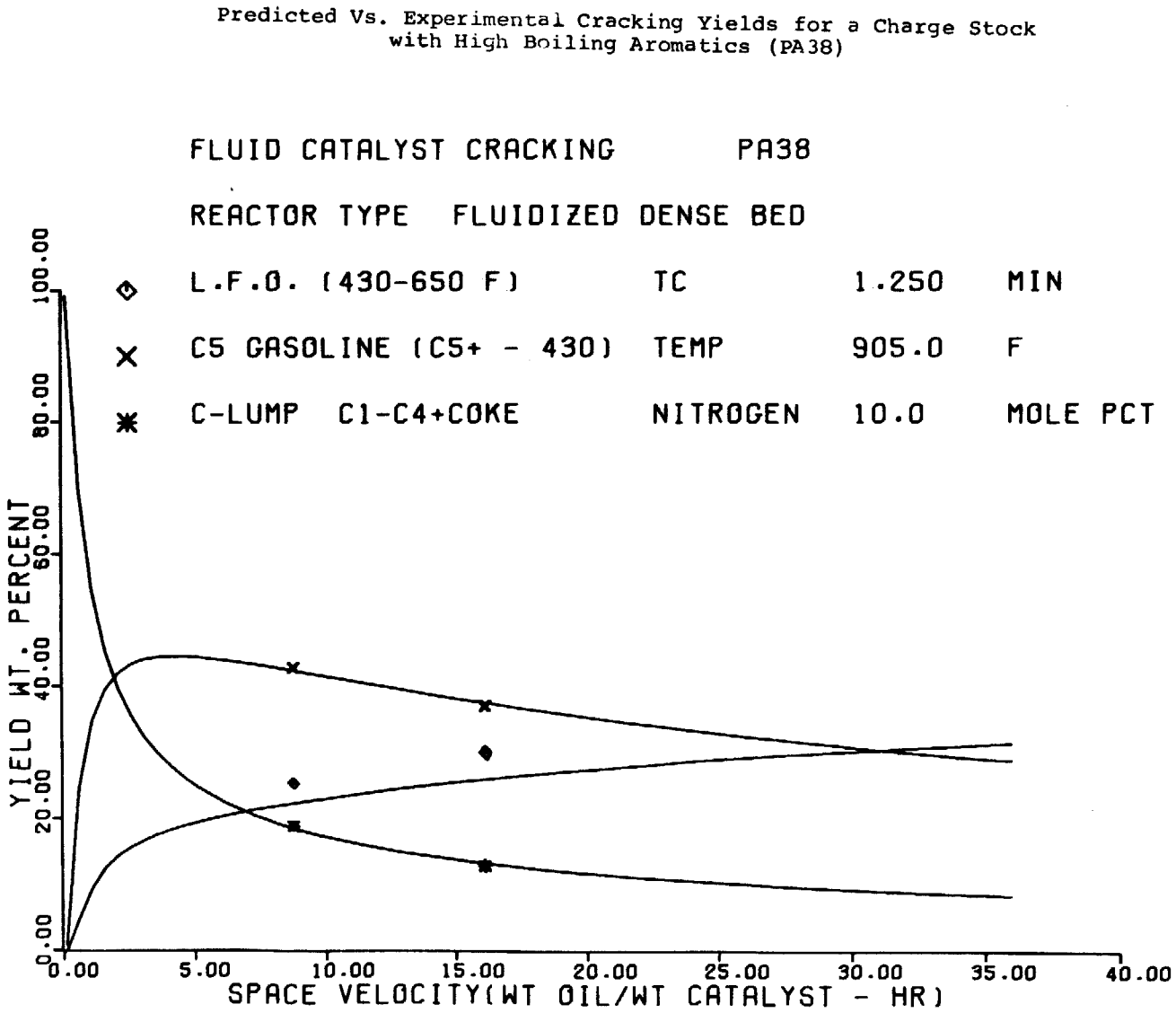

FIG. 20 is a plot of the yields of gasoline, C lump, and light fuel oil versus space velocity for another gas oil (PA38). This charge stock was not used in the determination of the rate constants given in Table 2. The agreement between the experimental data and the predicted curves is excellent.

Figure 27:
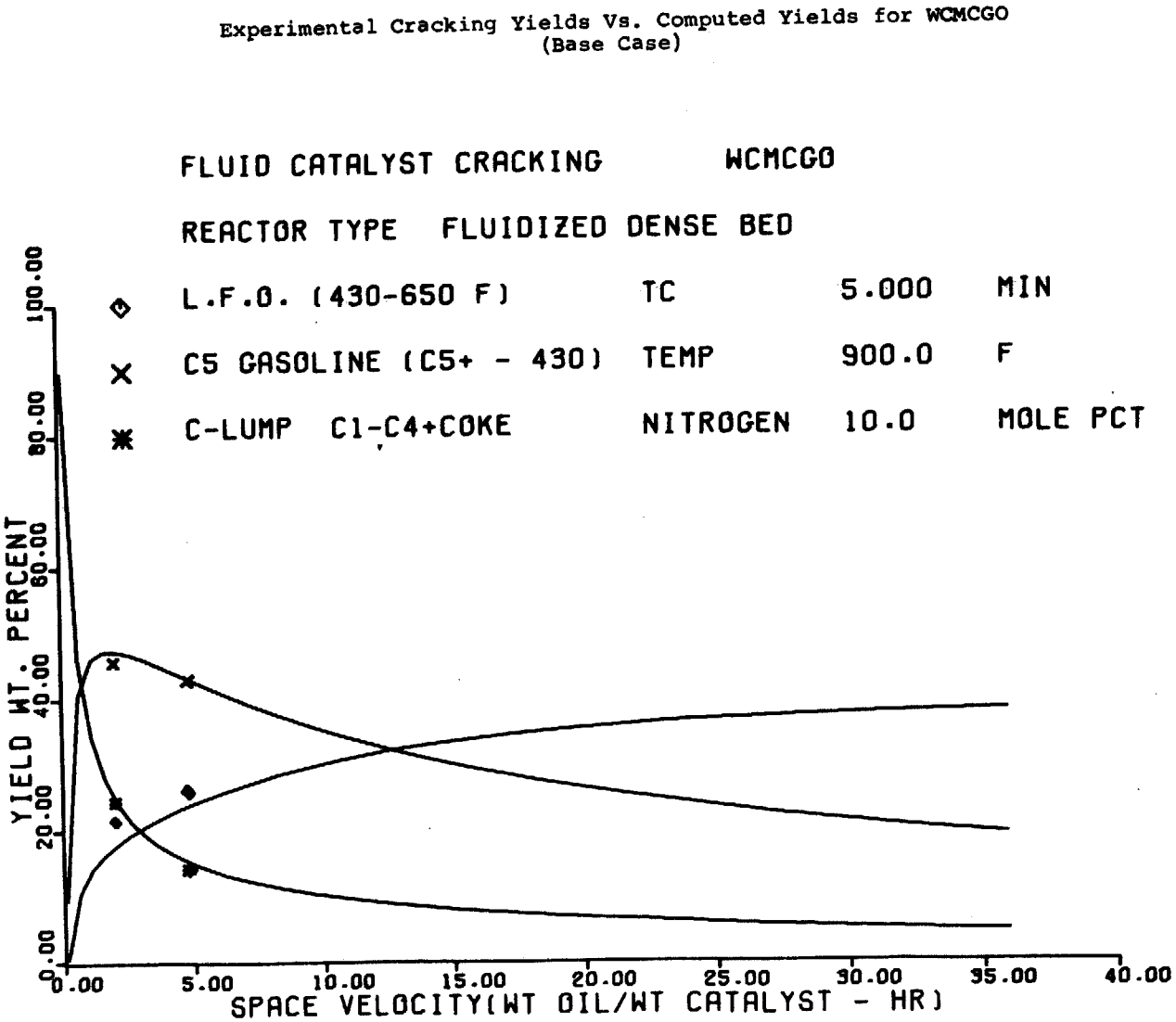
Figure 28:
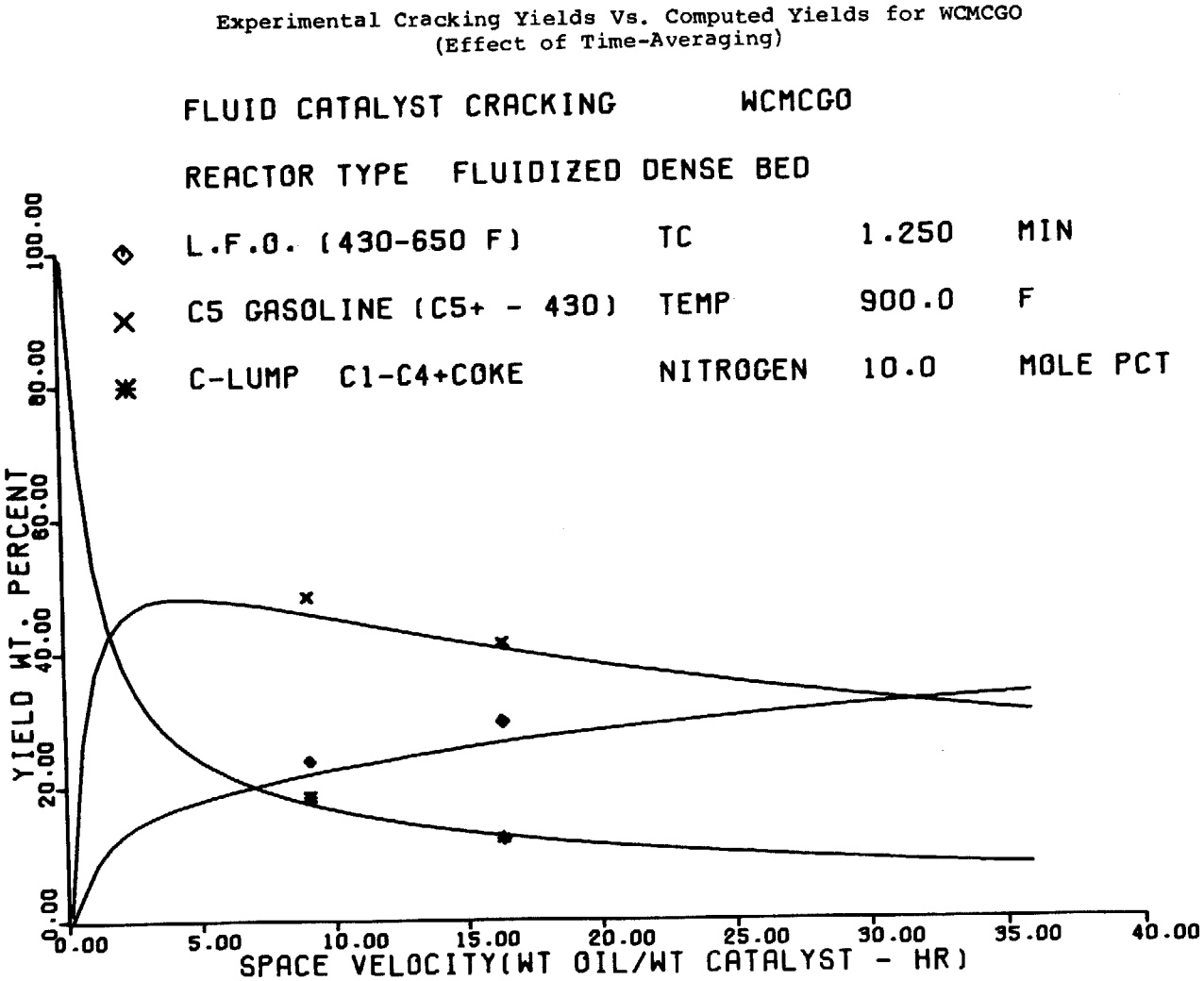

A similar plot in FIG. 27 is shown for a wide cut mid-continent gas oil (WCMCGO) a new charge stock not previously used in the model, and again the agreement is very good.

Activation Energies

Figure 21:
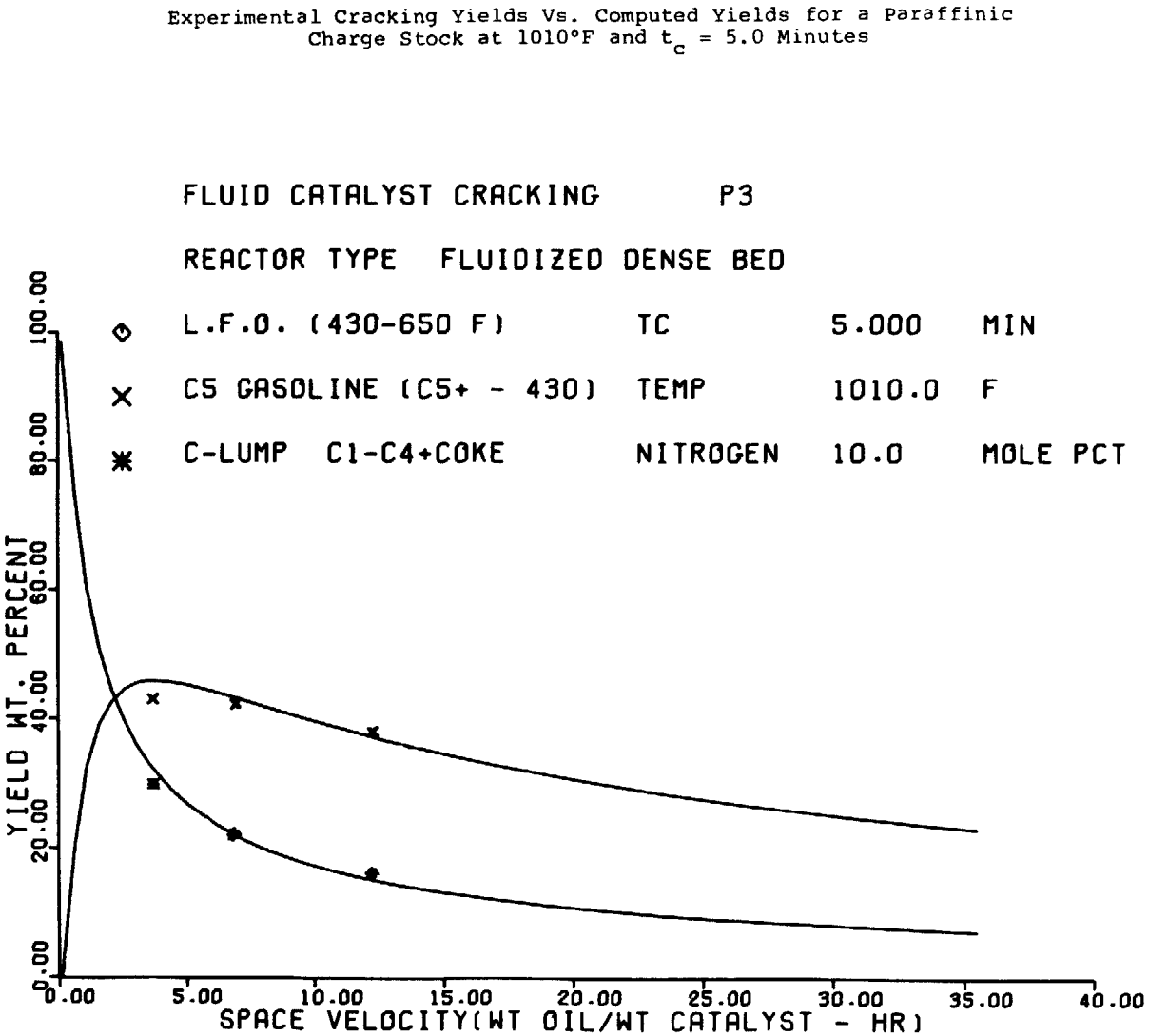
Figure 22:
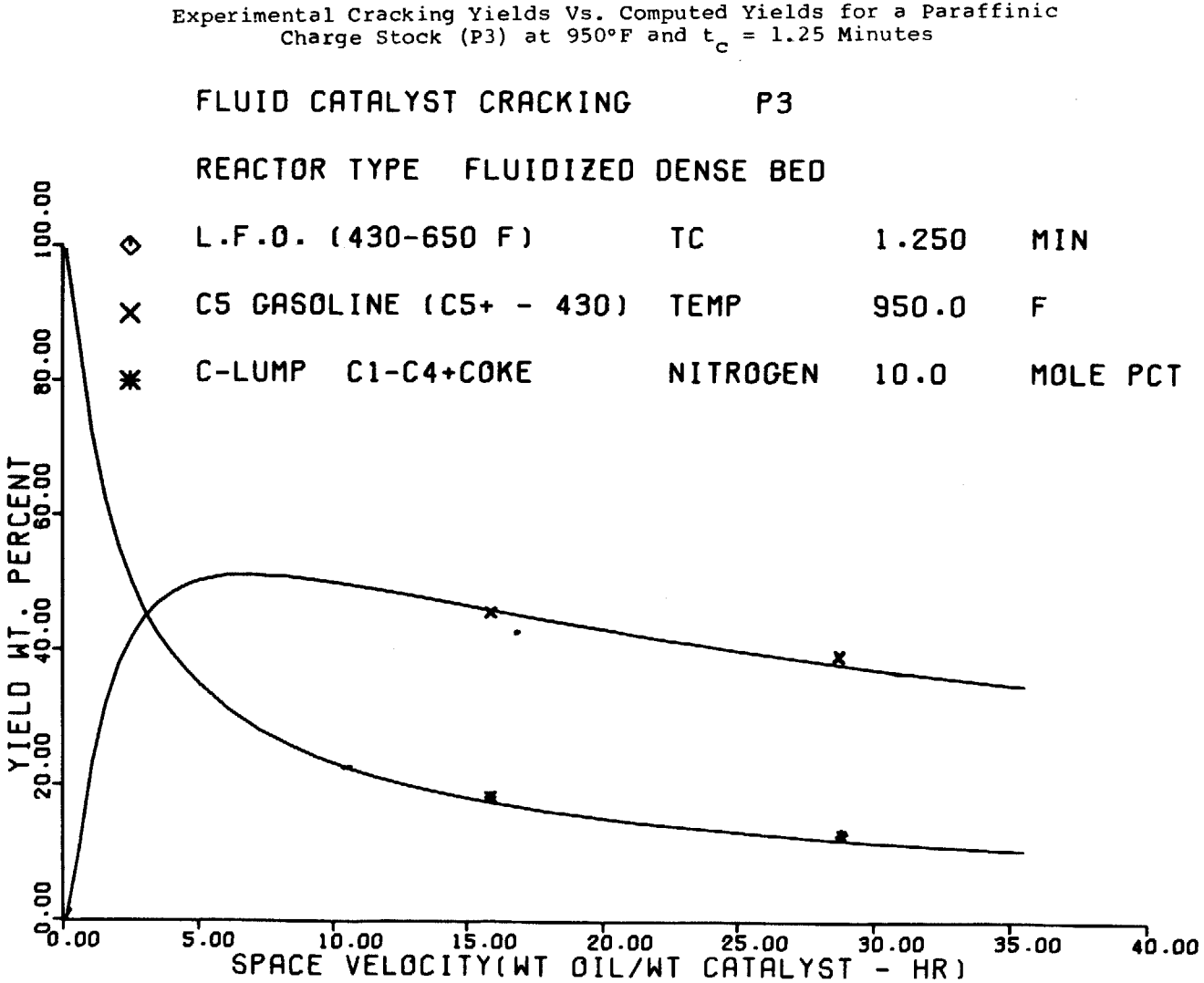
Figure 29:
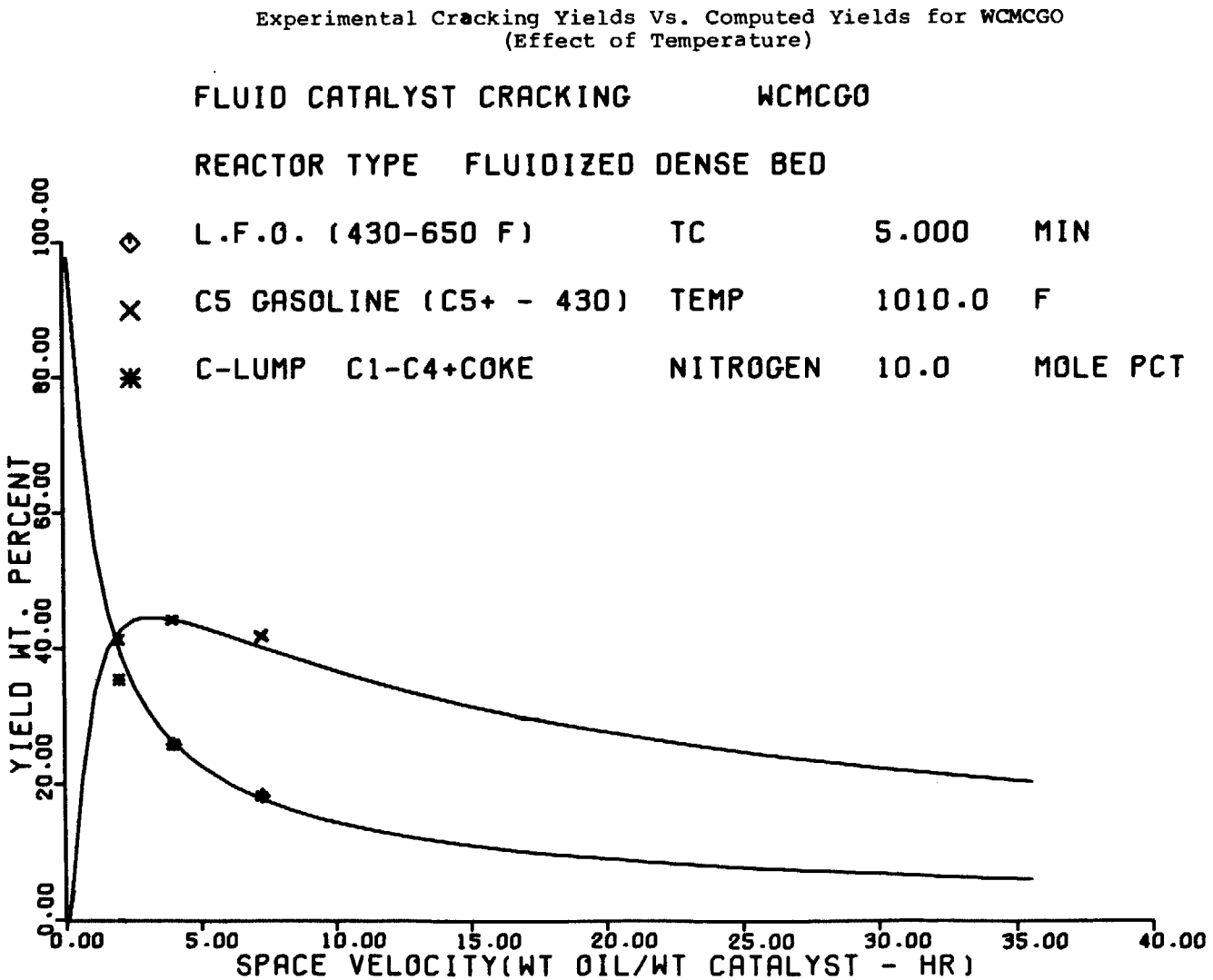
Figure 30:
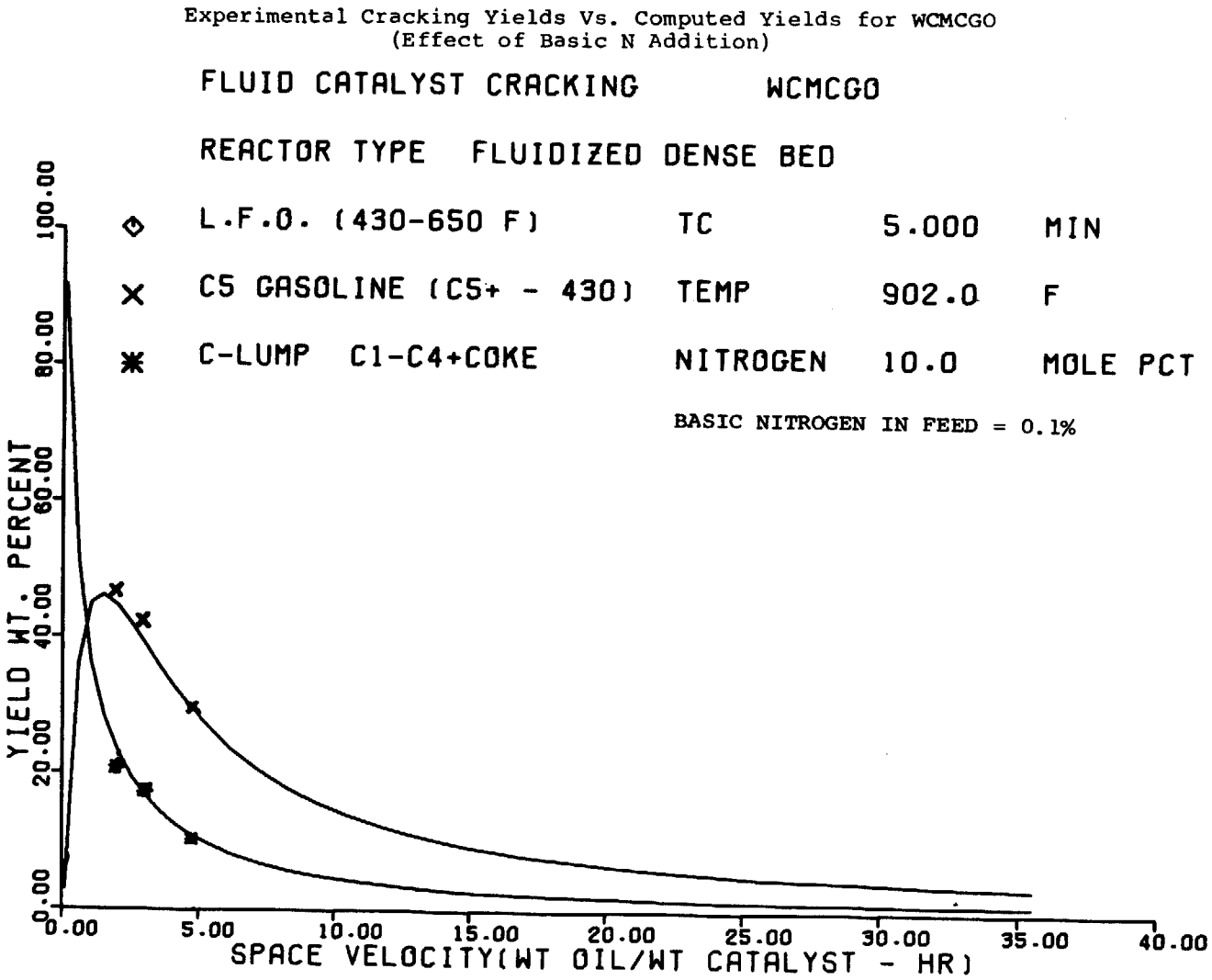
Figure 31:
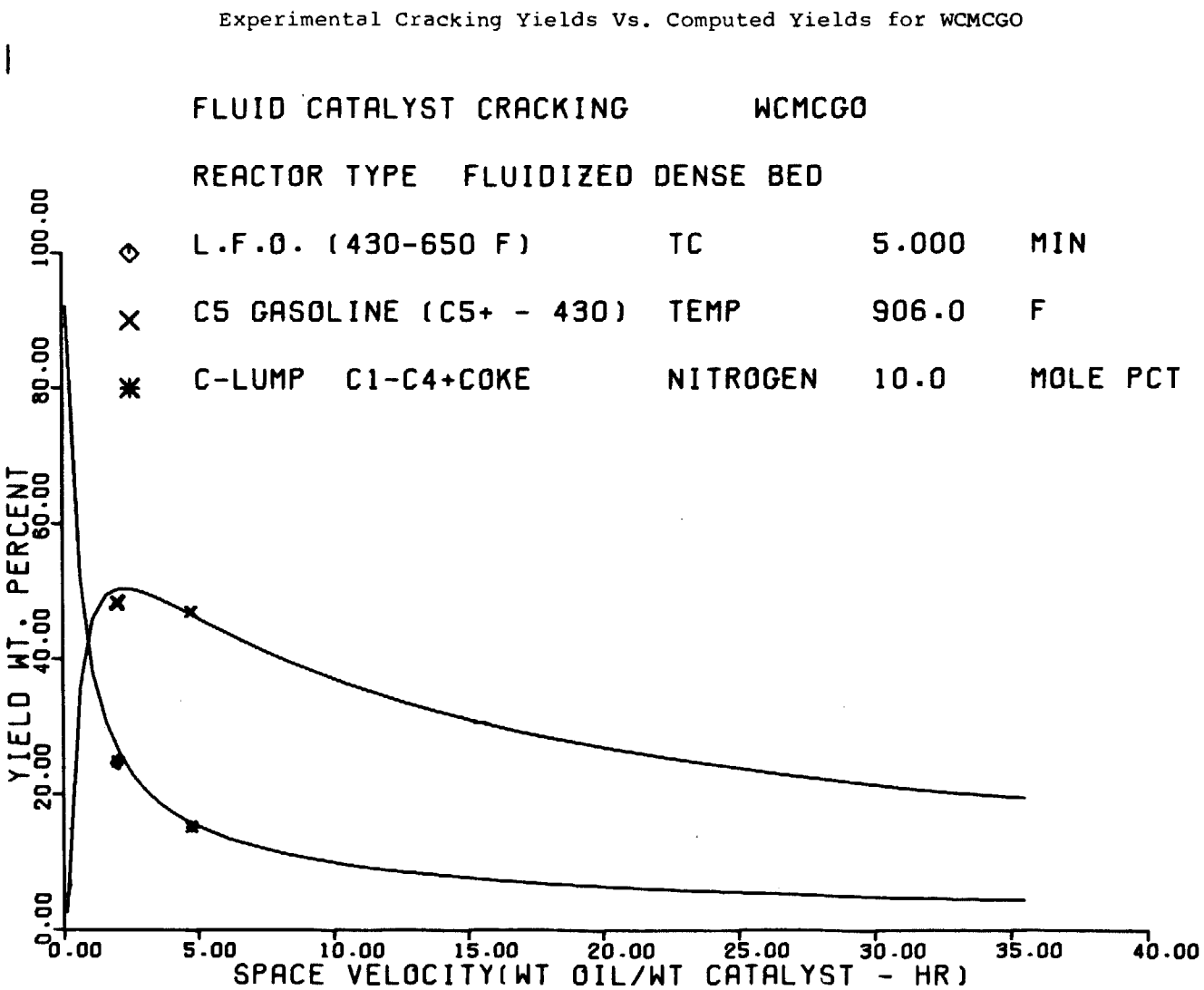

It is assumed, in the present model, that a single activation energy may be assigned to a group of reactions. However, updated activation energies can be integrated into the model, if necessary. The present model has six activation energies derived from temperature data at 900, 950, and 1000° F. on Amal and WCMCGO. The results of fitting these activation energies to the experimental data are shown in FIGS. 21 and 22 for Amal (P3) and in FIG. 29 for WCMCGO. The activation energies thus obtained are associated with the following groups of reactions:

| | Activation Energies (cal/g-mole) |
|---|---|
| 1. Gasoline (G lump) formation reactions from $P_h$, $P_l$, $N_h$, $N_l$ | 5,500 |
| 2. C lump formation reactions from $P_h$, $P_l$, $N_h$, $N_l$ | 8,500 |
| 3. Gasoline (G lump) formation reactions from $A_h$, $A_l$ | 14,500 |
| 4. C lump formation reactions from $A_h$, $A_l$, $C_{Ah}$, $C_{Al}$ | 17,500 |
| 5. C lump formation reactions from Gasoline | 20,000 |
| 6. LFO formation reactions from $P_h$, $N_h$, $A_h$, $C_{Ah}$ | 8,100 |

Nitrogen Poisoning

Basic nitrogen compounds are known to poison acidic cracking catalysts. It has been determined that quinoline added to WCMCGO gives the same effects on conversion and selectivity as the natural occurring nitrogen bases which occur in a typical FCC feedstock.

The effects of nitrogen poisoning have been incorporated into the lumped invariant kinetic model for catalytic cracking by the addition of a catalyst deactivation term related to nitrogen adsorption and the use of a scalar quantity on gasoline formation rate constants.

Catalyst deactivation is accounted for by a deactivation function f(N), given by:

$$f(N) = \frac{1}{1 + K_n\, N/\text{gms of catalyst}} = \frac{1}{1 + \frac{K_h}{100}\,\frac{\text{Wt. \% Basic } N \text{ in charge}}{\text{CAT/OIL}}\,\theta}$$

where N = gms of BASIC N to which the catalyst has been exposed at catalyst residence time, $t_c$. The deactivation function chosen has the form such that at high CATALYST/OIL ratios there are small quantities of Basic N per cracking site and the deactivation is insignificant. $\theta$ is the normalized catalyst residence time.

A slight increase in selectivity is incorporated amounting to a scalar increase of all gasoline formation reactions.

Fourteen sets of data were fitted to give a SE = 1.98 on the G lump and SE = 1.16 on the C lump. The Basic N deactivation constant is $K_n = 3600.0$ (gms Basic N/gms of catalyst)$^{-1}$ and the gasoline formation reaction scalar is such as to increase gasoline formation reactions by 8% for each 0.1 wt. % Basic N in the feed. Basic N effects are neglected, if the concentration is less than 0.04% in the feed.

The deactivation function is such that at the end of an experimental run ($\theta = 1$) where the Cat/Oil = 2.0 and the Basic N in the feedstock is 0.1 wt. % the catalyst activity is reduced by a factor =

$$\frac{1}{1 + \frac{3600}{100}\,\frac{0.1}{2.0}} = 1/2.8$$

Figure 23:
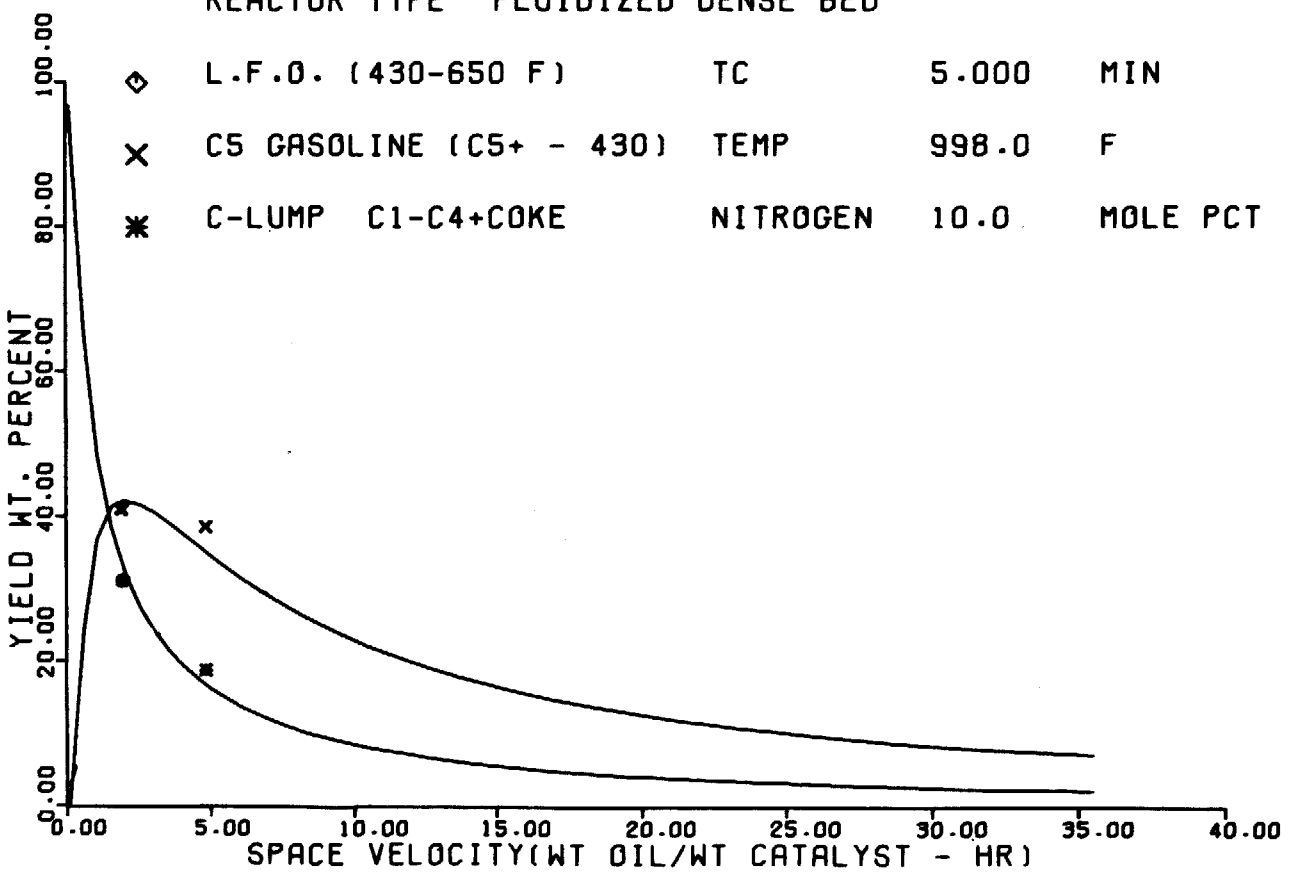
Figure 24:
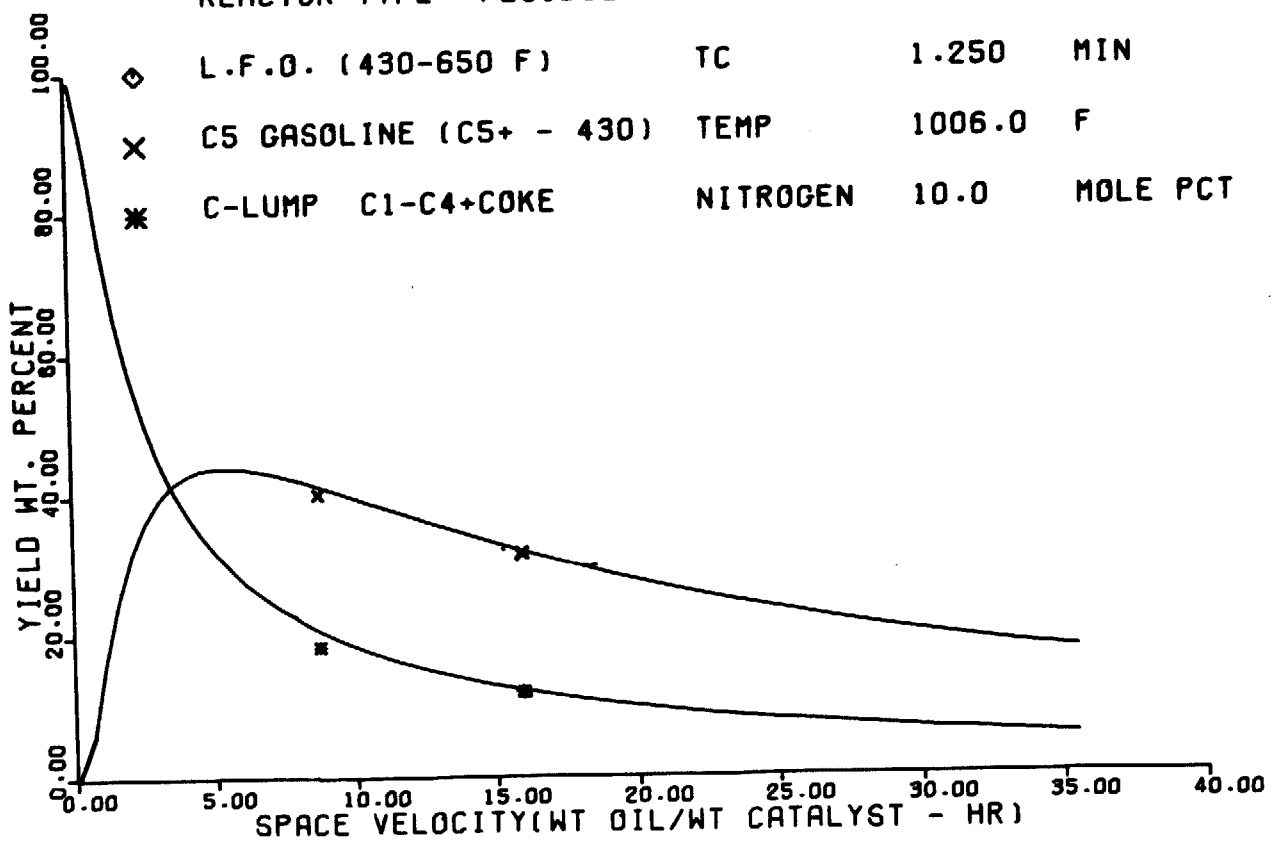

Detailed results for WCMCGO with 0.1 wt. % and 0.2 wt. % addition of nitrogen as quinoline at 1000° F. are indicated in FIGS. 23 and 24.

Figure 25:
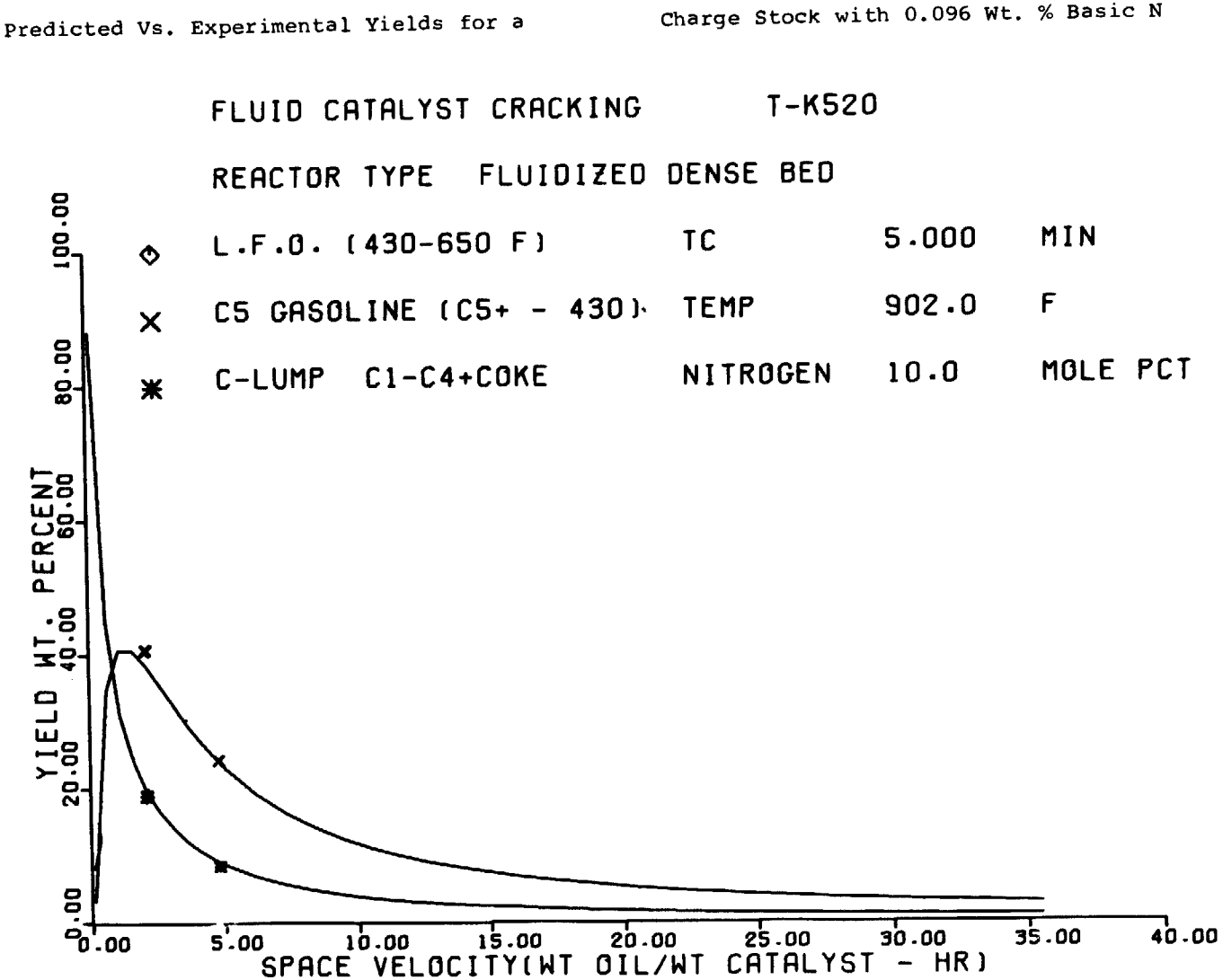

The model has been successfully tested on a gas oil (TK520) with 0.096% Basic N. The result provides a simultaneous test of lumping scheme, and the Basic N poison term. Comparisons between experimental and predicted yields are shown in FIG. 25 for this charge stock.

CATALYST EFFECTS

Figure 26:
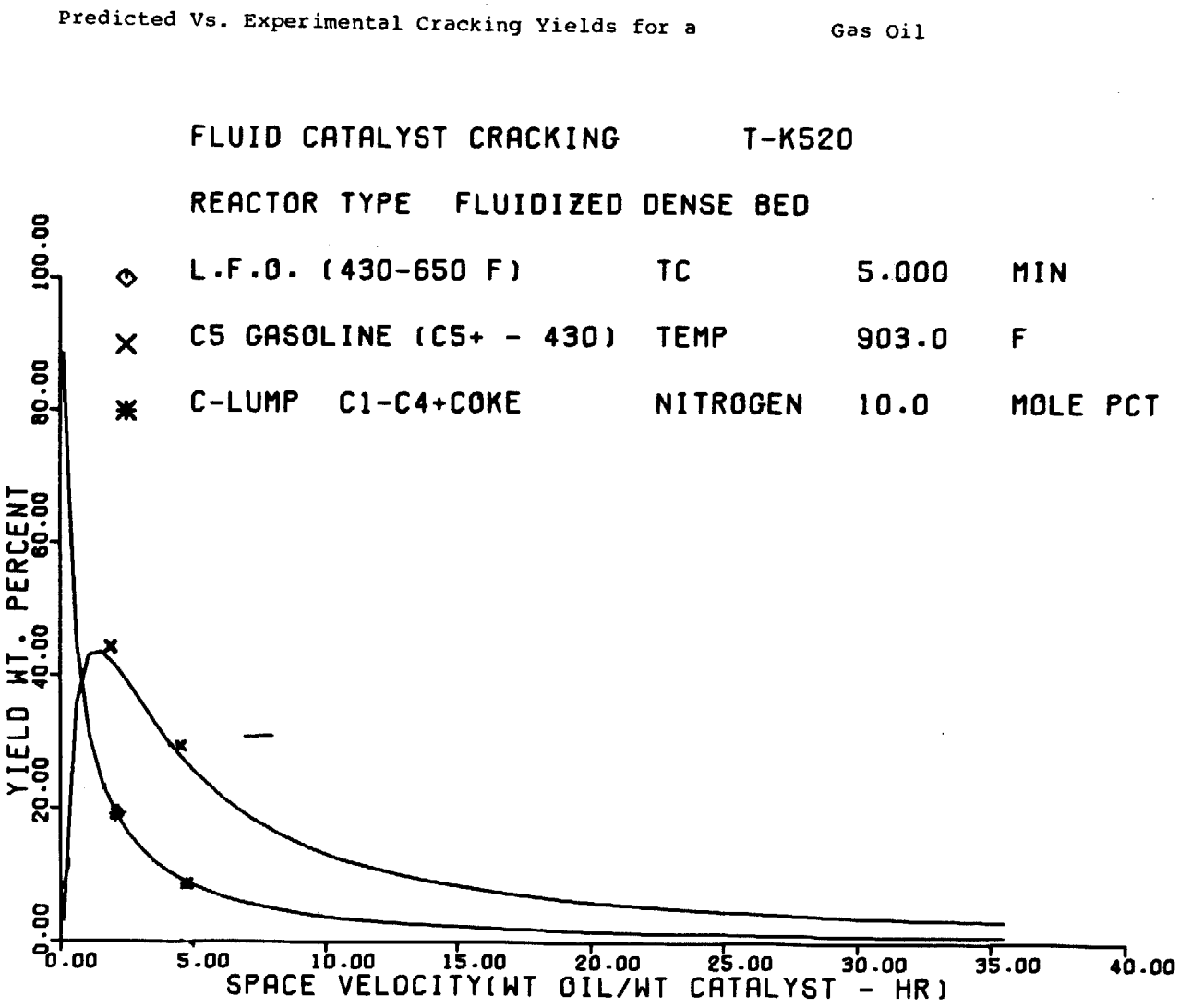

Rate constants listed in Table 2 were generated for a 10% rare earth exchanged zeolite Y aluminosilicate on a silica-alumina base. Catalysts will vary in both activity and selectivity. For example, a similar zeolite Y catalyst having a slightly different activity level was determined to require an alteration of the rate constants of Table 2 by increasing the gasoline formation rates by 20%, and by increasing the gasoline cracking rates by 2.5%. FIG. 26 shows comparisons between experimental and predicted yields for the similar zeolite Y catalyst with the altered model.

RESIDUAL CARBON ON CATALYST

The reactor model was prepared for fresh catalyst. However, since residual coke on the regenerated catalyst in the line 39 (FIG. 1) affects the catalytic properties of the catalyst, the effect of such residual coke on catalyst on the rate constants of the model are provided for experimental data for 0 through 0.5 weight % residual coke on a regenerated catalyst. A single matrix scalar cannot be used. Therefore, different factors must be applied to two groups of rate constants. For example, a 0.3 weight % of residual coke on regenerated catalyst requires that the gasoline formulation rate constants be decreased by 43%, and that the C lump formation rate constants be decreased by 35%. The model linearly interpolates these losses in activity between 0.3 wt. % of residual coke on catalyst and a completely regenerated or fresh catalyst.

Light End and Coke Yields

Correlations are provided in the model to predict the yields of light ends from catalytic cracking. The correlation is based on gasoline and C lump yield and the lumped composition of the charge stock, and is in the following form.

$$L^i = (a^iG + b^iC)\,(a_{pl}{}^iP_{lo} + a_{nl}{}^iN_{lo} + a_{al}{}^iA_{lo} + a_{cal}{}^iC_{alo} + a_{ph}{}^iP_{ho} + a_{nh}{}^iN_{ho} + a_{ah}{}^iA_{ho} + a_{cah}{}^iC_{aho})$$

$L^i$ = light end i (wt. %)

$i = C_1, C_2, C_2'', C_3, C_3'', nC_4, iC_4, C_4'', nC_5, iC_5, C_5''$ $P_{lo}, N_{lo} \ldots, C_{aho}$ = Wt. % composition of the charge stock $G, C$ = Wt. % G lump and Wt. % C lump $a^i, b^i, a_p{}^i \ldots a_{cah}{}^i$ = correlation constants used to fit 95 sets of data on each light end i.

Figure 32:
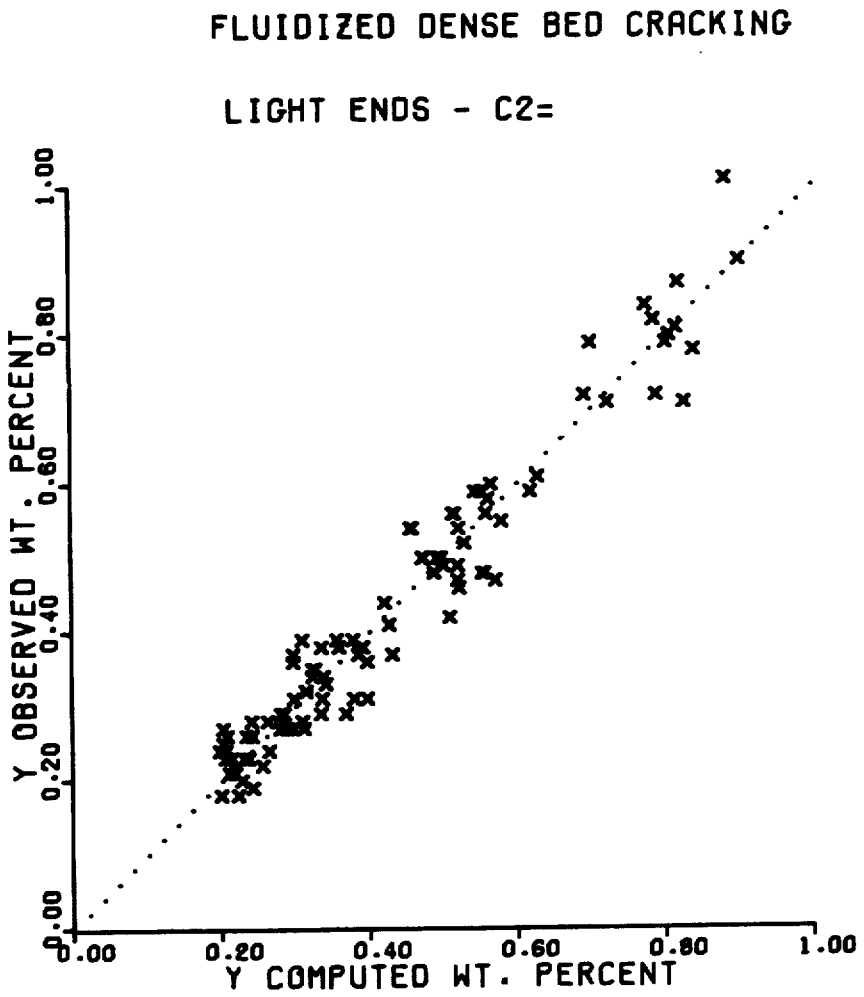
Figure 33:
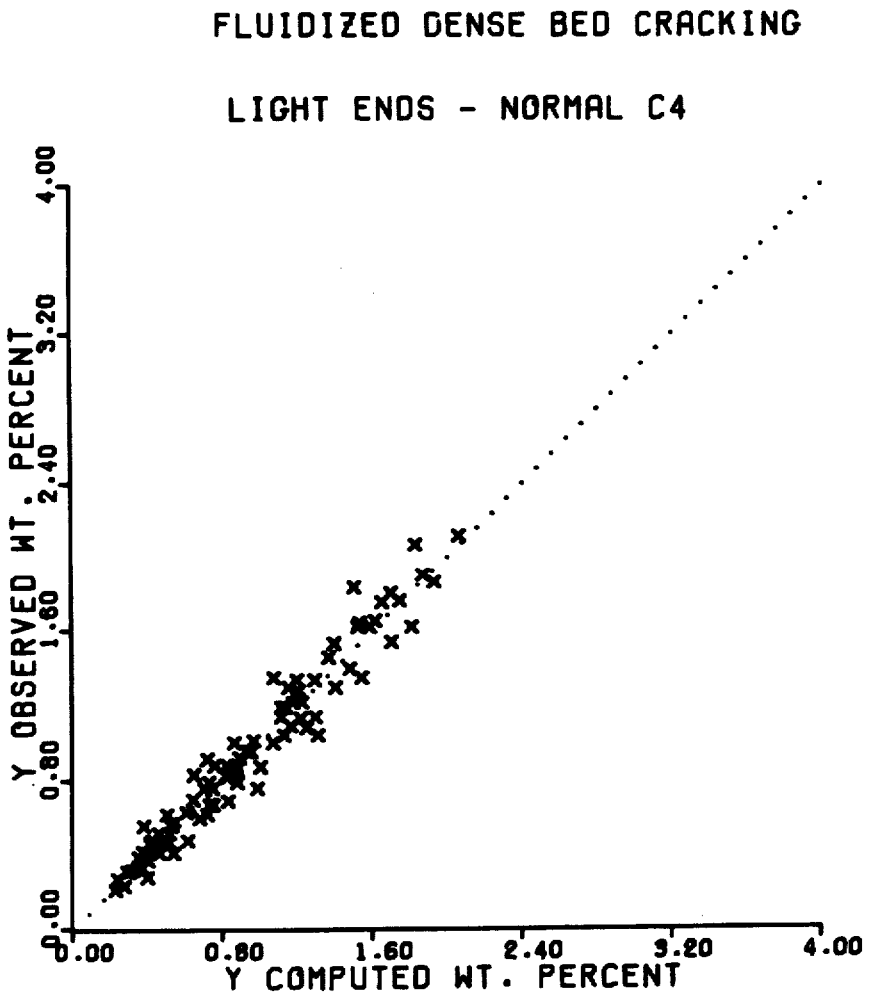

The results are summarized in Table 3, and some typical results for the individual light end yields are shown in FIGS. 32 and 33. Computed yields for $C_1$–$C_4$ are generally within 10% or less of the observed values.

Table 3

Light End Correlation Constants and Results

| | $a^i$ | $b^i$ | $a_{ph}^i$ | $a_{nh}^i$ | $a_{ah}^i$ | $a_{cah}^i$ | $a_{pl}^i$ | $a_{nl}^i$ | $a_{al}^i$ | $a_{cal}^i$ | Standard Error Absolute Wt. % | Average Error Absolute Wt. % | Average Values Wt. % | Range of Values Wt. % |
|---|---|---|---|---|---|---|---|---|---|---|---|---|---|---|
| $C_1$ | −0.0551 | 0.3270 | 0.0659 | 0.1522 | 0.2005 | 0.2263 | 0.0294 | 0.0817 | 0.0737 | 0.3570 | 0.0738 | 0.056 | 0.4 | 0.06–1.0 |
| $C_2$ | −0.0551 | 0.3270 | 0.0659 | 0.1522 | 0.2005 | 0.2263 | 0.0294 | 0.0817 | 0.0737 | 0.3570 | 0.0738 | 0.056 | 0.4 | 0.06–1.0 |
| $C_2=$ | −0.0258 | 0.2060 | 0.1622 | 0.2911 | 0.2683 | 0.0785 | 0.0415 | 0.2828 | 0.4451 | 0.0772 | 0.0445 | 0.032 | 0.5 | 0.19–1.0 |
| $C_3$ | −0.1673 | 1.0780 | 0.1033 | 0.2066 | 0.1356 | 0.0069 | 0.1199 | 0.2655 | 0.1921 | 0.0087 | 0.1339 | 0.104 | 1.5 | 0.40–3.3 |
| $C_3=$ | 0.2540 | 0.3564 | 0.2424 | 0.0846 | 0.1690 | 0.1299 | 0.1727 | 0.0798 | 0.1597 | 0.1602 | 0.1618 | 0.105 | 2.4 | 1.00–3.9 |
| $nC_4$ | −0.0394 | 0.3620 | 0.3199 | 0.2871 | 0.1333 | 0.0031 | 0.2687 | 0.3804 | 0.4823 | 0.0091 | 0.0862 | 0.065 | 1.1 | 0.20–2.2 |
| $iC_4$ | 0.0012 | 1.3950 | 0.1774 | 0.2893 | 0.1297 | 0.0041 | 0.2329 | 0.3271 | 0.2382 | 0.0065 | 0.2450 | 0.181 | 4.5 | 1.0–9.0 |
| $C_4-$ | 0.1288 | −0.0063 | 0.7972 | 0.3455 | 0.5440 | 0.5866 | 0.5726 | 0.2469 | 0.5466 | 0.4226 | 0.1720 | 0.122 | 2.6 | 1.2–3.8 |
| $nC_5$ | 0.0510 | −0.0011 | 0.2114 | 0.1973 | 0.1379 | 0.1608 | 0.3557 | 0.0831 | 0.1380 | 0.4561 | 0.1080 | 0.075 | 0.4 | 0.09–0.73 |
| $iC_5$ | 0.1803 | −0.0013 | 0.7797 | 0.6949 | 0.3467 | 0.2749 | 0.8779 | 0.5228 | 0.9388 | 0.3287 | 0.875 | 0.667 | 4.5 | 0.96–7.84 |
| $C_5=$ | 0.0896 | −0.0670 | 1.1540 | 0.0437 | 0.6362 | 1.0965 | 0.2829 | 0.0499 | 0.7844 | 0.5349 | 0.204 | 0.148 | 1.5 | 0.6–2.4 |

Carbon on catalyst is treated using the coking relation, $C=at_c^n$ where

C is wt. % carbon on catalyst a is a function of charge stock $t_c$ is the catalyst residence time n is an exponent which is a function of catalyst.

The equation below is a relation that is charge stock independent with a standard error SE of 0.24 (absolute wt. %) for wt. % coke produced on charge. Computed coke yields are generally within 6% or less of the observed values.

$$C = \frac{a}{100}\left(\frac{t_c}{5.0}\right)^{0.2}$$

where $a=0.631\ P_{lo}+0.110\ N_{lo}+1.475\ A_{lo}+0.0727\ C_{Alo}+0.631\ P_{ho}+0.297\ N_{ho}+0.773\ A_{ho}+2.225\ C_{Aho}$ $t_c$=catalyst residence time in minutes $P_{lo}$, $N_{lo}$, $A_{lo}$, $C_{Alo}$=Wt. % paraffins, naphthenes, aromatic substituent groups and aromatic rings in LFO of charge $P_{ho}$, $N_{ho}$, $A_{ho}$, $C_{Aho}$=Wt. % paraffins, naphthenes, aromatic substituent groups and aromatic rings in HFO of charge.

The coke yield in wt. % may then be calculated from

Coke Yield (wt. %)=1.1 C (cat/oil)

where the factor 1.1 accounts for the carbon hydrogen ratio in the coke.

COMPUTER PROGRAM

The computer program of Appendix III facilitates the rapid treatment of experimental data. The program performs the following functions:

1. Searches for the best fit to the data (G lump, C lump, LFO) by means of a pattern search on the parameters of the system.
2. Goes into an output routine which prints the pertinent process variables for each run and then calculates the light end and coke yields.
3. The program then proceeds to produce plots of
   (i) observed vs. computed yields for G lump, C lump, and LFO.
   (ii) observed and computed yields vs. space velocity.
   (iii) selectivity plots.
4. The program also allows for different reactor types to be called, (this is specified by the user in the input). The program is capable of treating data obtained from the following reactor types
   (i) time-averaged fluidized dense bed data.
   (ii) time-averaged fixed bed data using a scalar to account for more efficient catalyst utilization.
   (iii) instantaneous data - pilot plant fluidized dense bed.

With reference to the program of Appendix III, PROGRAM MAIN reads in the input data and the initial guess for the rate constants associated with the kinetic scheme and proceeds to determine the best set of rate constants that fits the experimental data.

Beginning with SET ISEARCH, read in input data (1) yields from cracking operation, (2) charge stock properties, and (3) reactor conditions.

Beginning with READ 3, read in initial guess for rate constants.

Beginning with 70 OBJSTR, the program determines the best set of rate constants to fit the experimental data.

Beginning with C COMPUTE AVERAGE ERRORS AND SE, the program computes standard errors of the model fit for gasoline, conversion and light fuel oil.

SUBROUTINE REACTR primarily sets up the fluidized dense bed FCC reactor model and proceeds with the integration of the differential equations through the reactor bed. Outlet concentrations are time-averaged to account for catalyst deactivation. The time-averaged computer values for yields of gasoline, conversion and light fuel oil are then compared to the experimental data to determine how closely the model predicts the bed behaviour. The reactor model may be of three forms, (1) time-averaged fluidized dense bed, (2) instantaneous riser, (3) instantaneous fluidized dense bed. The reactor model is specified by the user in the input.

Beginning with Y(1)=F(J,16), set up initial conditions for the kinetics scheme.

Beginning with H=TIM(K), for the time-averaged fluidized dense bed, integrate the differential equations through the reactor bed, and beginning with COMPUTE AVERAGED YIELDS, YBAR (J,L) compute time-averaged yields.

Beginning with RISER CALCULATION, the same integration scheme may be applied to a riser reactor model.

Beginning with INSTANTANEOUS FLUIDIZED BED REACTOR, the same integration scheme may be applied to an instantaneous fluidized bed reactor.

Beginning with 202 CONTINUE, the program computes the standard error for all the sets of experimental data provided.

SUBROUTINE GAUSS 6 allows the model yield spectrum to be time-averaged for the case where the time-averaged fluidized dense bed data is obtained with catalyst deactivation.

SUBROUTINE CONVERT takes the input data read in the main program and converts it to a more suitable format for computation and printout.

SUBROUTINE FOXY represents the differential equations describing the main kinetic framework in the reactor model. These equations describe the rate of change of each of the ten lumped species in the kinetic scheme shown in FIG. 2. It also computes the rate of formation of gasoline, conversion and light fuel oil. Furthermore, it computes the composition of paraffins, naphthenes, aromatic substituent groups and aromatic rings in the light fuel oil heavy fuel oil fractions.

SUBROUTINE OUTPUT uses correlations to predict light hydrocarbon yields ($C_1$–$C_5$), and coke. These predictions together with the gasoline conversion (C lump+G lump) and LFO are printed-out in a suitable format and compared to the experimental yields.

Beginning with LIGHT END AND COKE CORRELATION on page 16, light ends correlative prediction is generated.

Beginning with CARBON ON CATALYST, the coke prediction is generated.

Beginning with 10 FORMAT, format statements for output are provided.

The program of Appendix III is written in FORTRAN and is suitable for a Control Data Corporation CDC 1604 computer.

The model and program are readily adaptable to any catalytic cracking operation such as a moving bed (e.g., thermofor catalytic cracking), and a fluid riser of a fluid catalytic cracking process for either lab system or a commercial unit.

Appendix IV shows by way of example a comparison between predicted and observed yields for two feed stocks identified as WCMCGO and T-K520. Further Appendix V shows by way of example under PARAMETERS a $\underset{\approx}{K}$ which gives a minimum error (SE).

Appendix V shows by way of an example a printout of a best fit of yields for a WCMCGO charge stock in a fluidized dense bed or fixed bed reactor under the conditions stated thereon.

APPENDIX I

NOMENCLATURE

| | |
|---|---|
| **Roman** | |
| a | Coking constant for Voorhies equation, $C = at_c^n$ |
| $\underset{\sim}{a}$ | Composition vector consisting of j lumped species ($a_j$ = moles j/gm gas) |
| $a_j$ | Concentration of lump j (moles j/gm gas) |
| $A_h$ | Wt. % aromatic substituent groups in HFO (650° F.+) |
| $A_{ho}$ | Wt. % aromatic substituent groups in HFO of charge |
| $A_l$ | Wt. % aromatic substituent groups in LFO (430°–650° F.) |
| $A_{lo}$ | Wt. % aromatic substituent groups in LFO of charge |
| C | "C lump", Wt. % $H_2$, $H_2S$, $C_1$–$C_4$ + coke |
| $C_{Ah}$ | Wt. % aromatic rings in HFO (650° F.+) |
| $C_{Aho}$ | Wt. % aromatic rings in HFO of charge |
| $C_{Al}$ | Wt. % aromatic rings in LFO (430°–650° F.) |
| $C_{Alo}$ | Wt. % aromatic rings in LFO of charge |
| G | "G lump", Wt. % gasoline ($C_5^+$ −430° F.) |
| K | Rate constant matrix |
| $K_{Ah}$ | Heavy aromatic ring adsorption coefficient (Wt. % $C_{Ah})^{-1}$ |
| $K_n$ | Basic nitrogen adsorption coefficient (gms Basic N/gm catalyst)$^{-1}$ |
| $\overline{MW}$ | Mean molecular weight of gas mixture $= \frac{1}{\sum_j a_j}$ |
| $N_h$ | Wt. % naphthenic molecules in HFO (650° F.+) |
| $N_{ho}$ | Wt. % naphthenic molecules in HFO of charge |
| $N_l$ | Wt. % naphthenic molecules in LFO (430°–650° F.) |
| $N_{lo}$ | Wt. % naphthenic molecules in LFO of charge |
| P | Absolute pressure (atmospheres) |
| $P_h$ | Wt. % paraffin molecules in HFO (650° F.+) |
| $P_{ho}$ | Wt. % paraffin molecules in HFO of charge |
| $P_l$ | Wt. % paraffin molecules in LFO (430°–650° F.) |
| $P_{lo}$ | Wt. % paraffin molecules in LFO of charge |
| R | Gas constant (82.05 atm. cm$^3$/g-mole °K.) |
| $S_{WH}$ | True weight hourly space velocity (g feed/g catalyst-hr) |
| $t_c$ | Time from start of run, hr |
| T | Absolute temperature (°K.) |
| X | Dimensionless reactor length |
| **Greek** | |
| $\beta$ | Catalyst deactivation constant |
| $\gamma$ | Catalyst deactivation constant |
| $\Phi(t_c)$ | Catalyst decay as a function of catalyst residence time, $\frac{1}{1+\beta t_c^{\gamma}}$, (dimensionless) |
| $\sigma_C^2$ | Sum of the square of the deviations for C lump |
| $\sigma_G^2$ | Sum of the square of the deviations for G lump |
| $\sigma_L^2$ | Sum of the square of the deviations for LFO |

APPENDIX II

Development of Reactor Model

When gaseous chemical reactions occur which produce a change in the molecular weight of the reacting mixture (e.g., cracking reactions), the gas density changes accordingly. If these reactions take place in a tubular flow reactor, then this density variation produces a corresponding change in the linear velocity of the flowing gas. This needs to be modeled into the reactor description.

If inert gases are present in the reaction mixture, they too will influence this linear velocity and the reactant concentrations.

To formulate a reactor model, several assumptions must be made concerning the flow in the reactor, both of gas and solids.

Assumptions in Reactor Model

1. Reactor cross section is uniform.
2. Void fraction is uniform.
3. Mass flow rate through reactor is steady and in plug flow.

From 1, 2, and 3 and the equation of continuity (i.e., mass balance) G, the mass velocity, is constant throughout the bed. That is, $$G = \rho u = \text{constant}$$

where

G = Mass velocity, g/(cm$^3$ free cross section) (hr)

u = Gas velocity in the bed, cm/hr $\rho$ = Gas density, g/cm$^3$

A component material balance on a differential section of the reactor gives $$\left(\frac{\partial \rho a_j}{\partial t_c}\right)_x + G\left(\frac{\partial a_j}{\partial x}\right)_{t_c} = r_j$$

where $a_j$ = Concentration of component, j, moles j/g gas $r_j$ = Rate of formation of component, j, moles j/(cm$^3$ gas) (hr)

$t_c$ = Time from start of run, hr x = Distance into reactor from inlet, cm

No assumptions have been made to this point about the reaction kinetics so the model is still perfectly general.

Rate of Reaction

It is assumed that the rate of disappearance of a chemical species, j, in a single reaction is proportional to the molar concentration of species j (i.e., $\rho a_j$), and the mass density of catalyst relative to the gas volume (i.e., $C_c/\epsilon$). (NOTE: $C_c$ is defined as g catalyst/cm$^3$ bed; $\epsilon$ is bed void fraction). It is further assumed that the adsorption of heavy inert aromatic rings on the catalyst surface will influence the availability of active sites and consequently the rate of reaction, thus $$r_j = -k_j' (\rho a_j) \left(\frac{C_c}{\epsilon}\right) \frac{1}{1 + K_h C_{Ah}}$$

The rate constant, $k_j'$, has units of (g catalyst/cm$^3$)$^{-1}$ (hr)$^{-1}$. Combining the rate and material balance equation, $$\left(\frac{\partial \rho a_j}{\partial t_c}\right)_x + G\left(\frac{\partial a_j}{\partial x}\right)_{t_c} = -k_j' \rho a_j \frac{C_c}{\epsilon} \frac{1}{1 + K_h C_{Ah}}$$

The rate constant need not be constant but can decay with time.

Conversion to Laboratory Units

Experimental data are not usually reported in the form used by the model equation. Mass fractions usually replace moles/g gas, space velocity replaces mass velocity and so on. To make this model more readily useful, therefore, we have changed it to accept usual laboratory data.

Let X = x/L = dimensionless distance into bed $S_{WH}$ = g feed (oil + inerts)/(hr) (g catalyst)

NOTE: $S_{WH}$ is not the same as the weight hourly space velocity generally reported, i.e., g oil/hr g catalyst, which neglects the effect of inerts. In this discussion $S_{WH}$ will be used exclusively; it is the *True Weight Hourly Space Velocity.*

From the definitions of G and $S_{WH}$ $$G = \frac{S_{WH} C_c L}{\epsilon}$$

Assuming that the rate of concentration change with time, $$\left(\frac{\partial \rho a_j}{\partial t_c}\right)_x,$$

is small relative to the rate of change with position in a fluidized dense bed this is tantamount to saying that the oil molecules traverse the bed so fast that they see catalyst of essentially the same age then our model becomes $$\frac{da_j}{dX} = -\frac{1}{1 + K_h C_{Ah}} \frac{k_j' \rho a_j}{S_{WH}}$$

Now introduce catalyst decay as a function of catalyst residence time, $t_c$. Assume, too, that the decay is nonselective:

$$k_j' = k_j \Phi(t_c)$$

where $k_j$ are invariant rate constants With the ideal gas assumption $$\rho = \frac{P\overline{MW}}{RT}$$

then $$\frac{da_j}{dX} = -\frac{1}{1 + K_h C_{Ah}} \frac{\Phi(t_c) P \overline{MW} k_j a_j}{S_{WH} RT}$$

In matrix notation $$\frac{d\underset{\sim}{a}}{dX} = \frac{1}{1 + K_h C_{Ah}} \frac{P\overline{MW}\Phi(t_c)}{S_{WH} RT} \underset{\approx}{K} \underset{\sim}{a}$$

This system is *not* linear because MW is not constant. It changes with distance into the bed. Note that $$\overline{MW} = \frac{\Sigma a_j M_j}{\Sigma a_j} = \frac{1}{\Sigma a_j}$$

since the units for $a_j$ is moles j/gm of gas. The computer program solves this system of ordinary differential equations numerically using an extrapolation to zero routine.

Coordinate Transformation in Fixed and Fluidized Dense Beds

Experimental runs using fluid and fixed beds often obtain products collected over the duration of a run. If catalyst decay is present, then this collected material represents the mixed average reactor effluent. To account for time-averaging it is necessary to integrate the model equations from bed inlet to outlet ($X=0$ to $X=1$) and then integrate the reactor effluent over the duration of the run ($t_c=0$ to $t_c=t_{run}$).

To simplify greatly the calculational effort, the following coordinate transformation is performed.

Let $$dW = \frac{\Phi(t_c)\,P}{S_{WH}\,RT}\,dX$$

This transformation of the reaction coordinate, X, yields a "crazy clock time" W which incorporates into its definition the effect of $S_{WH}$ and $t_c$ and is given by:

$$W = \frac{\Phi(t_c)\,P}{S_{WH}\,RT}\,X$$

Note that this transformation holds only for fixed or fluidized dense beds (for a riser $\Phi(t_c)=f(X)$). The model becomes simply $$\frac{d\underset{\sim}{a}}{dW} = \frac{1}{1+K_h C_{Ah}}\;\frac{\underset{\approx}{K}\,\underset{\sim}{a}}{\sum_j a_j}$$

To see that this single result can be quite useful, determine the mixed average concentration for a particular run.

From the initial conditions (the specific feedstock) integrate the model equation to give $\underset{\sim}{a}$ as a function of W.

Next evaluate W for $X=1$ (reactor outlet)

$$W = \frac{\Phi(t_c)\,P}{S_{WH}\,RT}$$

where P, R, T, $S_{WH}$ are known from the run.

Next choose six times from 0 to $t_c$ according to a 6-point Gaussian quadrature integration formula. Using the equation above this specifies the six transformed coordinate values at which $\underset{\sim}{a}(W)$ is evaluated and supplied to the Gaussian formula. This together with the appropriate weighting factors gives the time-averaged composition.

For any given feed composition, only one evaluation of $a_j$ vs. W is required, thus computation time is substantially reduced.

It is important that the significance of this coordinate change not be overlooked. With one set of solutions $\underset{\sim}{a}$ vs. W, we know the reactor effluent for all $S_{WH}$ and $t_c$ for both fixed and fluid beds.

APPENDIX III

```
      PROGRAM MAIN
      COMMON/FOXY/ BETA1,BETA2,BETA3,BETA4,NREACT,RK8,RK9,RK10,RK11,RK12
     1,RK13,RK(50),MWOILL(100),MWOILH(100),MWIN(100),Z(10),RATHL(100),
     2RATHG(100),RATLG(100),R(100,20),RR(100,20),MWOIL(100)
      COMMON/GAUSS6/FF(100,20),F(100,20),TIME(12),TIM(12),GOGTO(100)
      COMMON/CONVERT/LBAR(100),GBAR(100),CBAR(100),PP(100,20),P(100,20)
     1,YY(20,10),YBAR(1,20),S(50),CH(100),CL(100)
      COMMON/SEARCH/NDATA,J,N,OBJ1,OBJ2,OBJCOM,NRATE,D9B,STEP,N1,N2,NP
      TYPE REAL MWOILL,MWOILH,MWOIL,MWIN,LBAR
      CALL MEMLEFT
      PRINT 7
    7 FORMAT(40H1 INPUT DATA FOLLOWS                                    )
      READ 1 ,NDATA,NRATE,N,ISEARCH,IPLOT,NP,STEP,SSTOP,D9B
      PRINT 1,NDATA,NRATE,N,ISEARCH,IPLOT,NP,STEP,SSTOP,D9B
    1 FORMAT(6I3,12X,2F10.4,22X,A8)
C     SET ISEARCH=1 IF SEARCH IS REQUIRED
C     SET IPLOT=1   IF PLOT IS REQUIRED
C
      READ 3, (RK(J), J=1,NRATE)
      PRINT 3, (RK(J), J=1,NRATE)
    3 FORMAT(8F10.2)
      DO 5 I=1,NDATA
      READ 6, (PP(I,J), J=1,15)

      PRINT 6, (PP(I,J), J=1,15)
    6 FORMAT(3X,A7,7F10.4/10X,7F10.4)
      READ 2, (FF(I,J),J=2,14)
      PRINT 2, (FF(I,J),J=2,14)
      READ 201, (RR(I,J),J=1,9 )
      PRINT 201, (RR(I,J),J=1,9 )
  201 FORMAT(3X,A6,F9.4,6F10.4/10X,7F10.4)
    5 CONTINUE
    2 FORMAT(10X,7F10.4)
C
C     INPUT DATA HAS THE FOLLOWING FORM -
C  ARRAY PP(J,K) RELATES TO PRODUCT ANALYSIS, FF(J,K) TO FEED, AND
C RR(J,K) TO REACTOR CONDITIONS.  THE J REPRESENTS THE RUN NUMBER,
C  THE K REPRESENTS THE PARTICULAR ITEM OF DATA.
```

```
C
C     THUS, IN ARRAY F, FOR ANY RUN J
C
C FF(J,2)=WT PCT P-HEAVY IN HEAVY FUEL OIL
C       3 =WT PCT P-LIGHT IN LIGHT FUEL OIL
C       4 =WT PCT N-HEAVY IN HEAVY FUEL OIL
C       5 =WT PCT  N-LIGHT IN LIGHT FUEL OIL
C       6 =WT PCT  HEAVY FUEL OIL
C       7 =CP HEAVY, PCT
C       8 =CN HEAVY, PCT
C       9 =CP LIGHT, PCT
C      10 =CN LIGHT, PCT
C      11 =MW LIGHT FUEL OIL (P,N,A ASSUMED THE SAME)
C      12 =MW HEAVY FUEL OIL (P,N,A ASSUMED THE SAME)
C      13 =WT PCT SULPHUR IN FUEL OIL
C      14 =WT PCT NITROGEN IN FUEL OIL
C
C
C      IN ARRAY P, FOR ANY RUN J
C
C PP(J,2)=WT PCT GASOLINE IN PRODUCT HYDROCARBON
C       3 =WT PCT C LUMP IN PRODUCT HYDROCARBON
C       4 =WT PCT LIGHT FUEL OIL IN PRODUCT HYDROCARBON
C       5 =WT PCT C1
C       6 =        C2 PRIME
C       7 =        C3
C       8 =        C3 PRIME
C       9 =      N-C4
C      10 =      I-C4
C      11 =        C4 PRIME
C      12 =      N-C5
C      13 =      I-C5
C      14 =        C5 PRIME
C      15 =        COKE
C
C
C      IN ARRAY R
C
C RR(J,2)= REACTOR TYPE (1.0=DENSE FLUID BED)
C                       (2.0=RISER          )
C                       (3.0=PILOT PLANT- INSTANTANEOUS DATA)
C RR(J,3)= WEIGHT HOURLY SPACE VELOCITY,GRAMS OIL/HR GRAM CATALYST
C       4 = CATALYST RESIDENCE TIME,MIN
C       5 = NITROGEN, MOLE PCT,((MOLES N2 /(MOLES(N2+OIL))*100.)
C       6 = H2O, WT PCT ((GRAMS H2O/(GRAMS(H2O+OIL)))(100.)
C       7 = TEMPERATURE, DEGREES F.
C       8 = PRESSURE, PSIG
C       9 = CARBON ON CATALYST
C
C
C      RK(1)=KALG     RK(2)=KALC     RK(3)=KNLG
C      RK(4)=KNLC     RK(5)=KPLG     RK(6)=KPLC
C      RK(7)=KGC      RK(8)=BETA     RK(9)=GAMMA
C      RK(10)=KAHAL   RK(11)=KNHNL   RK(12)=KPHPL
C      RK(13)=KAHG    RK(14)=KAHC    RK(15)=KNHG
C      RK(16)=KNHC    RK(17)=KPHG    RK(18)=KPHC
C      RK(19)=KCAHC   RK(20)=KCAHCAL      RK(21)=KAHCAL       RK(22)=KCAL
C      RK(23)=SCALE FACTOR FOR P,N,A LIGHT AND HEAVY TO GASOLINE
C      RK(24)=SCALE FACTOR FOR P,N,A LIGHT AND HEAVY TO CLUMP
C      RK(25)=SCALE FACTOR FOR GASOLINE TO CLUMP
C      RK(26)=SCALE FACTOR FOR P,N,A HEAVY FUEL OIL TO LIGHT FUEL OIL
C      RK(27)=NITROGEN POISON TERM
C      RK(30) EFFECT OF CARBON ON REGEN CAT- GASOLINE FORMATION REACTIO
C      RK(31) EFFECT OF CARBON ON REGEN CAT- CLUMP FORMATION REACTIONS
C      RK(32) EFFECT OF CARBON ON REGEN CAT- GASOLINE CRACKING REACTI
C      RK(33) SCALE FACTOR FOR ALL REACTIONS- ****UNIT FACTOR**********
C      RK(34)=ADSORBTION TERM FOR CATALYST POISONING DUE TO CA HEAVY
C      RK(35) ACTIVATION ENERGY FOR AH AND AL TO GASOLINE
C      RK(36) ACTIVATION ENERGY FOR AH,AL,CH,CL TO C LUMP
C      RK(37) ACTIVATION ENERGY FOR PH,PL,NH,NL TO GASOLINE
C      RK(38) ACTIVATION ENERGY FOR PH,PL,NH,NL TO C LUMP
C      RK(39) ACTIVATION ENERGY FOR ALL LFO FORMATION REACTIONS
C      RK(40) ACTIVATION ENERGY FOR GASOLINE TO C LUMP
       CALL CONVERT
```

```
      OBJCOM=1.0E+20
      N1=1
      N2=NDATA
      IF(ISEARCH.EQ.1) 105,120
  105 CONTINUE
      CALL REACTR
   70 OBJSTR=OBJCOM
      DO 100 L=33,33
   80 RK(L)=RK(L)*(1.0+STEP)
      CALL REACTR
      IF(OBJ2.LE.OBJ1) 100,90
   90 RK(L)=RK(L)*(1.0-STEP)/(1.0+STEP)
      CALL REACTR
      IF(OBJ2.LE.OBJ1) 100,91
   91 RK(L)=RK(L)/(1.0-STEP)
  100 CONTINUE
      COMP=OBJSTR*0.999
      IF(OBJCOM.LT.COMP) 70,71
   71 CONTINUE
      IF(STEP.LE.SSTOP) 120,121
  121 STEP=STEP/2
      GO TO 70
  120 CONTINUE
C     COMPUTE AVERAGE ERRORS AND SE ON EACH OF G,C,L
      SUM1=0.0
      SUM2=0.0
      SUM3=0.0
      SUM4=0.0
      SUM5=0.0
      SUM6=0.0
      CALL REACTR
      DO 1000  J=1,NDATA
      SUM1=SUM1+ABS(PP(J,2)-GBAR(J))
      SUM2=SUM2+ABS(PP(J,3)-CBAR(J))
      SUM3=SUM3+ABS(PP(J,4)-LBAR(J))
      SUM4=SUM4+    (PP(J,2)-GBAR(J))**2
      SUM5=SUM5+    (PP(J,3)-CBAR(J))**2
      SUM6=SUM6+    (PP(J,4)-LBAR(J))**2
 1000 CONTINUE
      SUM1=SUM1/NDATA
      SUM2=SUM2/NDATA
      SUM3=SUM3/NDATA
      SUM4=SQRT(SUM4/(NDATA))
      SUM5=SQRT(SUM5/(NDATA))
      SUM6=SQRT(SUM6/(NDATA))
      PRINT 98
      PRINT 99
   98 FORMAT(//,51H      AVERAGE ERRORS                    STANDARD ERRORS    )
   99 FORMAT(      60H  G LUMP     C LUMP     LFO       G LUMP     C LUMP
     1LFO            )
      PRINT 101, SUM1,SUM2,SUM3,SUM4,SUM5,SUM6
  101 FORMAT(10E10.2)
      CALL OUTPUT
      IF (IPLOT.EQ.1) 109,111
  109 CONTINUE
      CALL PLOTTING
  111 CONTINUE
      STOP
      END
```

```
PROGRAM          MAIN

                                IDENT     MAIN
RANGE              FWA  -  LWA+1
                  32555     33255
ENTRY POINTS
                  32627      MAIN
EXTERNAL SYMBOLS
                  00001  Q1005100
                  00002  Q1010010
                  00003   MEMLEFT
                  00004   CONVERT
                  00005    REACTR
                  00006       ABS
                  00007      SQRT
                  00010    OUTPUT
                  00011  PLOTTING
                  00012  QBOSTOPS
                  00013  QBQINGIN
                  00014  QBQENGIN
                  00015  QBQGINTY
                  00016  QBQINGOT
                  00017  QBQENGOT
                  00020  QBQGOTTY
                  00021  QBQENTRY
   NO DOUBLY DEFINED                          000
   NO UNDEFINED SYMBOLS
   NO ASSEMBLY ERRORS
      NULLS                       BETA1        BETA2        BETA3        BETA4       NREACT
                                    RK8          RK9         RK10         RK11         RK12
                                   RK13       MWOILL       MWOILH         MWIN            Z
                                  RATHL        RATHG        RATLG            R        MWOIL
                                      F         TIME          TIM        GOGTO            P
                                     YY         YBAR            S           CH           CL
                                ENDING.           .5         .105          .80        .1000
                                   .109
```

```
      SUBROUTINE REACTR
      COMMON/FOXY/ BETA1,BETA2,BETA3,BETA4,NREACT,RK8,RK9,RK10,RK11,RK12
     1,RK13,RK(50),MWOILL(100),MWOILH(100),MWIN(100),Z(10),RATHL(100),
     2RATHG(100),RATLG(100),R(100,20),RR(100,20),MWOIL(100)
      COMMON/GAUSS6/FF(100,20),F(100,20),TIME(12),TIM(12),GOGTO(100)
      COMMON/CONVERT/LBAR(100),GBAR(100),CBAR(100),PP(100,20),P(100,20)
     1,YY(20,10),YBAR(1,20),S(50),CH(100).CL(100)
      COMMON/SEARCH/NDATA,J,N,OBJ1,OBJ2,OBJCOM,NRATE,D98,STEP,N1,N2,NP
      TYPE REAL MWOILL,MWOILH,MWOIL,MWIN,LBAR
      DIMENSION Y(50)
      DIMENSION RKS(25)
      IF(N1.EQ.N2) 9,994
  994 PRINT 995
  995 FORMAT(1H1)
      PRINT 996
  996 FORMAT(8X,112H    G LUMP   G LUMP    C LUMP   C LUMP    LFO    LFO
     1   AH       NH       PH       CH       AL       NL       PL       CL          )
      PRINT 997
  997 FORMAT(8X, 56H        PRED   OBS          PRED   OBS          PRED     OBS )
    9 OBJ1=OBJCOM
   10 OBJ2=0.0
      NTIME=6
      EPS=1.0E-06
      FUNC=0.0
      DO 981 K1=1,22
  981 RKS(K1)=RK(K1)
      DO 40 J=N1,N2
      TTERM=1.0/R(J,7)-1.0/755.2
C     ADJUST FOR ACTIVATION ENERGIES
      E1=EXP(-RK(35)*TTERM/1.987)                                    A    TO G
      E2=EXP(-RK(36)*TTERM/1.987)                                    A,CATO C
      E3=EXP(-RK(37)*TTERM/1.987)                                    P,N TO G
      E4=EXP(-RK(38)*TTERM/1.987)                                    P,N TO C
      E5=EXP(-RK(39)*TTERM/1.987)                                    ALL LFO
      E6=EXP(-RK(40)*TTERM/1.987)                                    G    TO C
      RK(1)=RK(1)*E1
      RK(13)=RK(13)*E1
      RK(2)=RK(2)*E2
      RK(14)=RK(14)*E2
      RK(19)=RK(19)*E2
      RK(22)=RK(22)*E2
      RK(3)=RK(3)*E3
      RK(5)=RK(5)*E3
      RK(15)=RK(15)*E3
      RK(17)=RK(17)*E3
      RK(4)=RK(4)*E4
      RK(6)=RK(6)*E4
      RK(16)=RK(16)*E4
      RK(18)=RK(18)*E4
      RK(10)=RK(10)*E5
      RK(11)=RK(11)*E5
      RK(12)=RK(12)*E5
      RK(20)=RK(20)*E5
      RK(21)=RK(21)*E5
      RK(7)=RK(7)*E6
      ADJUST SCALE FACTORS IF ASKED FOR
      BETA1=RK(23)*RK(33)
      BETA2=RK(24)*RK(33)
      BETA3=RK(25)*RK(33)
      BETA4=RK(26)*RK(33)
C     ADJUST RATE CONSTANTS FOR CARBON ON REGENERATED CATALYST
      BETA1=BETA1*(1.0-RK(30)*RR(J,9))
      BETA2=BETA2*(1.0-RK(31)*RR(J,9))
      BETA3=BETA3*(1.0-RK(32)*RR(J,9))
      BETA4=BETA4*(1.0-RK(30)*RR(J,9))
C     ADJUST IF CATALYST IS D98
      IF(RR(J,1).EQ.D98)  350,351
  350 BETA1=BETA1*1.20
      BETA3=BETA3*1.025
  351 CONTINUE
C
C  FORM INITIAL CONDITIONS OF P,N,AND A LUMPS
C
```

```
      Y(1)=F(J,16)
      Y(2)=F(J,5)
      Y(3)=F(J,3)
      Y(4)=0.0
      Y(5)=F(J,15)
      Y(6)=F(J,4)
      Y(7)=F(J,2)
      Y(8)=F(J,17)
      Y(9)=F(J,16)
      Z(5)=0.0                                                          C
      Z(6)=0.0                                                          ********
      Z(6)=R(J,5)+R(J,6)                                                I
C
      DO 100 K=1,N
  100 S(K)=0.0
C
      NREACT=RR(J,2)+0.1
      IF(NREACT.EQ.3) 302,301
  301 CONTINUE
      IF(NREACT.EQ.1) 200,201
  302 CONTINUE
C *** TIME AVERAGED FLUIDISED DENSE BED *****
      CALL GAUSS6
      X=0.0
      H=TIM(1)
      DO 108 K=1,NTIME
      T=TIM(K)
  105 CALL DEXTRA(N,X,Y,H,EPS,S)
      IF(X.LT.T) 106,110
  106 H=AMIN1(H,T-X)
      GO TO 105
  110 H=AMIN1(H,TIM(K+1)-X)
C   STORE OUTPUT CONC,S IN YY
      YY(1,K)=Y(1)                                                      AL
      YY(2,K)=Y(2)                                                      NL
      YY(3,K)=Y(3)                                                      PL
      YY(4,K)=Y(4)                                                      GAS
      YY(5,K)=Z(5)                                                      CLU
      YY(6,K)=Y(1)+Y(2)+Y(3)+Y(9)                                       LFO
      YY(7,K)=Y(5)
      YY(8,K)=Y(6)
      YY(9,K)=Y(7)
      YY(10,K)=Y(8)                                                     CAH
      YY(11,K)=Y(9)                                                     CAL
  108 CONTINUE
C NOW HAVE COMPLETED    FULL RUN ON FEED J
C
C COMPUTE  AVERAGED YIELDS,YBAR(J,L)
      DO 155 L=1,11
      YBAR(1,L)=0.08566225*(YY(L,1)+YY(L,6))+0.1803808*(YY(L,2)+YY(L,5))
      YBAR(1,L)=   (YBAR(1,L)+0.2339570*(YY(L,3)+YY(L,4)))
  155 CONTINUE
      YBAR(1,1)=YBAR(1,1)*MWOILL(J)/GOGTO(J)*100.0
      YBAR(1,2)=YBAR(1,2)*MWOILL(J)/GOGTO(J)*100.0
      YBAR(1,3)=YBAR(1,3)*MWOILL(J)/GOGTO(J)*100.0
      YBAR(1,11)=YBAR(1,11)*MWOILL(J)/GOGTO(J)*100.0
      YBAR(1,7)=YBAR(1,7)*MWOILH(J)/GOGTO(J)*100.0
      YBAR(1,8)=YBAR(1,8)*MWOILH(J)/GOGTO(J)*100.0
      YBAR(1,9)=YBAR(1,9)*MWOILH(J)/GOGTO(J)*100.0
      YBAR(1,10)=YBAR(1,10)*MWOILH(J)/GOGTO(J)*100.0
      GBAR(J)=YBAR(1,4)*10000./GOGTO(J)
      CBAR(J)=YBAR(1,5)*4000./GOGTO(J)
      LBAR(J)=YBAR(1,6)*MWOILL(J)/GOGTO(J)*100.0
      GO TO 202
C ****************************************
  201 CONTINUE
C *** RISER CALCULATION ********************
      T=1.0
      X=0.0
      H=0.5
  205 CALL DEXTRA(N,X,Y,H,EPS,S)
      IF(X.LT.T) 206,210
  206 H=AMIN1(H,T-X)
```

```
      GO TO 205
 210  CONTINUE
      GBAR(J)=Y(4)*10000./GOGTO(J)
      CBAR(J)=Z(5)*4000./GOGTO(J)
      LBAR(J)=(Y(1)+Y(2)+Y(3)+Y(9))*MWOILL(J)/GOGTO(J)*100.0
C ****************************************
      GO TO 202
C *** INSTANTANEOUS FLUIDISED BED REACTOR ***************
 302  X=0.0
      T=R(J,6)/(R(J,3)*0.082*R(J,7))*1.0/(1.+RK(8)*(R(J,4))**RK(9))
      H=0.5*T
 305  CALL DEXTRA(N,X,Y,H,EPS,S)
      IF(X.LT.T) 306,310
 306  H=AMIN1(H,T-X)
      GO TO 305
 310  CONTINUE
      GBAR(J)=Y(4)*10000./GOGTO(J)
      CBAR(J)=Z(5)*4000./GOGTO(J)
      LBAR(J)=(Y(1)+Y(2)+Y(3)+Y(9))*MWOILL(J)/GOGTO(J)*100.0
C ****************************************
 202  CONTINUE
      FUNC=FUNC+(PP(J,2)-GBAR(J))**2+(PP(J,3)-CBAR(J))**2
      PRINT 90,PP(J,1), GBAR(J),PP(J,2),CBAR(J),PP(J,3),LBAR(J),PP(J,4),
     1YBAR(1,7),YBAR(1,8),YBAR(1,9),YBAR(1,10),YBAR(1,1),YBAR(1,2),
     2YBAR(1,3),YBAR(1,11)
  90  FORMAT(1X,A/,3(5X,F5.2,2X,F5.2),8(2X,F5.2))
      DO 980 K1=1,22
 980  RK(K1)=RKS(K1)
  40  CONTINUE
      OBJ2=SQRT(FUNC/(NDATA))
      IF(OBJ2.LE.OBJCOM) 131,141
 131  OBJCOM=OBJ2
 141  CONTINUE
      IF(N1.EQ.N2) 101,993
 993  PRINT 998,OBJCOM,OBJ2,FUNC,STEP
 998  FORMAT(//,5H SF= ,E12.4,10X,18HSE FOR TRIAL STEP=,E12.4,10X,5H PHI
     1=,E12.4,10X, 10HSTEP SIZE=, F6.4,//,12H PARAMETERS )
      PRINT 999,(RK(J), J=1,NRATE)
 999  FORMAT(10E12.4)
 101  RETURN
      END
```

```
SUBROUTINE      REACTR

                          IDENT     REACTR
RANGE              FWA -   LWA+1
                  32555    33532
ENTRY POINTS
                  32746    REACTR
EXTERNAL SYMBOLS
                  00001  Q1Q10100
                  00002  Q2Q07111
                  00003  Q1Q10010
                  00004       EXP
                  00005    GAUSS6
                  00006    DEXTRA
                  00007     AMIN1
                  00010      SQRT
                  00011  Q8QINGOT
                  00012  Q8QENGOT
                  00013  Q8QGOTTY
                  00014  Q8QENTRY
    NO DOUBLY DEFINED                        000
    NO UNDEFINED SYMBOLS
    NO ASSEMBLY ERRORS
      NULLS                       RK8          RK9         RK10         RK11         RK12
                                 RK13         MWIN        RATHL        RATHG        RATLG
                                MWOIL           FF         TIME            P           CH
                                   CL           NP          .10         .981         .350
                                 .100         .200         .106         .108         .155
                                 .206         .306         .980          .40
```

```
      SUBROUTINE GAUSS6
      COMMON/FUXY/ BETA1,BETA2,BETA3,BETA4,NREACT,RK8,RK9,RK10,RK11,RK12
     1,RK13,RK(50),MWOILL(100),MWOILH(100),MWIN(100),Z(10),RATHL(100),
     2RATHG(100),RATLG(100),R(100,20),RR(100,20),MWOIL(100)
      COMMON/GAUSS6/FF(100,20),F(100,20),TIME(12),TIM(12),GOGTO(100)
      COMMON/CONVERT/LBAR(100),GBAR(100),CBAR(100),PP(100,20),P(100,20)
     1,YY(20,10),YBAR(1,20),S(20),CH(100),CL(100)
      COMMON/SEARCH/NDATA,J,N,OBJ1,OBJ2,OBJCOM,NRATE,D9B,STEP,N1,N2,NP
      TYPE REAL MWOILL,MWOILH,MWOIL,MWIN,LBAR
C     RK(8)=BETA
C     RK(9)=GAMMA
      PHI(XXX)=1.0/(1.0+RK(8)*XXX**RK(9))
     1*1.0/(1.0+(RK(27)*GMSN2              *XXX)**2.0)
      GMSN2=FF(J,14)*  R(J,3)*GOGTO(J)
      C1=0.4662348
      C2=0.3306047
      C3=0.1193096
      TC=R(J,4)
  100 A=0.5*(TC)
      B=TC
  300 TIME(1)=A-C1*B
      TIME(2)=A-C2*B
      TIME(3)=A-C3*B
      TIME(4)=A+C3*B
      TIME(5)=A+C2*B
      TIME(6)=A+C1*B
      DO 400 K=1,6
      TIM(K)=PHI(TIME(7-K))/RR(J,3)
      TIM(K)=PHI(TIME(7-K))*R(J,8)/(R(J,3)*0.082*R(J,7))
  400 CONTINUE
      RETURN
      END
```

*******

```
SUBROUTINE      GAUSS6
                                IDENT     GAUSS6
RANGE                FWA  -  LWA+1
                    32555     32713
ENTRY POINTS
                    32601    GAUSS6
EXTERNAL SYMBOLS
                    00001  02007111
                    00002  08QENTRY
     NO DOUBLY DEFINED                          443
     NO UNDEFINED SYMBOLS
     NO ASSEMBLY ERRORS
       NULLS
                          BETA1        BETA2        BETA3        BETA4        NREACT
                            RK8          RK9         RK10         RK11         RK12
                           RK13       MWOILL       MWOILH         MWIN            Z
                          RATHL       RATHG        RATLG        MWOIL            F
                           LBAR        GBAR         CBAR           PP            P
                             YY        YBAR            S           CH           CL
                          NDATA           N         OBJ1         OBJ2       OBJCOM
                          NRATE         D98         STEP           N1           N2
                             NP        .100         .300         .400
```

```
      SUBROUTINE CONVERT
      COMMON/FOXY/ BETA1,BETA2,BETA3,BETA4,NREACT,RK8,RK9,RK10,RK11,RK12
     1,RK13,RK(50),MWOILL(100),MWOILH(100),MWIN(100),Z(10),RATHL(100),
     2RATHG(100),RATLG(100),R(100,20),RR(100,20),MWOIL(100)
      COMMON/GAUSS6/FF(100,20),F(100,20),TIME(12),TIM(12),GOGTO(100)
      COMMON/CONVERT/LBAR(100),GBAR(100),CPAR(100),PP(100,20),P(100,20)
     1,YY(20,10),YBAR(1,20),S(50),CH(100),CL(100)
      COMMON/SEARCH/NDATA,J,N,OBJ1,OBJ2,OBJCOM,NRATE,D98,STEP,N1,N2,NP
      TYPE REAL MWOILL,MWOILH,MWOIL,MWIN,LBAR
C  CONVERT TO A TOTAL FEED BASIS
C
      DO 1 J=1,NDATA
      RATHL(J)=FF(J,12)/FF(J,11)
      RATHG(J)=FF(J,12)/100.
      RATLG(J)=FF(J,11)/100.
      MWOILH(J)=FF(J,12)
      MWOILL(J)=FF(J,11)
      MWOIL(J)=100.                                                    ********
      MWOIL(J)=100./((100.-FF(J,6))/FF(J,11)+FF(J,6)/FF(J,12))
      GH20 = (RR(J,6)/(100.-RR(J,6)))*(1.0*(PR(J,5)/(100.-RR(J,5))))/
     1        (1.0-((RR(J,6)/(100.-RR(J,6)))*(RR(J,5)/(100.-RR(J-5)))
     2        *28./18.))
      GN2      =RR(J,5)*((28./MWOIL(J))+((28.*GH20/18.)))/(100.-RR(J,5))
      GOGTO(J)=1.0                                                     ********
      GOGTO(J)=1.0/(1.0+GH20+GN2)
      MWIN(J)=0.0                                                      ********
      MWIN(J)=(GH20+GN2)/(GH20/18.+GN2/28.)
C
C  CONVERSION TO MOLES PER GRAM FOR HEAVY AND LIGHT FEED
      CH(J)=FF(J,6)/1000000.                                           ********
      CH(J)=FF(J,6)*GOGTO(J)/(FF(J,12)*10000.)
      CL(J)=(100.-FF(J,6))/1000000.                                    ********
      CL(J)=(100.-FF(J,6))*GOGTO(J)/(FF(J,11)*10000.)
      F(J,2)= FF(J,2)*CH(J)                                            PH
      F(J,3)= FF(J,3)*CL(J)                                            PL
      F(J,4)= FF(J,4)*CH(J)                                            NH
      F(J,5)= FF(J ,5)*CL(J)                                           NL
      F(J,15)=(100.-FF(J,2)-FF(J,4))*CH(J)                             AH
      F(J,16)=(100.-FF(J,3)-FF(J,5))*CL(J)                             AL
      F(J,17)=(100.-FF(J,7)-FF(J,8))*CH(J)                             CAH
      F(J,18)=(100.-FF(J,9)-FF(J,10))*CL(J)                            CAL
      F(J,15)=F(J,15)-F(J,17)                                          AH-CAH
      F(J,16)=F(J,16)-F(J,18)                                          AL-CAL
C     IF BASIC NITROGEN IS LESS THAN 0.04 PERCENT NEGLECT N POISONING
      IF(FF(J,14).LT.0.05) 998,999
  998 FF(J,14)=0.00
  999 CONTINUE
C
C
C  CONVERSION OF REACTOR VARIABLES
C
      R(J,3) =RR(J,3)/GOGTO(J)                                         SWH
      R(J,4) =RR(J,4)/60.                                              TC
      R(J,5) =GN2*GOGTO(J)/28.                                         N2
      R(J,6) =GH20*GOGTO(J)/18.                                        H20
      R(J,7) =(RR(J,7)+460.)*5./9.                                     TEMP
      R(J,8) =(RR(J,8)+14.7)/14.7                                      PRESS
    1 CONTINUE
      RETURN
      END
```

```
SUBROUTINE      CONVERT
                                IDENT     CONVERT
RANGE              FWA   -   LWA+1
                  32555      32755
ENTRY POINTS
                  32555    CONVERT
EXTERNAL SYMBOLS
                  00001   QBQENTRY
     NO DOUBLY DEFINED                          463
     NO UNDEFINED SYMBOLS
     NO ASSEMBLY ERRORS
     NULLS                      BETA1        BETA2        BETA3        BETA4       NREACT
                                 RK8          RK9         RK10         RK11         RK12
                                RK13           RK            Z         TIME          TIM
                                LBAR         GBAR         CBAR           PP            P
                                  YY         YBAR            S            N         OBJ1
                                OBJ2       OBJCOM        NRATE          D98         STEP
                                  N1           N2           NP         .998           .1
```

```
      SUBROUTINE FOXY(X,Y,DY,NUMYS)
      COMMON/FOXY/ BETA1,BETA2,BETA3,BETA4,NREACT,RK8,RK9,RK10,RK11,RK12
     1,RK13,RK(50),MWOILL(100),MWOILH(100),MWIN(100),Z(10),RATHL(100),
     2RATHG(100),RATLG(100),R(100,20),RR(100,20),MWOIL(100)
      COMMON/GAUSS6/FF(100,20),F(100,20),TIME(12),TIM(12),GOGTO(100)
      COMMON/CONVERT/LBAR(100),GBAR(100),GBAR(100),PP(100,20),P(100,20)
     1,YY(20,10),YBAR(1,20),S(50),CH(100),CL(100)
      COMMON/SEARCH/NDATA,J,N,OBJ1,OBJ2,OBJCOM,NRATE,D98,STEP,N1,N2,NP
      TYPE REAL MWOILL,MWOILH,MWOIL,MWIN,LBAR
      DIMENSION DY(50),Y(50)
C  FOR SIMPLE P,N,A LUMPING
      Z(5)=(1.0-((Y(1)+Y(2)+Y(3)+Y(9))*MWOILL(J)+(Y(5)+Y(6)+Y(7)+Y(8))*  C LUMP
     1 MWOILH(J)+Y(4)*100.0+Z(6)*MWIN(J)))/40.0
      EANMW=1.0                                                        ********
      EANMW=1.0/(Y(1)+Y(2)+Y(3)+Y(4)+Y(5)+Y(6)+Y(7)+ Y(8)+Y(9)+0.75*Z(5)
     1+Z(6))*1.0/(1.0+RK(34)*(Y(8)*MWOILH(J)))
      IF(NREACT.EQ.2) 2,1
    2 EANMW=EANMW/(1.+RK(8)*(X*R(J,4))**RK(9))*R(J,8)/(R(J,3)*0.082*
     1R(J,7))
    1 CONTINUE
      DY(5)=-EANMW*(RK(10)*BETA4+RK(13)*BETA1+RK(14)*BETA2+RK(21)*BETA4)
     1*Y(5)
      DY(6)=-EANMW*(RK(11)*BETA4+RK(15)*BETA1+RK(16)*BETA2 )*Y(6)
      DY(7)=-EANMW*(RK(12)*BETA4+RK(17)*BETA1+RK(18)*BETA2 )*Y(7)
      DY(8)=-EANMW*(RK(20)*BETA4+RK(19)*BETA2)*Y(8)                    CAH
      DY(9)= EANMW*(RK(20)*BETA4*Y(8)*RATHL(J)+RK(21)*BETA4*Y(5)*RATHL(J  CAL
     1)-RK(22)*BETA2*Y(9))
      DY(1)= EANMW*(RK(10)*BETA4*Y(5)*RATHL(J)-(RK(1)*BETA1+RK(2)*BETA2
     1 )*Y(1))
      DY(2)= EANMW*(RK(11)*BETA4*Y(6)*RATHL(J)-(RK(3)*BETA1+RK(4)*BETA2
     1 )*Y(2))
      DY(3)= EANMW*(RK(12)*BETA4*Y(7)*RATHL(J)-(RK(5)*BETA1+RK(6)*BETA2
     1 )*Y(3))
      DY(4)= EANMW*((RK(13)*BETA1*Y(5)+RK(15)*BETA1*Y(6)+RK(17)*BETA1*
     1 Y(7))*RATHG(J)+(RK(1)*BETA1*Y(1)+RK(3)*BETA1 *Y(2)+RK(5)*BETA1 *
     2 Y(3))*RATLG(J)-RK(7)*BETA3*Y(4))
      RETURN
      END
```

```
SUBROUTINE      FOXY

                                IDENT     FOXY
RANGE                FWA   -   LWA+1
                    32555      33027
ENTRY POINTS
                    32555      FOXY
EXTERNAL SYMBOLS
                    00001   02007111
                    00002   080ENTRY
     NO DOUBLY DEFINED                                  777
     NO UNDEFINED SYMBOLS
     NO ASSEMBLY ERRORS
     NULLS                        RK8        RK9       RK10       RK11       RK12
                                 RK13         RR      MWOIL         FF          F
                                 TIME        TIM      GOGTO       LBAR       GBAR
                                 CBAR         PP          P         YY       YBAR
                                    S         CH         CL      NDATA          N
                                 OBJ1       OBJ2     OBJCOM      NRATE        D9B
                                 STEP         N1         N2         NP     NUMYS
                                   .2
```

```
      SUBROUTINE OUTPUT
      COMMON/FOXY/ BETA1,BETA2,BETA3,BETA4,NREACT,RK8,RK9,RK10,RK11,RK12
     1,RK13,RK(50),MWOILL(100),MWOILH(100),MWIN(100),Z(100),RATHL(100),
     2RATHG(100),RATLG(100),R(100,20),RR(100,20),MWOIL(100)
      COMMON/GAUSS6/FF(100,20),F(100,20),TIME(12),TIM(12),GOGTO(100)
      COMMON/CONVERT/LBAR(100),GBAR(100),CBAR(100),PP(100,20),P(100,20)
     1,YY(20,10),YBAR(1,20),S(50),CH(100),CL(100)
      COMMON/SEARCH/NDATA,J,N,OBJ1,OBJ2,OBJCOM,NRATE,D98,STEP,N1,N2,NP
      TYPE REAL MWOILL,MWOILH,MWOIL,MWIN,LBAR
      DIMENSION COEF(11,8),CLIGHT(11),RNAME(11)
      DIMENSION TEMPG(12)
      DATA((TEMPG(J), J=1,11)= 0.000,0.00,-0.325, 0.600,-0.34,-0.325,
     1 1.00,0.00,0.00, 2.15,0.00)
      DATA ((COEF(1,J), J=1,8)=
     1-0.05515, 0.3270,0.0938,0.1350,0.2057,0.0530,0.0743,0.1514          ) C10H22
      DATA ((COEF(2,J), J=1,8)=
     2-0.02346, 0.2060,0.1447,0.2911,0.1961,0.0598,0.2776,0.2636          ) C2=
      DATA ((COEF(3,J), J=1,8)=
     3-0.16730, 1.0780,0.0679,0.2296,0.0913,0.1360,0.2655,0.1153          ) C3
      DATA ((COEF(4,J), J=1,8)=
     4 0.25400, 0.3564,0.2424,0.0846,0.1523,0.1818,0.0822,0.1489          ) C3=.
      DATA ((COEF(5,J), J=1,8)=
     5-0.03580, 0.3620,0.2909,0.3020,0.0935,0.2575,0.3804,0.2715          ) NC4
      DATA ((COEF(6,J), J=1,8)=
     6 0.00353, 1.3950,0.1551,0.3043,0.0901,0.2392,0.3271,0.1438          ) IC4
      DATA ((COEF(7,J), J=1,8)=
     7 0.12880,-0.0062,0.7972,0.3455,0.5723,0.5450,0.2469,0.5333          ) C4=
      DATA ((COEF(8,J), J=1,8)=
     8 0.05667,-0.0028,0.1747,0.1515,0.1590,0.2940,0.0687,0.2832          ) NC5
      DATA ((COEF(9,J), J=1,8)=
     9 0.18030,-0.0024,0.6919,0.7170,0.4393,0.8396,0.5500,0.7205          ) IC5
      DATA ((COEF(10,J), J=1,8)=
     A 0.08959,-0.0668,1.1540,0.0802,0.7801,0.1975,0.0515,0.7288          ) C5=
      DATA ((COEF(11,J), J=1,8)=
     1-0.06019, 0.3650,0.2812,0.4102,1.5260,0.6380,0.1906,0.9007          ) COKE
      DATA ((RNAME(L), L=1,10)=4HC2  ,4HC2= ,4HC3  ,4HC3= ,4HNC4 ,
     14HIC4 ,4HC4= ,4HNC5 ,4HIC5 ,4HC5=     )
      DO 1000  J=1,NDATA
      PRINT 5
    5 FORMAT(33H1 * FCC-OPERATING CONDITIONS *      ,//)
C *** LIGHT END AND COKE CORRELATION  ***
      AL=100.0-FF(J,3)-FF(J,5)
      AH=100.0-FF(J,2)-FF(J,4)
      ALR=(100.0-FF(J,6))/100.0
      AHR=FF(J,6)/100.0
      DO 9   L=1,11
      CLIGHT(L)=(COEF(L,1)*GBAR(J)+COEF(L,2)*CBAR(J))*((FF(J,2)*COEF(L,3
     1)+FF(J,4)*COEF(L,4)+AH*COEF(L,5))*AHR+(COEF(L,6)*FF(J,3)+COEF(L,7)
     2*FF(J,5)+COEF(L,8)*AL)*ALR)/100.0
C     TEMP CORRECTION FOR LIGHT ENDS
      CLIGHT(L)=CLIGHT(L)*(1.0+TEMPG(L)*(RR(J,7)-900.0)*0.01)
    9 CONTINUE
C *** CARBON ON CATALYST  C=A*TC**N    ***
      A  =(0.5200*FF(J,2)+.344*FF(J,4)+1.290*AH)*AHR+(0.5200*FF(J,3)+
     10.1660*FF(J,5)+0.8076*AL)*ALR
      CARB=A/100.0*(RR(J,4)/5.0)**0.1964
      ECC=3700.0
      TTERM=1.0/R(J,7)-1.0/755.2
      CARB=CARB*EXP(-ECC*TTERM/1.987)
      CARB1=PP(J,15)*RR(J,3)*RR(J,4)/(60.0*1.15)
      COKE=CARB*60.0*1.15/(RR(J,3)*RR(J,4))
      PRINT 10, PP(J,1)
   10 FORMAT(14H CHARGE STOCK  ,A7,/)
      IF(RR(J,2).GT.1.0) 13,11
   11 PRINT 12
   12 FORMAT(47H REACTOR TYPE-FLUIDISED DENSE BED OR FIXED BED      ,/)
      GO TO 18
   13 CONTINUE
      IF(RR(J,2).GT.2.0) 16,14
   14 PRINT 15
   15 FORMAT(35H REACTOR TYPE-LABORATORY RISER        ,/)
      GO TO 18
   16 PRINT 17
   17 FORMAT(38H REACTOR TYPE-PILOT PLANT DENSE BED      ,/)
```

```
18 CONTINUE
   PRINT 20, RR(J,3)
20 FORMAT(35H WT OIL/HR/WT CATALYST                    ,F8.3 )
   PRINT 21, R(J,3)
21 FORMAT(35H TRUE WHSV-WT FEED/HR/WT CATALYST         ,F8.3 )
   PRINT 22, RR(J,4)
22 FORMAT(35H CATALYST RESIDENCE TIME MINUTES          ,F8.3 )
   PRINT 23, RR(J,5)
23 FORMAT(35H NITROGEN-MOLE PCT                        ,F8.3 )
   PRINT 24, RR(J,6)
24 FORMAT(35H STEAM-WT PCT                             ,F8.3 )
   PRINT 25, RR(J,7)
25 FORMAT(35H REACTOR TEMPERATURE-DEG F                ,F8.3 )
   PRINT 26, RR(J,8)
26 FORMAT(35H REACTOR PRESSURE-PSIG                    ,F8.3 )
   PRINT 27, RR(J,9)
27 FORMAT(35H CARBON ON REGEN CATALYST-WT PCT          ,F8.3 )
   PRINT 30
30 FORMAT(///,51H * YIELDS *                        OBSERVED   PREDICTED )
   PRINT 31
31 FORMAT(     48H                                   WT PCT     WT PCT ,/)
   PRINT 35, PP(J,5),CLIGHT(1)
35 FORMAT(30H C1                                  ,1X,F7.3,5X,F7.3)
   DO 36 L=1,10
36 PRINT 37, RNAME(L),PP(J,L+4),CLIGHT(L)
37 FORMAT(1X,A7,23X,F7.3,5X,F7.3)
   PRINT 38, PP(J,3),CBAR(J)
38 FORMAT(30H C LUMP (C4- + COKE)                 ,1X,F7.3,5X,F7.3)
   PRINT 39, PP(J,2),GBAR(J)
39 FORMAT(30H G LUMP (C5 -430 DEG F)              ,1X,F7.3,5X,F7.3)
   PRINT 40, PP(J,4),LBAR(J)
40 FORMAT(30H LFO     (430-650 DEG F)             ,1X,F7.3,5X,F7.3)
   HFOO=100.0-PP(J,3)-PP(J,2)-PP(J,4)
   HFOP=100.0-CHAR(J)-GBAR(J)-LBAR(J)
   PRINT 41, HFOO,HFOP
41 FORMAT(30H HFO     (650+ )                     ,1X,F7.3,5X,F7.3)
   PRINT 45, CARB1,CARB
45 FORMAT(30H CARB ON CAT-WT PCT-VOORHEES           ,1X,F7.3,5X,F7.3)
   PRINT 46,       PP(J,15),COKE
46 FORMAT(30H COKE WT PCT-VOORHEES                  ,1X,F7.3,5X,F7.3)
   PRINT 47,               PP(J,15),CLIGHT(11)
47 FORMAT(30H COKE WT PCT-CORRELATION               ,1X,F7.3,5X,F7.3)
1000 CONTINUE
   RETURN
   END
```

```
                                    IDENT     OUTPUT
RANGE                 FWA   -   LWA+1
                     32555      33625
ENTRY POINTS
                     33203     OUTPUT
EXTERNAL SYMBOLS
                     00001   02007111
                     00002        EXP
                     00003   08QINGOT
                     00004   08QENGOT
                     00005   08QGOTTY
                     00006   06QENTRY
     NO DOUBLY DEFINED                                  000
     NO UNDEFINED SYMBOLS
     NO ASSEMBLY ERRORS
        NULLS
                                  BETA1        BETA2        BETA3        BETA4       NREACT
                                   RK8          RK9         RK10         RK11         RK12
                                  RK13           RK        MWOILL       MWOILH         MWIN
                                     Z       RATHL        RATHG        RATLG        MWOIL
                                     F        TIME          TIM        GOGTO            P
                                    YY        YBAR            S           CH           CL
                                     N        OBJ1         OBJ2       OBJCOM        NRATE
                                   D9B        STEP           N1           N2           NP
                                    .9         .36        .1000
```

```
      SUBROUTINE PLOTTING
      COMMON/FOXY/ BETA1,BETA2,BETA3,BETA4,NREACT,RK8,RK9,RK10,RK11,RK12
     1,RK13,RK(50),MWOILL(100),MWOILH(100),MWIN(100),Z(10),RATHL(100),
     2RATHG(100),RATLG(100),R(100,20),RR(100,20),MWOIL(100)
      COMMON/GAUSS6/FF(100,20),F(100,20),TIME(12),TIM(12),GOGTO(100)
      COMMON/CONVERT/LBAR(100),GBAR(100),CBAR(100),PP(100,20),P(100,20)
     1,YY(20,10),YBAR(1,20),S(50),CH(100),CL(100)
      COMMON/SEARCH/NDATA,J,N,OBJ1,OBJ2,OBJCOM,NRATE,D9B,STEP,N1,N2,KP
      TYPE REAL MWOILL,MWOILH,MWOIL,MWIN,LBAR
      DIMENSION U(2),V(2),CBUR(100),GBUR(100),LBUR(100),IBUF(1000)
     1,RTEMP(100),RX(100),RS(100),OGO(100),RZ(100),OP2(1),OP3(1),OP4(1),
     1RRR(1)
      TYPE REAL LBUR
      CALL PLOTS(IBUF,1000,28)
      CALL LIMITS(11.)
      PRINT 306
306   FORMAT(40H1 PLOTTING IN PROGRESS                                  )
307   N1=1
      N2=NDATA
      DO 303  I=1,NDATA
      GBUR(I)=PP(I,2)
      CBUR(I)=PP(I,3)
      LBUR(I)=PP(I,4)
303   CONTINUE
      DXN=10.
      DYN=10.
      SY=5.
      SX=5.
      XO=10.
      YO=10.
      CALL AXIS(0.,0.,11H Y COMPUTED,-11,SX,0.,XO,DXN)
      CALL AXIS(0.,0.,11H Y OBSERVED,11,SY,90.,YO,DYN)
      U(1)=10.
      V(1)=10.
      U(2)=60.
      V(2)=60.
      CALL LINE(U,V,2,1,0,1, XO,DXN,YO,DYN)
      CALL LINE(LBUR, LBAR  ,NDATA,1,-1,4,XO,DXN,YO,DYN)
      CALL SYMBOL(.75,5.5,.14,29H FLUIDIZED DENSE BED CRACKING,0.,29 )
      CALL SYMBOL(.75,5.0,.14,29H LFO (430 - 650 F)          ,0.,29)
      CALL NXIPLT(SX)
      XO=5.
      YO=5.
      SY=5.
      SX=5.
      DXN=5.
      DYN=5.
      CALL AXIS(0.,0.,11H Y COMPUTED,-11,SX,0.,XO,DXN)
      CALL AXIS(0.,0.,11H Y OBSERVED,11,SY,90.,YO,DYN)
      U(1)=5.
      V(1)=5.
      V(2)=30.
      U(2)=30.
      CALL LINE(U,V,2,1,0,1, XO,DXN,YO,DYN)
      CALL LINE(GBUR, GBAR  ,NDATA,1,-1,4,XO,DXN,YO,DYN)
      CALL SYMBOL(.75,5.5,.14,29H FLUIDIZED DENSE BED CRACKING,0.,29)
      CALL SYMBOL(.75,5.0,.14,29H C LUMP (C1 -C4 + COKE)       ,0.,29 )
      CALL NXIPLT(SX)
      XO=20.
      YO=20.
      SX=5.
      SY=5.
      DXN=10.
      DYN=10.
      CALL AXIS(0.,0.,11H Y COMPUTED,-11,SX,0.,XO,DXN)
      U(1)=20.
      V(1)=20.
      U(2)=70.
      V(2)=70.
      CALL AXIS(0.,0.,11H Y OBSERVED,11,SY,90.,YO,DYN)
      CALL LINE(U,V,2,1,0,1,XO,DXN,YO,DYN)
      CALL LINE(CBUR, CBAR  ,NDATA,1,-1,4,XO,DXN,YO,DYN)
      CALL SYMBOL(.75,5.5,.14,29H FLUIDIZED DENSE BED CRACKING,0.,29)
```

```
      CALL SYMBOL(.75,5.0,.14,29H G LUMP (C5 - 430 F)          ,0.,29)
      CALL NXTPLT(SX)
      MAM=N
      DO 117 J=1,NDATA
      RTEMP(J)=R(J,3)
C        RX OBSERVED C+G
C        RS CALCULATED C+G
      RX(J)=PP(J,2)+PP(J,3)
  117 CONTINUE
      DELSV=1
      NPOINT=39
      M=39
      DO 111 K=1,NP
      N=MAM
      NPART=3
      N1=K
      N2=K
      SINNN=.01
      SINNN=.09
      DO 159 J1=1,NPOINT
      IF(J1.LE.10) 501,503
  501 DELSV=.5
      GO TO 505
  503 DELSV=1.3
      DELSV=1.1
  505 CONTINUE
      R(K ,3)=SINNN
      CALL REACTR
      QQQ(J1)=R(K,3)*GOGTO(K)
      CBUR(J1)=CBAR(K)
      LBUR(J1)=LBAR(K)
      GBUR(J1)=GBAR(K)
      SINNN=SINNN+DELSV
  159 CONTINUE
      M=39
      DO 131 I=1,M
      RS(I)=GBUR(I)+CBUR(I)
  131 CONTINUE
      QP2(1)=PP(K,2)
      QP3(1)=PP(K,3)
      QP4(1)=PP(K,4)
      RRR(1)=RR(K,3)
      N=39
      XO=0.
      YO=0.
      DXN=4.
      DYN=10.
      SX=12.5
      SY=10.
      SX=8.
      SY=5.
      DXN=5.
      DYN=20.
      CALL AXIS(0.,0.,20HYIELD WT. PERCENT    ,20,SY, 90.,YO,DYN)
      CALL AXIS(0.,0.,39HSPACE VELOCITY(WT OIL/WT CATALYST - HR),-39,SX,
     10., XO,DXN)
      CALL LINE( QQQ    ,LBUR,M,1,0.5,XO,DXN,YO,DYN)
      CALL LINE( QQQ    ,GBUR,M,1,0.4,XO,DXN,YO,DYN)
      CALL LINE( QQQ    ,CBUR,M,1,0.11,XO,DXN,YO,DYN)
      CALL LINE(RRR      ,QP2     , 1,1,-1,4,XO,DXN,YO,DYN)
      CALL LINE(RRR      ,QP3     , 1,1,-1,11,XO,DXN,YO,DYN)
      CALL LINE(RRR      ,QP4     , 1,1,-1,5,XO,DXN,YO,DYN)
      J=K
      CALL SYMBOL(1.,6.,.14,23HFLUID CATALYST CRACKING, 0.0,23)
      CALL SYMBOL(1.,5.5,.14,23HREACTOR TYPE            ,0.0,23)
      CALL SYMBOL(5.,6.,.14,PP(J,1),0.0,7)
      IF (RR(J,2)-2.)171,173,175
  171 CALL SYMBOL(3.0,5.5,.14,32HFLUIDIZED DENSE BED              ,0.,32)
      GO TO 179
  173 CALL SYMBOL(3.0,5.5,.14,31HLABORATORY RISER                 ,0.0,31)
      GO TO 179
  175 CALL SYMBOL(3.0,5.5,.14,31HPILOT PLANT                      ,0.0,31)
  179 CONTINUE
```

```
      CALL SYMBOL(.5,5.0,.14,5,0.0,-1)
      CALL SYMBOL(1.0,5.0,.14,18HL.F.O. (430-650 F),0.,18)
      CALL SYMBOL(4.5,5.0,.14,39HTC                    MIN
     1,0.,39)
      TC=RR(J,4)
      CALL NUMBER(6.0,5.,.14,TC      ,0.0,3)
      CALL SYMBOL(.5,4.5,.14,4,0.0,-1)
      CALL SYMBOL(1.0,4.5,.14,23HC5 GASOLINE (C5+ - 430),0.,23)
      CALL SYMBOL(4.5,4.5,.14,39HTEMP                  F
     1,0.,39)
      CALL NUMBER(6.0,4.5,.14,RR(J,7),0.0,3)
      CALL SYMBOL(1.0,4.0,.14,18HC-LUMP  C1-C4+COKE,0.,18)
      CALL SYMBOL(.5,4.0,.14,11,0.0,-1)
      CALL SYMBOL(4.5,4.0,.14,39HNITROGEN              MOLE PCT
     1,0.,39)
      CALL NUMBER(6.0,4.,.14,RR(J,5),0.0,3)
      CALL SYMBOL(4.5,3.5,.14,39HSTEAM                 WT PCT
     1,0.,39)
      CALL NUMBER(6.0,3.5,.14,RR(J,6),0.0,3)
      CALL SYMBOL(4.5,3.0,.14,39HPRESS                 PSIG
     1,0.,39)
      CALL NUMBER(6.0,3.,.14,RR(J,8),0.0,3)
      CALL SYMBOL(4.5,2.5,.14,39HREGEN. CAT            LB C/LB CAT
     1,0.,39)
      CALL NUMBER(6.0,2.5,.14,RR(J,9),0.0,3  )
      SX=12.
705   CALL NXTPLT(SX)
      XO=0.
      YO=0.
      DXN=20.
      SX=5.
      SY=5.
      DYN=20.
      CALL AXIS(0.,0.,14HCONVERSION     ,-14,SX,0.,XO,DXN)
      CALL AXIS(0.,0.,20HYIELD WT. PERCENT    ,20,SY. 90.,YO,DYN)
      CALL LINE( RS     ,LBUR,M,1,0,5,XO,DXN,YO,DYN)
      CALL LINE( RS     ,GBUR,M,1,0,4,XO,DXN,YO,DYN)
      CALL LINE( RS     ,CBUR,M,1,0,11,XO,DXN,YO,DYN)
      RZ(1)=RX(K)
      CALL LINE( RZ,QP2      ,1,1,-1,4,XO,DXN,YO,DYN)
      CALL LINE( RZ,QP3      ,1,1,-1,11,XO,DXN,YO,DYN)
      CALL LINE( RZ,QP4      ,1,1,-1,5,XO,DXN,YO,DYN)
      CALL SYMBOL(1.,6.,.14,23HFLUID CATALYST CRACKING, 0.0,23)
      CALL SYMBOL(1.,5.5,.14,23HREACTOR TYPE          , 0.0,23)
      CALL SYMBOL(5.,6.,.14,PP(J,1),0.0,7)
      IF (RR(J,2)-2.)191,193,195
191   CALL SYMBOL(3.0,5.5,.14,32HFLUIDIZED DENSE BED          ,0.,32)
      GO TO 199
193   CALL SYMBOL(3.0,5.5,.14,31HLABORATORY RISER             ,0.0,31)
      GO TO 199
195   CALL SYMBOL(3.0,5.5,.14,31HPILOT PLANT                  ,0.0,31)
199   CONTINUE
      SX=6.
      CALL NXTPLT(SX)
111   CONTINUE
      CALL ENDPLT(SX)
      RETURN
      END
```

```
SUBROUTINE      PLOTTING

                                IDENT     PLOTTING
RANGE                FWA  -  LWA+1
                    32555     37442
ENTRY POINTS
                    36401  PLOTTING
EXTERNAL SYMBOLS
                    00001     PLOTS
                    00002    LIMITS
                    00003      AXIS
                    00004      LINE
                    00005    SYMBOL
                    00006    NXTPLT
                    00007    REACTR
                    00010    NUMBER
                    00011    ENDPLT
                    00012  Q80INGOT
                    00013  Q80ENGOT
                    00014  Q80GOTTY
                    00015  Q80ENTRY
      NO DOUBLY DEFINED                          000
      NO UNDEFINED SYMBOLS
      NO ASSEMBLY ERRORS
         NULLS                     BETA1       BETA2       BETA3       BETA4      NREACT
                                    RK8         RK9        RK10        RK11       RK12
                                   RK13          RK       MWOILL      MWOILH       MWIN
                                      Z       RATHL       RATHG       RATLG      MWOIL
                                     FF           F        TIME         TIM          P
                                     YY        YBAR           S          CH         CL
                                   OBJ1        OBJ2      OBJCOM       NRATE        D9B
                                   STEP        .307        .303        .117       .159
                                   .131        .705        .111    Q80GOTTY

            END
                                   END
EXECUTE.
```

PROGRAM NAMES

| | | |
|---|---|---|
| 00000 RESIDENT | 02113 ERRDUMP* | 02746 XITDUMP* |
| 41470 MAIN | 41347 Q1QRESNT | 41021 Q1OSTORE |
| 40712 MEMLEFT | 40706 ABSF | 40651 SQRTF |
| 40646 Q80PAUSE | 37471 Q80GINTY | 36333 Q80GOTTY |
| 36163 Q80ENTRY | 36146 MEM | 36134 Q80LOADA |
| 36062 Q80IBJOB | 35575 Q80FORMS | 02043 REACTR |
| 34300 POWRF | 34435 EXPF | 31127 DEXTRA |
| 31057 MAX1F | 31045 Q20LOADA | 31036 FLOATF |
| 31015 XFIXF | 76102 GAUSS6 | 75702 CONVERT |
| 75430 FOXY | 74360 OUTPUT | 67473 PLOTTING |
| 21365 PLOT470 | 21032 AXIS | 20615 LINE |
| 20677 SYMBOL | 17643 NUMBER | 17615 INTF |
| 17517 Q80TAPES | 17332 Q80BUFFS | 17131 SINF |
| 17043 LOGF | 17003 XTOI | |

LABELED COMMON

| | | |
|---|---|---|
| 63002 FOXY | 52746 GAUSS6 | 41504 CONVERT |
| 41470 SEARCH | | |

NUMBERED COMMON NONE

PROGRAM ENTRY POINTS

```
01263 READ*
01216 REMOVE*
02077 CHKSTD*
03147 RELOAD*
02737 EXIT*
00463 BCDBN*
02361 RECLIM*
02051 CBF*
02060 CBF7*
05516 LOK1*
02061 FCH*
00100 DATE*
74317 MAIN
41357 03000140
41434 03001040
41367 03002140
41442 03003040
41407 03004140
41454 03005040
41216 01010200
41171 01010010
41151 01010310
41115 01010120
41105 01010420
41061 01010230
41021 03010040
41021 03010340
41251 070LODRC
41277 070LODLC
41244 070FLOAT
41264 070LDDC3
```

```
01270 WRITE*
01025 DETECT*
03175 LOADER*
03063 LIBREW*
02106 ERROR*
00371 OPCOM*
00606 FLAGTST*
02052 CBF1*
00776 IOSLECT*
05114 LMSRCH*
01112 EXSEN*
00063 SIEOF*
41351 01000100
41362 03001140
41363 01002100
41377 03003140
41403 01004100
41420 03005140
41201 01010000
41210 01010300
41151 01010110
41152 01010410
41125 01010220
41042 01010030
41075 01010330
41021 03010140
41021 03010440
41261 070LODDC
41314 070LODID
41241 070LDIC2
41273 070LDDC3
```

```
00737 SELECT*
02072 GETCH*
03176 RELOCOM*
03002 CLBNBCD*
01252 MODIRET*
02340 RECREF*
00253 MEMREC*
02053 CBF2*
01577 MRW600*
01177 ILMF*
00223 SETCLK*
03055 LIBPSIT*
41354 01001100
41430 03000040
41373 01003100
41435 03002040
41413 01005100
41447 03004040
41210 01010100
41202 01010400
41160 01010210
41135 01010020
41115 01010320
41052 01010130
41105 01010430
41021 03010240
41237 070LODIC
41270 070LODCC
41323 070LODRD
41253 070LDRC2
41303 070LDLC4
```

| | | | | | |
|---|---|---|---|---|---|
| 41316 | Q7QLDID2 | 41325 | Q7QLDRD2 | 40743 | MEMLEFT |
| 30460 | CONVERT | 35011 | REACTR | 40707 | ABSF |
| 40706 | ABS | 40706 | Q8QABSF | 40706 | Q8QXABSF |
| 40707 | XABSF | 40706 | IABS | 40652 | SQRTF |
| 40651 | SQRT | 40651 | Q8QSQRTF | 27564 | OUTPUT |
| 26075 | PLOTTING | 40647 | Q8QSTOPS | 40646 | Q8QPAUSE |
| 37471 | Q8QINGIN | 37555 | Q8QGINTY | 40330 | Q8QENGIN |
| 36333 | Q8QINGOT | 36410 | Q8QGOTTY | 37250 | Q8QENGOT |
| 36163 | Q8QENTRY | 36166 | Q8QEXITS | 36211 | Q8QLPSEN |
| 36212 | Q8QGNSET | 36215 | Q8QFTSEN | 36216 | Q8QFTSET |
| 36221 | Q8QIOSEN | 36222 | Q8QIOSET | 36225 | Q8QGNSEN |
| 36244 | Q8QLPSET | 36311 | Q8QGNTAB | 36322 | Q8QGTTAB |
| 36325 | Q8QBUTAB | 36146 | MEM | 36134 | Q8QLOADA |
| 36062 | Q8QIBJOB | 35575 | Q8QIFORM | 35615 | Q8QFORMS |
| 36010 | Q8QGLIST | 34502 | POWRF | 34501 | Q8QPOWRF |
| 34500 | Q2007111 | 34436 | EXPF | 34435 | EXP |
| 34435 | Q8QEXPF | 30704 | GAUSS6 | 33726 | DEXTRA |
| 31057 | MAX1F | 31057 | AMAX1 | 31057 | XMAX0F |
| 31057 | MAX0 | 31062 | MAX0F | 31062 | AMAX0 |
| 31066 | XMAX1F | 31066 | MAX1 | 31072 | MIN1F |
| 31072 | AMIN1 | 31072 | XMIN0F | 31072 | MIN0 |
| 31075 | MIN0F | 31075 | AMIN0 | 31101 | XMIN1F |
| 31101 | MIN1 | 31045 | Q2QLOADA | 31037 | FLOATF |
| 31036 | FLOAT | 31036 | Q8QFLOAT | 30206 | FOXY |
| 31017 | XFIXF | 31016 | IF'X | 31016 | Q8QXFIXF |
| 31017 | XINTF | 31016 | IN' | 31016 | Q8QXINTF |
| 21365 | PLOTS | 22046 | PLOT | 22043 | PLOTTT |
| 21446 | WHERE | 21427 | FACTOR | 22147 | LIMITS |
| 22165 | NXTPLT | 22206 | ENDPLT | 21032 | AXIS |
| 20415 | LINE | 20077 | SYMBOL | 17643 | NUMBER |
| [illegible] | INTF | 17615 | AINT | 17615 | Q8QINTF |
| 17566 | Q8QFILES | 17555 | Q8QREWND | 17520 | Q8QHACKS |
| 17332 | Q8QINBFI | 17335 | Q8QINBFO | 17461 | Q8QHUNCH |
| 17473 | LENGTHF | 17147 | Q8QSINF | 17131 | Q8QCOSF |
| 17150 | SINF | 17147 | SIN | 17132 | COSF |
| 17131 | COS | 17050 | LOGF | 17047 | ALOG |
| 17043 | LOG10F | 17047 | Q8QLOGF | 17005 | XTOI |
| 17003 | Q2007110 | 17004 | Q8QXTOI | | |

AVAILABLE MEMORY 2426 CELLS

| | G LUMP PRED | G LUMP OBS | C LUMP PRED | C LUMP OBS | LFO PRED | LFO OBS | AH | NH | PH | CH | AL | NL | PL | CL |
|---|---|---|---|---|---|---|---|---|---|---|---|---|---|---|
| *CMCGO | 46.70 | 46.97 | 15.88 | 15.13 | 24.58 | -0 | 1.17 | 2.36 | 2.98 | 6.33 | 2.75 | 3.91 | 7.39 | 10.54 |
| *CMCGO | 50.59 | 47.74 | 26.41 | 24.62 | 17.86 | -0 | .10 | .29 | .65 | 4.10 | 1.71 | 1.06 | 3.91 | 11.18 |
| *CMCGO | 43.52 | 43.16 | 12.51 | 11.84 | 27.02 | -0 | 1.97 | 3.69 | 4.17 | 7.12 | 3.08 | 5.16 | 8.60 | 10.17 |
| *CMCGO | 49.91 | 50.91 | 17.84 | 17.83 | 22.59 | -0 | .58 | 1.31 | 1.97 | 5.79 | 2.52 | 2.79 | 6.44 | 10.84 |
| *CMCGO | 29.56 | 29.50 | 11.01 | 10.24 | 29.67 | -0 | 5.82 | 9.04 | 7.37 | 7.53 | 3.07 | 7.76 | 9.62 | 9.23 |
| *CMCGO | 39.60 | 42.45 | 17.09 | 17.60 | 26.46 | -0 | 2.32 | 4.17 | 4.14 | 6.22 | 2.86 | 5.13 | 7.84 | 10.62 |
| *CMCGO | 44.75 | 46.54 | 23.98 | 20.56 | 22.37 | -0 | .64 | 1.49 | 1.95 | 4.81 | 2.33 | 2.89 | 5.89 | 11.26 |
| *CMCGO | 45.51 | 47.55 | 24.51 | 22.47 | 21.84 | -0 | .53 | 1.23 | 1.70 | 4.68 | 2.28 | 2.58 | 5.57 | 11.40 |
| *CMCGO | 28.12 | 28.76 | 8.96 | 8.26 | 30.93 | -0 | 6.27 | 9.76 | 7.97 | 7.99 | 3.24 | 8.39 | 10.29 | 9.01 |
| *CMCGO | 42.53 | 42.85 | 16.76 | 15.50 | 26.26 | -0 | 1.59 | 3.18 | 3.50 | 6.17 | 2.92 | 4.67 | 7.81 | 10.86 |
| T-4520 | 25.00 | 24.32 | 9.81 | 8.45 | 31.23 | -0 | 8.77 | 9.20 | 3.99 | 12.00 | 5.17 | 9.07 | 4.40 | 12.59 |
| T-4520 | 39.18 | 41.22 | 21.25 | 19.08 | 26.60 | -0 | 1.39 | 2.02 | 1.30 | 8.26 | 4.12 | 3.90 | 3.00 | 15.58 |
| T-4520 | 22.97 | 22.74 | 7.75 | 7.27 | 32.20 | -0 | 9.75 | 10.20 | 4.39 | 12.74 | 5.44 | 9.93 | 4.71 | 12.12 |
| T-4520 | 35.39 | 36.09 | 14.13 | 12.37 | 29.89 | -0 | 3.43 | 4.33 | 2.34 | 10.48 | 5.06 | 6.30 | 3.90 | 14.64 |
| T-4520 | 27.83 | 30.08 | 9.66 | 8.70 | 29.88 | -0 | 8.31 | 8.53 | 3.77 | 12.01 | 4.94 | 8.38 | 4.22 | 12.34 |
| T-4520 | 42.27 | 45.00 | 21.03 | 19.32 | 24.60 | -0 | 1.16 | 1.58 | 1.10 | 8.26 | 3.71 | 3.11 | 2.68 | 15.11 |
| T-4520 | 26.73 | 27.23 | 7.90 | 7.60 | 30.79 | -0 | 8.82 | 9.08 | 4.03 | 12.65 | 5.23 | 8.99 | 4.49 | 12.07 |
| T-4520 | 38.88 | 41.12 | 13.75 | 13.16 | 27.97 | -0 | 3.09 | 3.69 | 2.09 | 10.53 | 4.71 | 5.39 | 3.62 | 14.24 |

SE= 2.2628E 00 SE FOR TRIAL STEP= 2.2628E 00 PHI= 9.2168E 01 STEP SIZE= .1000

PARAMETERS

| | | | | | | | | | | |
|---|---|---|---|---|---|---|---|---|---|---|
| 1.8509E 01 | 3.6300E 00 | 6.6150E 01 | 8.1840E 00 | 2.3850E 01 | 9.4400E 00 | 4.4000E 00 | 1.6215E 02 | 7.6000E-01 | 1.9000E 01 |
| 2.2500E 01 | 2.0700E 01 | 6.3000E 01 | 2.1000E 01 | 8.4700E 01 | 1.4870E 01 | 5.5000E 01 | 7.8500E 00 | 1.4630E 01 | 5.8630E 00 |
| 5.0000E 01 | 1.0000E 00 | 1.0000E 00 | 1.0000E 00 | 1.0000E 00 | 1.0000E 00 | 6.4420E 01 | -0 | -0 | 1.0000E 00 |
| 6.6000E-01 | 6.6000E-01 | 1.1000E 00 | 1.2800E 01 | 1.4500E 04 | 1.7500E 04 | 5.5000E 03 | 8.5000E 03 | 8.1000E 03 | 2.0000E 04 |

| AVERAGE ERRORS | | | STANDARD ERRORS | | |
|---|---|---|---|---|---|
| G LUMP | C LUMP | LFO | G LUMP | C LUMP | LFO |
| [illegible] 00 | 1.18E 00 | 2.68E 01 | 1.75E 00 | 1.44E 00 | 2.71E 01 |

* FCC-OPERATING CONDITIONS *

CHARGE STOCK WCMCGO

REACTOR TYPE-FLUIDISED DENSE BED OR FIXED BED.

| | |
|---|---|
| WT OIL/HR/WT CATALYST | 4.750 |
| TRUE WHSV-WT FEED/HR/WT CATALYST | 4.802 |
| CATALYST RESIDENCE TIME MINUTES | 5.000 |
| NITROGEN-MOLE PCT | 10.000 |
| STEAM-WT PCT | -0 |
| REACTOR TEMPERATURE-DEG F | 906.000 |
| REACTOR PRESSURE-PSIG | -0 |
| CARBON ON REGEN CATALYST-WT. PCT | -0 |

| * YIELDS * | OBSERVED WT PCT | PREDICTED WT PCT |
|---|---|---|
| C1 | .370 | .345 |
| C2 | .370 | .345 |
| C2= | .420 | .456 |
| C3 | 1.360 | 1.371 |
| C3= | 2.630 | 2.625 |
| NC4 | .910 | .976 |
| IC4 | 4.320 | 4.467 |
| C4= | 3.000 | 3.169 |
| NC5 | .480 | .452 |
| IC5 | 4.660 | 5.261 |
| C5= | 1.650 | 1.772 |
| C LUMP (C4- + COKE) | 15.130 | 15.880 |
| G LUMP (C5 -430 DEG F) | 46.970 | 46.699 |
| LFO (430-650 DEG F) | -0 | 24.583 |
| HFO (650+ ) | 37.900 | 12.838 |
| CARB ON CAT-WT PCT-VOORHEES | .585 | .677 |
| COKE WT PCT-VOORHEES | 1.700 | 1.968 |
| COKE WT PCT-CORRELATION | 1.700 | 2.203 |

We claim:

1. In a catalytic cracking process comprising contacting hydrocarbon feed with hot cracking catalyst under operating conditions sufficient to crack said feed into a desirable product distribution, including hydrocarbon products of lower molecular weight, while depositing coke on said catalyst, separating said products from said coked catalyst, recovering said products, regenerating and heating said catalyst by burning coke therefrom, and contacting said regenerated, hot catalyst with hydrocarbon feed; the improvement which comprises:

A. Lumping said hydrocarbon feed both kinetically and according to boiling range into at least two lumps including (1) compounds with carbon atoms in aromatic rings and (2) compounds with carbon atoms in aromatic side chains associated with the aromatic rings;

B. simulating said cataytic cracking process based on invariant simultaneous and consecutive reactions of said lumped hydrocarbons under a selected set of operating conditions to determine a yield product distribution;

C. repeating step (B) at different simulated operating conditions until a predetermined desired yield product distribution and coke deposition on catalyst is determined; and D. operating said catalytic cracking process at the operating conditions selected to result in said desired yield.

2. The method of claim 1 wherein said reactants are lumped as:

$P_l$=Wt. % paraffinic molecules, (mass spec analysis), 430°-650° F.

$N_l$=Wt. % naphthenic molecules, (mass spec analysis), 430°-650° F.

$C_{Al}$=Wt. % carbon atoms among aromatic rings, (n-d-M method), 430°-650° F.

$A_l$=Wt. % aromatic substituent groups (430°-650° F.)

$P_h$=Wt. % paraffinic molecules, (mass spec analysis), 650° F.+

$N_h$=Wt. % naphthenic molecules, (mass spec analysis), 650° F.+

$C_{Ah}$=Wt. % carbon atoms among aromatic rings, n-d-M method, 650° F.+

$A_h$=Wt. % aromatic substituent groups (650° F.+) and wherein said product yields are lumped as:

G=G lump ($C_5$+ −430° F.)

C=C lump ($C_1$-$C_4$+coke).

3. The method of claim 1 wherein said operating conditions include the following reaction rate constants:

MATRIX OF RATE CONSTANTS $\underset{\approx}{K}$

| | $P_h$ | $N_h$ | $A_h$ | $C_{Ah}$ | $P_l$ | $N_l$ | $A_l$ | $C_{Al}$ | G | C |
|---|---|---|---|---|---|---|---|---|---|---|
| $P_h$ | $-(K_{phpl}+K_{phg}+K_{phc})$ | | | | | | | | | |
| $N_h$ | | $-(K_{nhnl}+K_{nhg}+K_{nhc})$ | | | | | | | | |
| $A_h$ | | | $-(K_{ahal}+K_{ahg}+K_{ahc}+K_{ahcal})$ | | | | | | | |
| $C_{Ar}$ | | | | $-(K_{cahcal}+K_{cahc})$ | | | | | | |
| $P_l$ | $V_{hl}K_{phpl}$ | | | | $-(K_{plg}+K_{plc})$ | | | | | |
| $N_l$ | | $V_{hl}K_{nhnl}$ | | | | $-(K_{nlg}+K_{nlc})$ | | | | |
| $A_l$ | | | $V_{hl}K_{ahal}$ | | | | $-(K_{alg}+K_{alc})$ | | | |
| $C_{Al}$ | | | $V_{hl}K_{ahcal}$ | $V_{hl}K_{cahcal}$ | | | | $-K_{calc}$ | | |
| G | $V_{hg}K_{phg}$ | $V_{hg}K_{nhg}$ | $V_{hg}K_{ahg}$ | o | $V_{lg}K_{plg}$ | $V_{lg}K_{nlg}$ | $V_{lg}K_{alg}$ | o | $-K_{gc}$ | |
| C | $V_{hc}K_{phc}$ | $V_{hc}K_{nhc}$ | $V_{hc}K_{ahc}$ | $V_{hc}K_{cahc}$ | $V_{lc}K_{plc}$ | $V_{lc}K_{nlc}$ | $V_{lc}K_{alc}$ | $V_{lc}K_{cala}$ | $V_{gc}K_{gc}$ | o |

where, $V_{hl}$ = Stoichiometric coefficient (Mol. Wt. of heavy fuel oil/Mol. Wt. of light fuel oil)

$V_{hg}$ = Stoichiometric coefficient (Mol. Wt. of heavy fuel oil/Mol. Wt. of gasoline)

$V_{hc}$ = Stoichiometric coefficient (Mol. Wt. of heavy fuel oil/Mol. Wt. of C lump)

$V_{lg}$ = Stoichiometric coefficient (Mol. Wt. of light fuel oil/Mol. Wt. of gasoline)

$V_{lc}$ = Stoichiometric coefficient (Mol. Wt. of light fuel oil/Mol. Wt. of C lump)

$V_{gc}$ = Stoichiometric coefficient (Mol. Wt. of gasoline/Mol. Wt. of C lump)

4. Apparatus for predicting the reaction product yields of a catalytic cracking process for the conversion of a stream of hydrocarbons wherein said stream is contacted with an active catalyst in a reactor maintained under catalytic cracking conditions to provide reaction products which are removed from said reactor, the catalyst in said reactor becoming contaminated by the deposition of coke thereon, said apparatus comprising:

means for lumping said hydrocarbons both kinetically and according to boiling range, two of the lumps of said hydrocarbons including: (1) the carbon atoms in aromatic rings and (2) aromatic side chains associated with the aromatic rings, means for simulating said catalytic cracking process based on invariant simultaneous and consecutive reactions of the lumped hydrocarbons, and means for producing an output representing the yield of said reactions based upon said model.

5. The combination of a cataytic cracker which converts a stream of hydrocarbons wherein said stream is contacted with an active catalyst in a reactor maintained under catalytic cracking conditions to provide reaction products which are removed from said reactor, the catalyst in said reactor being contaminated by the deposition of coke thereon, and automatic computing apparatus for predicting the reaction products of said catalytic cracker comprising:

means for lumping said hydrocarbons both kinetically and according to boiling range, two of the lumps of said hydrocarbons including: (1) the carbon atoms in aromatic rings and (2) aromatic side chains associated with the aromatic rings, means for simulating said catalytic cracking process based on invariant simultaneous and consecutive reactions of the lumped hydrocarbons, and means for producing from said model an output representing the yield of said reactions based upon said model.

* * * * *